US006875550B2

(12) United States Patent
Miyakawa et al.

(10) Patent No.: US 6,875,550 B2
(45) Date of Patent: Apr. 5, 2005

(54) NON-MAGNETIC SINGLE-COMPONENT TONER, METHOD OF PREPARING THE SAME, AND IMAGE FORMING APPARATUS USING THE SAME

(75) Inventors: Nobuhiro Miyakawa, Nagano-Ken (JP); Takuya Kadota, Nagano-Ken (JP); Hidehiro Takano, Nagano-Ken (JP); Shinji Yasukawa, Nagano-Ken (JP); Masanao Kunugi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 10/191,752

(22) Filed: Jul. 10, 2002

(65) Prior Publication Data

US 2003/0157419 A1 Aug. 21, 2003

(30) Foreign Application Priority Data

| | | |
|---|---|---|
| Jul. 11, 2001 | (JP) | 2001-210603 |
| Sep. 18, 2001 | (JP) | 2001-283183 |
| Sep. 18, 2001 | (JP) | 2001-283351 |
| Sep. 18, 2001 | (JP) | 2001-283699 |
| Sep. 28, 2001 | (JP) | 2001-300083 |
| Sep. 28, 2001 | (JP) | 2001-300084 |
| Sep. 28, 2001 | (JP) | 2001-301472 |
| Sep. 28, 2001 | (JP) | 2001-301473 |
| Dec. 5, 2001 | (JP) | 2001-30939 |
| Mar. 4, 2002 | (JP) | 2002-057125 |

(51) Int. Cl.[7] ..... G03G 9/08

(52) U.S. Cl. ..... 430/108.6; 430/108.7; 430/137.11; 399/252

(58) Field of Search ..... 430/108.6, 108.7, 430/137.11, 108.1; 399/252, 302

(56) References Cited

U.S. PATENT DOCUMENTS

| | | | |
|---|---|---|---|
| 3,779,926 | A | 12/1973 | Merck et al. |
| 5,620,823 | A | 4/1997 | Kambayashi et al. |

(Continued)

FOREIGN PATENT DOCUMENTS

| | | |
|---|---|---|
| JP | 2000-128534 | 5/2000 |
| JP | 2000-181130 | 6/2000 |
| JP | 2001-083732 | 3/2001 |

OTHER PUBLICATIONS

Patent Abstracts of Japan, Publication No. 2001083732; Mar. 30, 2001; Toshiba Tec Corp. XP–002266353, Sep. 27, 1991; Fuji Xerox Co., Ltd.

*Primary Examiner*—John Goodrow
(74) *Attorney, Agent, or Firm*—Sughrue Mion, PLLC

(57) ABSTRACT

A non-magnetic single-component toner 8 of the present invention has toner mother particles 8*a*, and external additives 12 comprising: two hydrophobic silicas 13, 14 of which particle diameters are different from each other, i.e. a mean primary particle diameter of 7 nm to 12 nm and a mean primary particle diameter of 40 nm to 50 nm, and a hydrophobic rutile/anatase type titanium oxide 15 having a spindle shape of which major axial diameter is in a range from 0.02 nm to 0.10 nm and the ratio of the major axial diameter to the minor axial diameter is set to be 2 to 8, wherein the external additives 12 adhere to the toner mother particles 8*a*. By the hydrophobic silicas 13, 14 having work function smaller than the work function of the toner mother particles 8*a*, the negative charging property is imparted to the toner mother particles 8*a* and the fluidity is also insured. On the other hand, by mixing and using hydrophobic rutile/anatase type titanium oxide particles 15 having work function larger than or equal to the work function of the toner mother particles 8*a* together with the hydrophobic silicas 13, 14, the non-magnetic single-component toner 8 is prevented from excessively charged. Therefore, the amount of fog toner on non-image portions is reduced, the transfer efficiency is further improved, the charging property is further stabilized, and the production of reverse transfer toner is further inhibited.

12 Claims, 20 Drawing Sheets

U.S. PATENT DOCUMENTS 5,824,442 A 10/1998 Tanikawa et al.
5,851,715 A * 12/1998 Barthel et al. ..... 430/110
6,130,020 A * 10/2000 Wada et al. ..... 430/110
6,348,291 B1 * 2/2002 Sato ..... 430/108.7
6,379,856 B2 * 4/2002 Sokol et al. ..... 430/108.24
6,555,281 B1 * 4/2003 Nozawa et al. ..... 430/108.7
6,605,402 B2 * 8/2003 Schein et al. ..... 430/108.7

* cited by examiner

FIG. 2
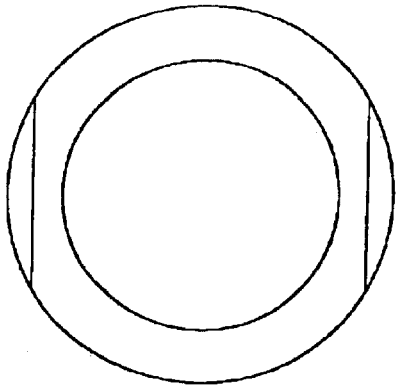
(a)
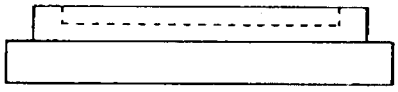
(b)
FIG. 3
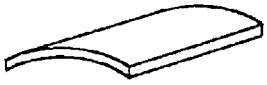
(a)
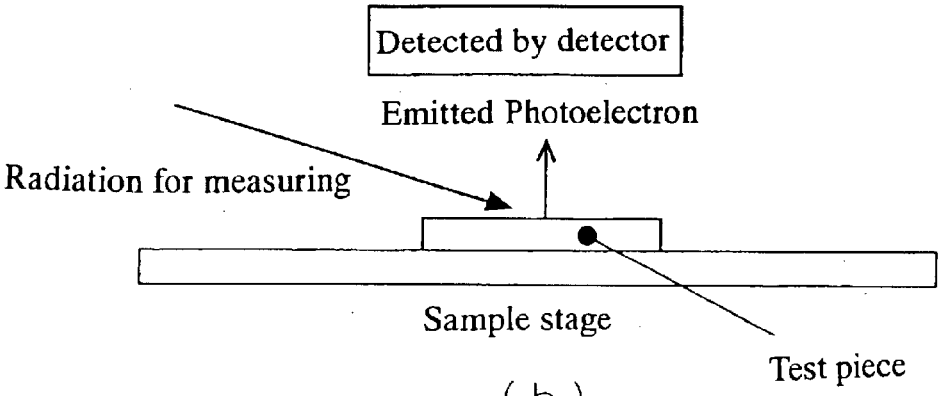
(b)

FIG. 11

X 100,000

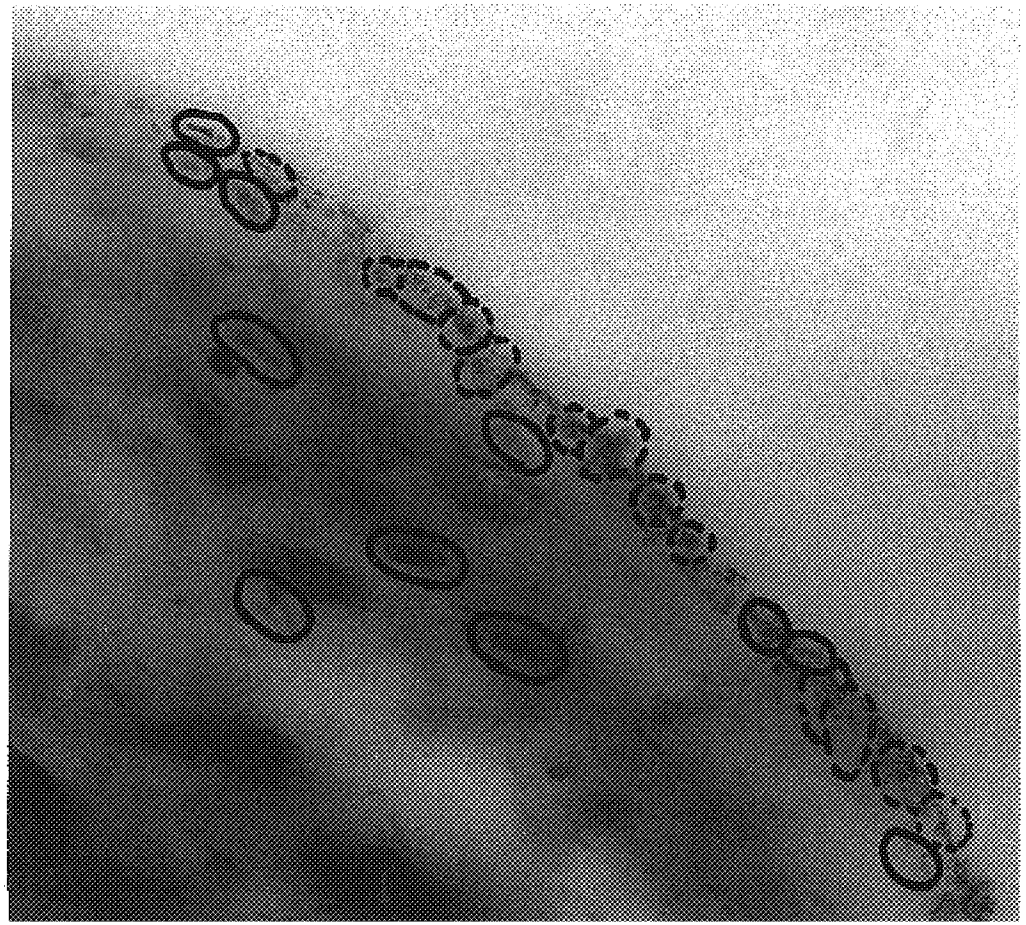

Electron micrograph of a cut surface of toner of Example 10 according to the present invention 0.1 μm

CUT

: Titania

Some particles of titania having an oval (spindle-like) shape are shown in a state adhering to the cut surface in a state liberated or separated when cutting a toner particle (exactly in half, as shown in the right-hand illustration).

: Small-particle negatively chargeable silica

Small particles shown in the micrograph

: Large-particle negatively chargeable silica and Large-particle positively chargeable silica

FIG. 12

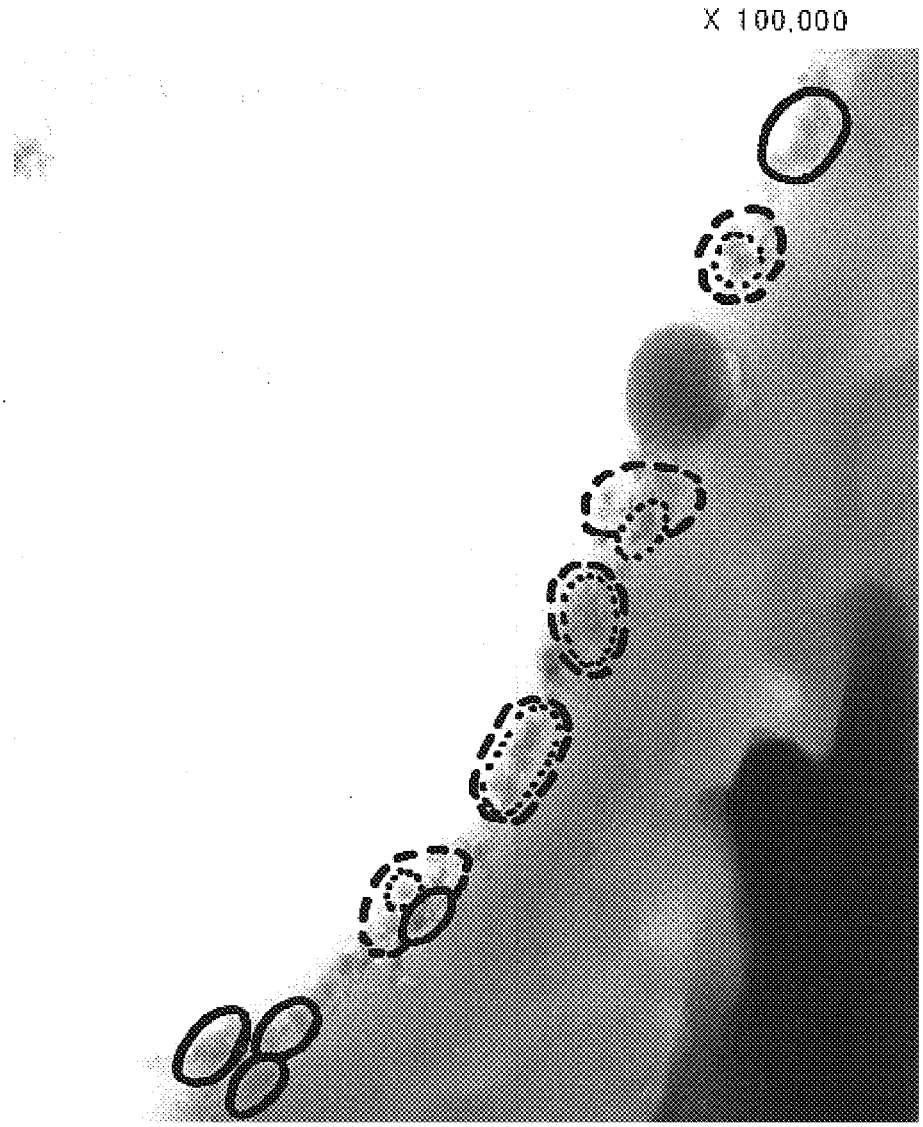

Electron micrograph of a cut surface of toner of Comparative Example 10 (Small- and large-particle negatively chargeable silicas + Titania + Small-particle positively chargeable silica)

Since the charge of the positively chargeable silica is strong, small- and large-particle negatively chargeable silicas are attracted to the positively chargeable silica and thus gathered. Therefore, the tintania can not adhere to the negatively chargeable silicas so that the titania is isolated.

X 100,000

Electron micrograph of a cut surface of toner of Comparative Example 11 (Small- and large-particle negatively chargeable silicas + Titania)

The small- and large-particle negatively chargeable silicas are weakly attached to the surface. The tintania is attracted to the negatively chargeable silicas. These are somehow inhomogeneous.

WF : 5.22[eV] Slope : 5.1 [Y^0.5]

WF : 5.24[eV] Slope : 5.2 [Y^0.5]

WF : 5.29[eV] Slope : 7.1 [Y^0.5]

WF : 5.52[eV] Slope : 15.8 [Y^0.5]

WF : 5.58[eV] Slope : 17.3 [Y^0.5]

NON-MAGNETIC SINGLE-COMPONENT TONER, METHOD OF PREPARING THE SAME, AND IMAGE FORMING APPARATUS USING THE SAME

BACKGROUND OF THE INVENTION

The present invention relates to a non-magnetic single-component toner, to be employed in an image forming apparatus for forming an image by electrophotographic technology, for developing an electrostatic latent image on a latent image carrier of the image forming apparatus, a method of preparing the same, and an image forming apparatus using the same. More particularly, the present invention relates to a non-magnetic single-component toner composed of a large number of mother particles and a large number of external additive particles made of at least silica and titanium oxide, a method of preparing the same, and an image forming apparatus using the same.

In a conventional image forming apparatus, a photoreceptor as a latent image carrier such as a photosensitive drum or a photosensitive belt is rotatably supported to the main body of the image forming apparatus. During the image forming operation, a latent image is formed onto a photosensitive layer of the photoreceptor and, after that, is developed with toner particles to form a visible image. Then, the visible image is transferred to a recording medium. For transferring the visible image, there are a method of directly transferring the visible image to the recording medium by using a corona transfer or a transferring roller, and a method of transferring the visible image to the recording medium via an intermediate transfer member such as a transfer drum or a transfer belt, that is, transferring the visible image twice.

These methods are employed in monochrome image forming apparatuses. In addition, for a color image forming apparatus having a plurality of photoreceptors and developing devices, there is a known method transferring a plurality of unicolor images on a transfer belt or transfer drums to a recording medium such as a paper in such a manner that the respective unicolor images are sequentially superposed on each other, and then fixing these images. The apparatuses according to such a method using a belt are categorized as a tandem type, while the apparatuses according to such a method using drums are categorized as a transfer drum type. Moreover, an intermediate transferring type is also known in which respective unicolor images are sequentially primary-transferred to an intermediate transfer medium and the primary-transferred images are secondary-transferred to a recording medium such as a paper at once. Arranged on the photoreceptor used for any of the aforementioned methods is a cleaning mechanism for cleaning toner particles after developing and residual toner particles remaining on the photoreceptor after the transferring.

As toner used for such an image forming apparatus, dual-component toner composed of a developer and a magnetic carrier is generally known. Though the dual-component toner achieves relatively stable developing, the mixing ratio of the developer and the magnetic carrier is easily varied so that the maintenance for keeping the predetermined mixing ratio is required. Accordingly, magnetic single-component toner has been developed. However the magnetic single-component toner has such a problem that clear color images are not obtained due to the opacity of magnetic material thereof. Therefore, non-magnetic single-component toner has been developed as color toner. For obtaining high-quality record images with the non-magnetic single-component toner, there are problems how to improve the charging stability, the fluidity, and the endurance stability.

Conventionally, toner to be used in an image forming apparatus is surface treated by coating toner mother particles with fine particles of external additives in order to improve the charging stability, the fluidity, and the endurance stability.

Known examples of these external additives for toner are silicon dioxide (silica: $SiO_2$), aluminium oxide (alumina: $Al_2O_3$), and titanium oxide (titania: $TiO_2$) which have negative charging characteristics for imparting a negative polarity to mother particles. These external additives are employed alone or in combination. In this case, these external additives are normally used in combination rather than used alone in order to make full use of their characteristics.

However, such a toner using external additives of different kinds in combination has the following problems:

(1) Even though the toner is treated with eternal additives, the toner has a charge distribution because of the particle size distribution thereof. Therefore, generation of some positively charged toner particles in the toner to be used in negatively charged state is inevitable. As a result of this, in an image forming apparatus which forms images by negative charge reversal developing, the positively charged toner particles adhere to non-image portions of a latent image carrier (photoreceptor), thereby increasing the amount of cleaning toner particles. In addition, as the number of printed sheets of paper increases, the external additive particles are gradually embedded into mother particles. This means that the amount of actually effective external additive particles are reduced, leading to increase in the amount of fog toner and also decrease in the charge of toner particles. The decrease in charge allows the toner particles to scatter.

(2) When a large amount of silica is added to maintain the fluidity of the toner in order to prevent the degradation of the toner, the fixing property should be poor while the fluidity is improved.

(3) Since increase in the amount of silica makes the negative charging capacity of the toner too high. This leads to low density of printed images. To avoid this, titania and/or alumina having relatively low electric resistance are added. However, since the primary particle diameters of titania and alumina are generally small, these are embedded gradually as the number of printed sheets of paper increases. In the embedded state, these can not exhibit their effects.

(4) To obtain excellent full color toners, it is desired to prevent generation of reverse transfer toner particles as possible.

Therefore, it is proposed in Japanese Patent Unexamined Publication No. 2000-128534 to use rutile type titanium oxide, containing anatase type titanium oxide, and having a layer treated with a silane coupling agent, as an external additive. Because of existence of spindle shaped utile type titanium oxide, titanium oxide adhering to toner mother particles is prevented from being embedded in the mother particles. Because of existence anatase type titanium oxide having well affinity with the silane coupling agent, uniform coating layer of the silane coupling agent is provided onto toner mother particles. Accordingly, uniform charge distribution and stabilized charging property can be provided without reducing the triboelectric charging property. In addition, the environment dependency, the fluidity, and caking resistance can be improved. According to the toner disclosed in this publication, the aforementioned problems (1) through (4) can be somewhat resolved.

Additionally, it is proposed in Japanese Patent Unexamined Publication No. 2001-83732 to add rutile/anatase mixed crystal titanium oxide to hydrophobic silica. Accordingly, the fluidity of the toner is improved without impairing color reproducibility, and transparency, stable triboelectric charging property can be obtained irrespective of environmental conditions such as temperature, humidity, and scattering of toner particles can be prevented, thus preventing fog of toner particles on non-image portions. Also according to the toner disclosed in this publication, the aforementioned problems (1) through (3) can be somewhat resolved.

According to the toner disclosed in the aforementioned publications, external additives of titanium oxide can be prevented from being embedded in mother particles so that somewhat stable charging property can be obtained by the effect of rutile type titanium oxide and the fluidity and environmental dependency can be improved by the effect of anatase type titanium oxide. However, the rutile/anatase type titanium oxides are used only as external additives. This means that characteristics of rutile/anatase type titanium oxide, i.e. a feature that they are hardly embedded into mother particles and charge-controlling function, are not fully exhibited and that the degree of improving the stable charging property, the fluidity, and the environment dependency should be limited. That is, in order to effectively solve the aforementioned problems (1)–(4), more improvement of toner is still required.

On the other hand, Japanese Patent Unexamined Publication No. 2000-181130 discloses toner particles made of aluminum oxide-silicone dioxide combined oxide particles which are obtained by flame hydrolysis and also discloses that good fluidity of toner particles and more stable charging behavior (faster chargeability, a higher charge capacity, and permitting constant charging over time) can be provided according to the aforementioned toner particles. However, when aluminum oxide-silicone dioxide combined oxide particles are added as external additive particles to form a negatively chargeable dry type toner, the aluminum oxide components function as positively chargeable sites so as to produce reverse transfer toner particles, thereby increasing fog and thus leading to reduction in transfer efficiency.

SUMMARY OF THE INVENTION

It is an object of the present invention to provide a non-magnetic single-component toner capable of reducing fog toner on non-image portions, capable of further improving transfer efficiency, and capable of making charging property further stable, to provide a method of preparing the same, and to provide an image forming apparatus using the same.

It is another object of the present invention to provide non-magnetic single-component toners to be used as full color toners capable of reducing production of reverse transfer toner particles, capable of making image density uniform, and keeping high image quality over a long time, to provide a method of preparing the same, and to provide an image forming apparatus using the same.

It is still another object of the present invention to provide an image forming apparatus suitable for forming full color images by using an intermediate transfer medium.

It is still another object of the present invention to provide a negatively chargeable dry toner in which aluminum oxide-silicone dioxide combined oxide particles obtained by flame hydrolysis are added to externally adhere to toner mother particles, the toner having excellent uniformity of charging capacity, capable of reducing fog, and capable of improving the transfer efficiency.

To achieve the aforementioned objects, a non-magnetic single-component toner of the present invention has toner mother particles and external additives externally adhering to said toner mother particles, and is characterized in that said external additives comprise, at least, a small-particle hydrophobic silica having a work function smaller than the work function of said toner mother particles for imparting the negative charging property to said toner mother particles and of which mean primary particle diameter is 20 nm or less, preferably in a range from 7 to 12 nm, a large-particle hydrophobic silica having a work function smaller than the work function of said toner mother particles for imparting the negative charging property to said toner mother particles and of which mean primary particle diameter is 30 nm or more, preferably in a range form 40 nm to 50 nm, and a hydrophobic rutile/anatase type titanium oxide having a work function nearly equal to the work function of said toner mother particles and having a spindle shape of which major axial diameter is in a range from 0.02 $\mu$m to 0.10 $\mu$m and the ratio of the major axial diameter to the minor axial diameter is set to be 2 to 8.

The non-magnetic single-component toner of the present invention is characterized in that said small-particle hydrophobic silica is added in an amount larger than the adding amount of said hydrophobic rutile/anatase type titanium oxide.

The non-magnetic single-component toner of the present invention is characterized in that the total amount of said external additives is 0.5% by weight or more and 4.0% by weight or less relative to the weight of the toner mother particles.

A method of producing a non-magnetic single-component toner of the present invention is characterized in that said toner mother particles and said two hydrophobic silicas of which mean primary particle diameters are different from each other are first mixed to make a mixture, and said hydrophobic rutile/anatase type titanium oxide is then added into said mixture and mixed.

A non-magnetic single-component toner of the present invention is prepared by adding at least a hydrophobic negatively chargeable external additive which has a negative charging property to toner mother particles and of which entire work function is set to be smaller than the work function of said toner mother particles, and is characterized in that a hydrophobic positively chargeable external additive, surface-treated with a material having a positive charging property to said toner mother particles and of which entire work function is set to be smaller than the work function of said toner mother particles is also added.

The non-magnetic single-component toner of the present invention is characterized in that said hydrophobic negatively chargeable silica is composed of a small-particle negatively chargeable silica having a small mean primary particle diameter and a large-particle negatively chargeable silica having a mean primary particle diameter larger than that of said small-particle negatively chargeable silica, and said hydrophobic positively chargeable silica has a mean primary particle diameter equal or nearly equal to that of said large-particle negatively chargeable silica.

A method of producing a non-magnetic single-component toner of the present invention is characterized in that said toner mother particles and said small-particle and large-particle negatively chargeable silicas are first mixed to make a mixture, said hydrophobic rutile/anatase type titanium oxide is then added into said mixture and mixed, and said positively chargeable silica is additionally added and mixed.

A non-magnetic single-component toner of the present invention is prepared by adding at least a hydrophobic negatively chargeable external additive having a negative charging property to toner mother particles, and is characterized in that a hydrophobic positively chargeable external additive, surface-treated with a material having a positive charging property to said toner mother particles and having a work function which is larger than the work function of said negatively chargeable external additive, and a low-resistance external additive having relatively low electric resistance are also added.

A non-magnetic single-component toner of the present invention is characterized in that the total amount of the entire external additives including said negatively chargeable and positively chargeable external additives is set to be in a range from 0.5% by weight to 4.0% by weight relative to the weight of said toner mother particles.

An image forming apparatus of the present invention is an image forming apparatus having a predetermined gap between a latent image carrier and a development roller and is structured such that the development roller carries a non-magnetic single component toner comprising toner mother particles coated with external additives to develop an electrostatic latent image on said latent image carrier according to the non-contact development, and is characterized in that said external additives include at least a hydrophobic rutile/anatase type titanium oxide having a work function larger than or nearly equal to the work function of said toner mother particles and of which each particle is in a spindle shape.

An image forming apparatus of the present invention is an image forming apparatus which is structured such that an electrostatic latent image on a latent image carrier is developed with a non-magnetic single component toner comprising toner mother particles coated with external additives to form a toner image and the toner image is transferred to an intermediate transfer medium, and is characterized in that said external additives include at least a hydrophobic rutile/anatase type titanium oxide having a work function larger than or nearly equal to the work function of said toner mother particles and of which each particle is in a spindle shape.

The image forming apparatus of the present invention is characterized in that said external additives include a hydrophobic silica having a work function smaller than the work function of said toner mother particles for imparting a negative charging property to said toner mother particles.

The image forming apparatus of the present invention is characterized in that said hydrophobic silica comprises a small-particle hydrophobic silica having a work function smaller than the work function of said toner mother particles for imparting the negative charging property to said toner mother particles and of which mean primary particle diameter is 20 nm or less, preferably in a range from 7 to 16 nm and a large-particle hydrophobic silica having a work function smaller than the work function of said toner mother particles for imparting the negative charging property to said toner mother particles and of which mean primary particle diameter is 30 nm or more, preferably in a range form 40 nm to 50 nm.

A non-magnetic single-component toner of the present invention is prepared by adding at least a negatively chargeable external additive having a negative charging property to toner mother particles, and is characterized in that a positively chargeable external additive, having a positive charging property to said toner mother particles and having a work function which is larger than the work function of said negatively chargeable external additive, is also added.

The non-magnetic single-component toner of the present invention is characterized in that the total amount of the entire external additives including said positively chargeable external additive is set to be in a range from 0.5% by weight to 4.0% by weight relative to the weight of said toner mother particles.

The non-magnetic single-component toner of the present invention is characterized in that said negatively chargeable external additive is a hydrophobic negatively chargeable silica and said positively chargeable external additive is a hydrophobic positively chargeable silica.

The non-magnetic single-component toner of the present invention is characterized in that said hydrophobic negatively chargeable silica is composed of a small-particle negatively chargeable silica having a small mean primary particle diameter and a large-particle negatively chargeable silica having a mean primary particle diameter larger than that of said small-particle negatively chargeable silica, and said hydrophobic positively chargeable silica has a mean primary particle diameter equal or nearly equal to that of said large-particle negatively chargeable silica.

The non-magnetic single-component toner of the present invention is characterized in that a hydrophobic rutile/anatase type titanium oxide having a work function nearly equal to or larger than the work function of said toner mother particles is added, and that said hydrophobic negatively chargeable silica is added in an amount larger than the total adding amount of said hydrophobic positively chargeable silica and said hydrophobic rutile/anatase type titanium oxide.

The non-magnetic single-component toner of the present invention is characterized in that the amount of said hydrophobic positively chargeable silica is set to be 30% by weight or less of the total weight of said hydrophobic negatively chargeable silica.

A method of producing a non-magnetic single-component toner of the present invention is characterized in that said toner mother particles and said negatively chargeable silica are first mixed to make a mixture, said hydrophobic rutile/anatase type titanium oxide is then added into said mixture and mixed, and said positively chargeable silica is additionally added and mixed.

An image forming apparatus of the present invention is characterized in that it is a full color image forming apparatus of an intermediate transfer type employing an intermediate transfer medium and using non-magnetic single-component toners as claimed in claim 14 as toners of four colors: cyan, magenta, yellow, and black.

The image forming apparatus of the present invention is characterized in that said intermediate transfer medium comprises a belt.

A non-magnetic single-component toner of the present invention has toner mother particles and external additives externally adhering to toner mother particles, and is characterized in that at least a hydrophobic rutile/anatase type titanium oxide and hydrophobic metallic oxide particles of which work function is smaller than the work function of said rutile/anatase type titanium oxide are used as said external additives.

The non-magnetic single-component toner of the present invention is characterized in that a silicon dioxide set to have a mean primary particle diameter smaller than the mean primary particle diameter of said rutile/anatase type titanium oxide and having a negatively charging property is also used as said external additive.

The non-magnetic single-component toner of the present invention is characterized in that said metallic oxide particles are alumina-silica combined oxide particles, silicon dioxide, or aluminum oxide.

The non-magnetic single-component toner of the present invention is characterized in that the non-magnetic single-component toner is a pulverized toner of which toner mother particles are prepared by the pulverization method or a polymerized toner of which toner mother particles are prepared by the polymerization method.

The non-magnetic single-component toner of the present invention is characterized in that the degree of circularity of the non-magnetic single-component toner is set to be 0.91 (value measured by FPIA2100) or more.

The non-magnetic single-component toner of the present invention is characterized in that the particle diameter ($D_{50}$), as 50% particle diameter based on the number, of the non-magnetic single-component toner is set to be 9 $\mu$m or less.

A negatively chargeable dry toner of the present invention is characterized in that aluminum oxide-silicon dioxide combined oxide particles, obtained by flame hydrolysis, and silicon dioxide particles are added to externally adhere to toner mother particles.

A negatively chargeable dry toner of the present invention is characterized in that aluminum oxide-silicon dioxide combined oxide particles, obtained by flame hydrolysis, and silicon dioxide particles are added to externally adhere to toner mother particles, wherein said combined oxide particles has two work functions: a first work function in a range from 5.0 eV to 5.4 eV and a second work function in a range from 5.4 eV to 5.7 eV, and wherein the work function of the toner mother particles is in a range form 5.3 eV to 5.65 eV which is larger than the first work function of said combined oxide particles and smaller than the second work function of said combined oxide particles.

The negatively chargeable dry toner of the present invention is characterized in that the aluminum oxide-silicon dioxide combined oxide particles obtained by flame hydrolysis have a primary particle diameter from 7 to 80 nm and a distribution in which particles having a particle diameter of 20 nm or more occupy 30% or more based on the number.

The negatively chargeable dry toner of the present invention is characterized in that the aluminum oxide-silicon dioxide combined oxide particles are added at a rate of 0.1% by weight to 3% by weight relative to the toner mother particles.

The negatively chargeable dry toner of the present invention is characterized in that the toner mother particles are made of polyester resin.

The negatively chargeable dry toner of the present invention is characterized in that the toner mother particles are made of styrene-acrylic polymeric resin.

The negatively chargeable dry toner of the present invention is characterized in that the degree of circularity of the negatively chargeable dry toner is 0.94 or more.

The negatively chargeable dry toner of the present invention is characterized in that the toner mother particles are prepared by the polymerization method and the particle diameter as 50% particle diameter based on the number of the negatively chargeable dry toner is 8 $\mu$m or less.

The negatively chargeable dry toner of the present invention is characterized in that the negatively chargeable dry toner is a toner to be used in a full color image forming apparatus.

The negatively chargeable dry toner of the present invention is characterized in that the negatively chargeable dry toner is used for conducting the reverse development.

According to the non-magnetic single-component toner of the present invention structured as mentioned above, the two hydrophobic silica of which mean particle diameters are different from each other and the hydrophobic rutile/anatase type titanium oxide are used together. Therefore, since the work functions of the hydrophobic silicas are smaller than the work function of the mother particles, the hydrophobic silicas directly adhere to the toner mother particles. Since the work function of the hydrophobic rutile/anatase type titanium oxide is nearly equal to the work function of the toner mother particles and larger than the work functions of the hydrophobic silicas, the hydrophobic rutile/anatase type titanium oxide hardly adhere to the mother particle so that the hydrophobic rutile/anatase type titanium oxide is attached to the toner mother particles in the state attracted by the hydrophobic silicas adhering to the toner mother particles.

Therefore, characteristics of rutile/anatase type titanium oxide, i.e. the feature that they are hardly embedded into mother particles and charge-controlling function, can be effectively exhibited. Synergistic function of features owned by the hydrophobic silicas i.e. the negative charging property and fluidity, and characteristics owned by the hydrophobic rutile/anatase type titanium oxide, i.e. relatively low resistance and a characteristic capable of preventing excessive negative charging, can be imparted to the toner mother particles. Therefore, the non-magnetic single-component toner can be prevented from excessively negatively charged without reducing its fluidity, thereby having improved negative charging property.

Since the two hydrophobic negatively chargeable silicas of which mean particle diameters are different from each other are used as external additives, the small-particle negatively chargeable silica particles are embedded in the toner mother particles. Since the work function of the hydrophobic rutile/anatase type titanium oxide is larger than the work function of hydrophobic silicas, the hydrophobic rutile/anatase type titanium oxide sticks to the embedded hydrophobic silica because of the contact potential difference by the difference in work function so that the hydrophobic rutile/anatase type titanium oxide is hardly liberated from the toner mother particles. In addition, since the large-particle hydrophobic negatively chargeable silica and the large-particle hydrophobic positively chargeable silica stick to the surface of each toner mother particle, the surface of each toner mother particle can be covered evenly with the small-particle and large-particle hydrophobic negatively chargeable silicas, the hydrophobic positively chargeable silica and the hydrophobic rutile/anatase type titanium oxide. Therefore, the negative charging of the non-magnetic single-component toner can be kept stable for longer period of time and stable image quality can be provided even for successive printing. Particularly, the hydrophobic negatively chargeable silica of which mean primary particle diameter is small is added in an amount larger than the total adding amount of the hydrophobic positively chargeable silica and the hydrophobic rutile/anatase type titanium oxide, thereby keeping the negative charging of the non-magnetic single-component toner stable for further longer period of time.

Therefore, the amount of fog toner on non-image portions is further reduced, the transfer efficiency is further improved, the charging property is further stabilized, and the production of reverse transfer toner is further inhibited. Because of reduction in the amount of fog toner and improvement of the transfer efficiency, the consumption of toner can be reduced.

In case of using a positively chargeable silica as a fluidity improving agent, use of a large-particle positively chargeable silica reduces the amount of fog toner and the amount of reverse transfer without reducing the fixing property rather than the use of the small-particle positively chargeable silica.

When the hydrophobic silica and the hydrophobic rutile/anatase type titanium oxide are used together as the external additives of toner of which particle diameter is relatively small, the amount of hydrophobic silica can be reduced as compared to the amount of hydrophobic silica of a conventional case in which silica particles are used alone, thereby improving the fixing property.

In either of the pulverization method and the polymerization method, toner having small particle diameter has a problem that the charge of the toner becomes too large in the initial stage because the adding amount of silica particles should be increased in case of such a toner having small particle size. In addition, as printing proceeds, the effective surface areas of the silica particles are reduced due to embedment and/or scattering of silica particles. This reduces the charge of the toner, thus increasing the amount of reverse transfer toner the variation of image density and increasing the amount of fog toner. This means the increase of the toner consumption. In the non-magnetic single-component toner, however, the small-particle and large particle hydrophobic negatively chargeable silica, the hydrophobic positively chargeable silica, and the hydrophobic rutile/anatase type titanium oxide are used together, thereby reducing the amount of the hydrophobic negatively chargeable silica and thus effectively inhibiting reverse transfer toner, variation in image density, and fog toner on non-image portions.

Since the production of reverse transfer toner can be effectively inhibited, the non-magnetic single-component toner of the present invention is advantageously used as a toner for a full color image forming apparatus, because the improved uniformity in image density can be kept for a longer period of time. Therefore, high-quality full color image can be provided for a longer period of time.

According to the method of producing a non-magnetic single-component toner of the present invention, the toner mother particles and the two hydrophobic silicas of which mean primary particle diameters are different from each other are first mixed to make a mixture, and the hydrophobic rutile/anatase type titanium oxide is then added into the mixture and mixed, whereby the hydrophobic rutile/anatase type titanium oxide can be securely attached to the toner mother particles in the state attracted by the hydrophobic silicas adhering to the toner mother particles.

By adding a hydrophobic positively chargeable external additive, which is surface-treated with a material having a positive charging property to said toner mother particles and of which entire work function is set to be smaller than the mother particles, to toner mother particles in which at least a hydrophobic negatively chargeable external additive is added, the work functions of the hydrophobic negatively chargeable external additive and the hydrophobic positively chargeable external additives directly adhere to the surfaces of the toner mother particles because the work functions of the hydrophobic negatively chargeable external additive and the hydrophobic positively chargeable external additives are smaller than the work function of the mother particles.

Therefore, the positively chargeable silica exhibits its function as micro carrier, thus speeding up the risetime for charging the toner mother particles. As a result of this, the production of reverse transfer toner and the generation of fog can be further effectively inhibited.

By using the hydrophobic negatively chargeable silica and the hydrophobic rutile/anatase type titanium oxide and/or the hydrophobic positively chargeable silica together, the hydrophobic negatively chargeable silica and hydrophobic positively chargeable silica directly adhere to the toner mother particles because the work functions of the hydrophobic negatively chargeable silica and hydrophobic positively chargeable silica are smaller than the work function of the mother particles, while the hydrophobic rutile/anatase type titanium oxide adhere to the toner mother particles in the state attracted by the hydrophobic negatively chargeable silica adhering to the toner mother particles because the work function of the hydrophobic rutile/anatase type titanium oxide is nearly equal to the work function of the toner mother particles and larger than the work functions of the hydrophobic negatively chargeable silica.

Therefore, characteristics of rutile/anatase type titanium oxide, i.e. the feature that they are hardly embedded into mother particles and charge-controlling function, can be effectively exhibited. Synergistic function of features owned by the hydrophobic negatively chargeable silica i.e. the negative charging property and fluidity, and characteristics owned by the hydrophobic rutile/anatase type titanium oxide, i.e. relatively low resistance and a characteristic capable of preventing excessive negative charging, can be imparted to the toner mother particles. Therefore, the non-magnetic single-component toner can be prevented from excessively negatively charged without reducing its fluidity, thereby having improved negative charging property. As a result, the production of reverse transfer toner and the generation of fog can be effectively inhibited.

According to the method of producing a non-magnetic single-component toner of the present invention, the toner mother particles and the small-particle and large-particle negatively chargeable silicas are first mixed to make a mixture, the hydrophobic rutile/anatase type titanium oxide is then added into said mixture and mixed, and the positively chargeable silica is additionally added and mixed, whereby the hydrophobic rutile/anatase type titanium oxide can be securely attached to the toner mother particles in the state attracted by the hydrophobic silicas adhering to the toner mother particles and the positively chargeable silica can directly adhere to the toner mother particles. Therefore, the non-magnetic single-component toner of the present invention capable of effectively inhibiting the production of reverse transfer toner and fog toner and the variation in image density can be securely produced.

By adding a hydrophobic positively chargeable external additive, surface-treated with a material having a positive charging property to said toner mother particles and a low-resistance external additive having relatively low electric resistance to toner mother particles in which at least a hydrophobic negatively chargeable external additive is added, the positively chargeable external additive exhibits its function as micro carrier, thus speeding up the risetime for charging the toner mother particles and preventing the negative excessive charging and preventing the production of positively charged toner because of the low-resistance external additive. As a result of this, the production of reverse transfer toner and the generation of fog can be further effectively inhibited.

By using the hydrophobic rutile/anatase type titanium oxide as one of the external additives of the non-magnetic single-component toner, the amount of positively charged toner i.e. inversely charged toner can be reduced with little change in the mean charge amount of the non-magnetic single-component toner. In the non-contact developing process (jumping developing process), the non-magnetic single-component toner vibrates between the surface of the development roller and the surface of the organic photoreceptor to develop an electrostatic latent image on a latent image carrier. During the vibration, positively charged small-size toner particles can be negatively charged. Therefore, by conducting the non-contact developing process by using the non-magnetic single-component toner containing at least the rutile/anatase type titanium oxide as one of the external additives, the amount of positively charged toner can be significantly reduced, thereby effectively reducing the amount of fog toner and effectively inhibiting the variation in image density.

Since the hydrophobic rutile/anatase type titanium oxide having a work function larger than or nearly equal to the work function of the toner mother particles and having a spindle shape is used as an external additive of the non-magnetic single-component toner, the amount of positively charged toner i.e. inversely charged toner can be effectively reduced with little change in the mean charge amount of the non-magnetic single-component toner. Therefore, the amount of reverse transfer toner can be effectively reduced, thereby improving the transfer efficiency and reducing the amount of fog toner, leading to effective inhibition of the variation in image density. Therefore, the negative charging of the non-magnetic single-component toner can be kept stable for longer period of time and stable image quality can be provided even for successive printing.

When full color images are formed by organically combining that the production of reverse transfer toner is inhibited by using the non-magnetic single-component toner containing at least the hydrophobic rutile/anatase type titanium oxide as the external additive and that the intermediate transfer by an intermediate transfer medium is conducted, the improved uniformity in image density can be kept for a longer period of time. Therefore, high-quality full color image can be provided for a longer period of time.

By adding a hydrophobic positively chargeable external additive having positive charging property to the toner mother particle to the toner mother particles in which at least a hydrophobic negatively chargeable external additive is added, the positively chargeable external additive exhibits its function as micro carrier, thus speeding up the risetime for charging the toner mother particles and preventing the negative excessive charging and effectively inhibiting the production of reverse transfer toner and the generation of fog.

Since the rutile/anatase type titanium oxide has a spindle shape, the particles of the rutile/anatase type titanium oxide are hardly embedded in the toner mother particles so that the particles can be securely attached to the surfaces of the toner mother particles. Hydrophobic metallic oxide fine particles having a work function smaller than that of the rutile/anatase type titanium oxide adhere to the particles of the rutile/anatase type titanium oxide.

Synergistic function of characteristics owned by the hydrophobic rutile/anatase type titanium oxide, i.e. the excessive negative charging preventing function and the fluidity improving function, and characteristics owned by the metallic oxide fine particles can be imparted to the toner mother particles. That is, the synergistic function is not the mere combination of the two function owned by the rutile/anatase type titanium oxide and the function by the characteristics owned by the metallic oxide fine particles. The excessive effects by the aforementioned two functions owned by the rutile/anatase type titanium oxide can be controlled by the function of the metallic oxide fine particles. The excessive negative charging preventing function and the fluidity improving function owned by the rutile/anatase type titanium oxide can be effectively exhibited.

Therefore, the non-magnetic single-component toner has further improved negative charging property, thereby effectively inhibiting the production of reverse transfer toner and generation of fog. Therefore, the transfer efficiency can be further improved. The negative charging property of the non-magnetic single component toner can be kept stable for a longer period of time, thus providing high quality images having improved sharpness and providing stable image quality even for successive printing. In addition, because of the improved fluidity of the toner, a uniform thin layer of toner can be formed by a toner regulating member.

In the negatively chargeable dry toner of the present invention, since the aluminum oxide-silicon dioxide combined oxide particles which are obtained by flame hydrolysis are added to externally adhere to toner mother particles, the negatively chargeable dry toner has excellent uniformity of charging capacity of toner particles and is capable of reducing the amount of fog and capable of improving the transfer efficiency. Further, the transfer efficiency to a recording medium or a transfer medium can be improved, thus significantly reducing the amount of toner left after transfer. In addition, the load to a cleaning unit can be reduced, a smaller-size cleaning container can be used, and the consumption of toner can be minimized, thereby reducing the running cost.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIGS. 2(*a*), 2(*b*) are illustrations showing a measuring cell used for measuring the work function of the toner, wherein FIG. 2(*a*) is a front view thereof and FIG. 2(*b*) is a side view thereof;

FIGS. 3(*a*), 3(*b*) are illustrations for explaining the method of measuring the work function of a cylindrical member of an image forming apparatus, wherein FIG. 3(*a*) is a perspective view showing the configuration of a test piece for measurement and FIG. 3(*b*) is an illustration showing the measuring state;

FIG. 11 is a microphotograph of a negatively chargeable toner of Example 10;

FIG. 12 is a microphotograph of a negatively chargeable toner of Comparative Example 10 according to the present invention;

DESCRIPTION OF THE PREFERRED EMBODIMENTS

Figure 1:
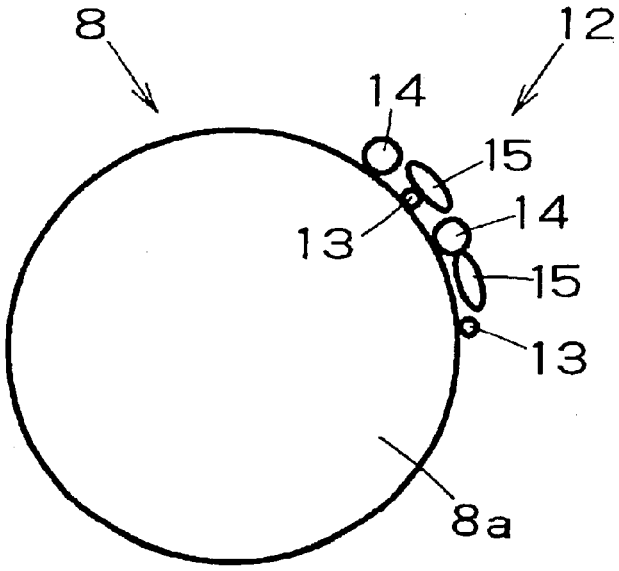
FIG. 1 is an illustration schematically showing one embodiment of non-magnetic single-component toner according to the present invention.

FIG. 1 is an illustration schematically showing a first embodiment of non-magnetic single-component toner according to the present invention.

As shown in FIG. 1, a non-magnetic single-component toner of the first embodiment is a negatively chargeable toner comprising toner mother particles 8*a* and external additives 12 externally adhering to the toner mother particles 8*a*. As the external additives 12, small-particle and large-particle hydrophobic silicas ($SiO_2$) 13, 14, i.e. hydrophobic silica ($SiO_2$) 13 of which mean primary particle diameter is small and hydrophobic silica ($SiO_2$) 14 of which mean primary particle diameter is large, and hydrophobic rutile/anatase type titanium oxide ($TiO_2$) 15 are used.

The mean primary particle diameter of the small-particle hydrophobic silica 13 is set to 20 nm or less, preferably in a range from 7 to 12 nm (this is equal to "from 7 nm to 12 nm". The same notation is used for other units.) and the mean primary particle diameter of large-particle hydrophobic silica 14 is set to 30 nm or more, preferably in a range from 40 to 50 nm. The hydrophobic rutile/anatase type titanium oxide 15 consists of rutile type titanium oxide and anatase type titanium oxide which are mixed at a predetermined mixed crystal ratio and may be obtained by a production method disclosed in Japanese Patent Unexamined Publication No. 2000-128534. The hydrophobic rutile/anatase type titanium oxide particles 15 are each formed in a spindle shape of which major axial diameter is in a range from 0.02 to 0.10 $\mu$m and the ratio of the major axial diameter to the minor axial diameter is set to be 2 to 8.

In the non-magnetic single-component toner 8 of this embodiment, the negative charging property is imparted to the toner mother particles by the hydrophobic silicas 13, 14 having work function (numerical examples will be described later) smaller than the work function (numerical examples will be described later) of the toner mother particles 8*a*. On the other hand, by mixing and using hydrophobic rutile/anatase type titanium oxide particles 15 having work function larger than or equal to the work function of the toner mother particles 8*a* (the difference in work function therebetween is in a range of 0.25 eV or less), the toner mother particles 8*a* is prevented from excessively charged.

The work function ($\Phi$) is a value measured by a surface analyzer (AC-2, produced by Riken Keiki Co., Ltd) with radiation amount of 500 nW and is known as minimum energy necessary for taking out one electron from the substance. The smaller the work function of a substance is, it is easier to take out electrons from the substance. The larger the work function of a substance is, it is harder to take out electrons from the substance. Accordingly, when a substance having a small work function and a substance having a large work function are in contact with each other, the substance having a small work function is positively charged and the substance having a large work function is negatively charged. Work function can be numerically indicated as energy (eV) necessary for taking out one electron from the substance.

According to the present invention, the work functions of the non-magnetic single-component toner and the respective members of the image forming apparatus are measured as follows. That is, in the aforementioned surface analyzer, a heavy hydrogen lump is used, the radiation amount for the development roller plated with metal is set to 10 nW, the radiation amount for others is set to 500 nW, and a monochromatic beam is selected by a spectrograph, samples are radiated with a spot size of 4 square mm, an energy scanning range of 3.4–6.2 eV, and a measuring time of 10 sec/one point. The quantity of photoelectrons emitted from each sample surface is detected. Work function is calculated by using a work function calculating software based on the quantity of photoelectrons and measured with repeatability (standard deviation) of 0.02 eV. For ensuring the repeatability of data, the samples to be measured are left for 24 hours at environmental temperature and humidity of 25° C., 55% RH before measurement.

In case of measuring the work function of sample toner, a measurement cell for toner comprising a stainless steel disk which is 13 mm in diameter and 5 mm in height and is provided at the center thereof with a toner receiving concavity which is 10 mm in diameter and 1 mm in depth as shown in FIGS. 2(*a*), 2(*b*) is used. For measurement, toner is entered in the concavity of the cell by using a weighting spoon without pressure and then is leveled by using a knife edge. The measurement cell filled with the toner is fixed to a sample stage at a predetermined position. Then, measurement is conducted under conditions that the radiation amount is set to 500 nW, and the spot size is set to 4 square mm, the energy scanning range is set to 4.2–6.2 eV in the same manner as described later with reference to FIG. 3(*b*).

In case that the sample is a cylindrical member of the image forming apparatus such as a photoreceptor or a development roller, the cylindrical member is cut to have a width of 1–1.5 cm and is further cut in the lateral direction along ridge lines so as to obtain a test piece of a shape as shown in FIG. 3(*a*). The test piece is fixed to the sample stage at the predetermined position in such a manner that a surface to be radiated is parallel to the direction of radiation of measurement light as shown in FIG. 3(*b*). Accordingly, photoelectron emitted from the test piece can be efficiently detected by a detector (photomultiplier).

In case that the sample is an intermediate transfer belt, a regulating blade, or a sheet-like photoreceptor, such a member is cut to have at least 1 square cm as a test piece because the radiation is conducted to a spot of 4 square mm. The test piece is fixed to the sample stage and measured in the same manner as described with reference to FIG. 3(*b*).

In this surface analysis, photoelectron emission is started at a certain energy value (eV) while scanning excitation energy of monochromatic beam from the lower side to the higher side. The energy value is called "work function (eV)". FIG. 15 through FIG. 23 show charts for respective examples obtained by using the surface analyzer and the details will be described later.

The toner mother particles used in the non-magnetic single-component toner 8 of the first embodiment may be prepared by the pulverization method or the polymerization method. Hereinafter, the preparation method will be described.

First, description will be made as regard to the preparation of the non-magnetic single-component toner 8 of the first embodiment employing toner mother particles made by the pulverization method (hereinafter, such a toner will be referred to as a pulverized toner).

For making the pulverized toner 8 of first embodiment, a pigment, a release agent, and a charge control agent are uniformly mixed to a resin binder by a Henschel mixer, melt and kneaded by a twin-shaft extruder. After cooling process, they are classified through the rough pulverizing-fine pulverizing process. Further, fluidity improving agents as external additives are added to the toner mother particles 8*a* thus obtained. In this manner, the toner is obtained.

As the binder resin, a known binder resin for toner may be used. Preferable examples are homopolymers or copolymers containing styrene or styrene substitute, such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymer, styrene-methacrylate ester copolymers, styrene-acrylate ester-methacrylate ester copolymers, styrene-α-chloracrylic methyl copolymer, styrene-acrylonitrile-acrylate ester copolymers, and styrene-vinyl methyl ether copolymers; polyester resins, epoxy resins, polyurethane modified epoxy resins, silicone modified epoxy resin, vinyl chloride resins, rosin modified maleic acid resins, phenyl resins, polyethylene, polypropylene, ionomer resins, polyurethane resins, silicone resins, ketone resins, ethylene-ethylacrylate copolymers, xylene resins, polyvinyl butyral resins, terpene resins, phenolic resins, and aliphatic or alicyclic hydrocarbon resins. These resins may be used alone or in blended state. Among these resins, styrene-acrylate ester-based resins, styrene-methacrylate ester-based resins, polyester resins, and epoxy resin are especially preferable in the present invention. The binder resin preferably has a glass-transition temperature in a range from 50 to 75° C. and a flow softening temperature in a range from 100 to 150° C.

As the coloring agent, a known coloring agent for toner may be used. Examples are Carbon Black, Lamp Black, Magnetite, Titan Black, Chrome Yellow, Ultramarine Blue, Aniline Blue, Phthalocyanine Blue, Phthalocyanine Green, Hansa Yellow G, Rhodamine 6G, Chalcone Oil Blue, Quinacridon, Benzidine Yellow, Rose Bengal, Malachite Green lake, Quinoline Yellow, C.I. Pigment red 48:1, C.I. Pigment red 122, C.I. Pigment red 57:1, C.I. Pigment red 122, C.I. Pigment red 184, C.I. Pigment yellow 12, C.I. Pigment yellow 17, C.I. Pigment yellow 97, C.I. Pigment yellow 180, C.I. Solvent yellow 162, C.I. Pigment blue 5:1, and C.I. Pigment blue 15:3. These dyes and pigments can be used alone or in blended state.

As the release agent, a known release agent for toner may be used. Specific examples are paraffin wax, micro wax, microcrystalline wax, candelilla wax, carnauba wax, rice wax, montan wax, polyethylene wax, polypropylene wax, oxygen convertible polyethylene wax, and oxygen convertible polypropylene wax. Among these, polyethylene wax, polypropylene wax, carnauba wax, or ester wax is preferably employed.

As the charge control agent, a known charge control agent for toner may be used. Specific examples are Oil Black, Oil Black BY, Bontron S-22 (available from Orient Chemical Industries, LTD.), Bontron S-34 (available from Orient Chemical Industries, LTD.); metal complex compounds of salicylic acid such as E-81 (available from Orient Chemical Industries, LTD.), thioindigo type pigments, sulfonyl amine derivatives of copper phthalocyanine, Spilon Black TRH (available from Hodogaya Chemical Co., Ltd.), calix arene type compounds, organic boron compounds, quaternary ammonium salt compounds containing fluorine, metal complex compounds of monoazo, metal complex compounds of aromatic hydroxyl carboxylic acid, metal complex compounds of aromatic di-carboxylic acid, and polysaccharides. Among these, achromatic or white agents are especially preferable for color toner.

As the fluidity improving agent as the external additives, at least the aforementioned small-particle hydrophobic negatively chargeable silica 13, the aforementioned large-particle hydrophobic negatively chargeable silica 14, and the aforementioned hydrophobic rutile/anatase type titanium oxide 15 are used. One or more of inorganic and organic known fluidity improving agents for toner may be additionally used in a state blended with the above fluidity improving agents. Examples of inorganic or organic fluidity improving agents are fine particles of alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, calcium stearate, metallic salt titanate, and silicon metallic salt. These fine particles are preferably processed by a hydrophobic treatment with a silane coupling agent, a titanate coupling agent, a higher fatty acid, or silicone oil. Examples of hydrophobic treatment agents are dimethyldichlorosilane, octyltrimethoxysilane, hexamethyldisilazane, silicone oil, octyl-trichlorosilane, decyl-trichlorosilane, nonyl-trichlorosilane, (4-iso-propylphenyl)-trichlorosilane, dihexyldichlosilane, (4-t-butylphenyl)-trichlorosilane, dipentyle-dichlorosilane, dihexyle-dichlorosilane, dioctyle-dichlorosilane, dinonyle-dichlorosilane, didecyle-dichlorosilane, di-2-ethylhexyl-dichlorosilane, di-3,3-dimehylpentyl-dichlorosilane, trihexyl-chlorosilane, trioctyl-chlorosilane, tridecyl-chlorosilane, dioctyl-methyl-chlorosilane, octyl-dimethyl-chlorosilane, and (4-iso-propylphenyl)-diethyl-chlorosilane. Besides the aforementioned fine resin particles, examples include acrylic resin, styrene resin, and fluororesin.

Table 1 shows proportions (parts by weight) of components in the pulverized toner 8 of the first embodiment.

TABLE 1

| | |
|---|---|
| Binder resin | Par 100 parts by weight |
| Coloring agent | 0.5–15 parts, preferably 1–10 parts by weight |
| Release agent | 1–10 parts, preferably 2.5–8 parts by weight |
| Charge control agent | 0.1–7 parts, preferably 0.5–5 parts by weight |
| Fluidity improving agent | 0.1–5 pars, preferably 0.5–4 parts by weight |

As shown in Table 1, par 100 parts by weight of the binder resin, the coloring agent is in a range form 0.5 to 15 parts by weight, preferably from 1 to 10 parts by weight, the release agent is in a range from 1 to 10 parts by weight, preferably from 2.5 to 8 parts by weight, the charge control agent is in a range from 0.1 to 7 parts by weight, preferably from 0.5 to 5 parts by weight, and the fluidity improving agent is in a range from 0.1 to 5 parts by weight, preferably from 0.5 to 4 parts by weight.

The pulverized toner 8 of the first embodiment is preferably spheroidized to increase the degree of circularity in order to improve the transfer efficiency. To increase the degree of circularity of the pulverized toner 8, the following methods may be employed:

(i) by using such a machine allowing the toner to be pulverized into relatively spherical particles, for example, a turbo mill (available from Kawasaki Heavy Industries, Ltd.) for pulverization, the degree of circularity may be 0.93 maximum or, alternatively, (ii) by using a hot air spheroidizing apparatus: Surfusing System SFS-3 (available from Nippon Pneumatic Mfg. Co., Ltd.) for treatment after pulverization, the degree of circularity may be 1.00 maximum.

The desirable degree of circularity (sphericity) of the pulverized toner 8 of the first embodiment is 0.91 or more, thereby obtaining excellent transfer efficiency. In case of the degree of circularity up to 0.97, a cleaning blade is preferably used. In case of the higher degree, a brush cleaning is preferably used with the cleaning blade.

The pulverized toner 8 obtained as mentioned above is set to have a mean particle diameter ($D_{50}$) of 9 $\mu$m or less, preferably from 4.5 $\mu$m to 8 $\mu$m, in which the mean particle diameter ($D_{50}$) is 50% particle diameter based on the number. Accordingly, the particles of the pulverized toner 8 have relatively small particle diameter. By using the hydrophobic silica together with the hydrophobic rutile/anatase type titanium oxide as the external additives of the small-particle toner, the amount of hydrophobic silica can be reduced as compared to the amount of hydrophobic silica of a conventional case in which silica particles are used alone, thereby improving the fixing property.

It should be noted that the mean particle diameter and the degree of circularity of toner particles are values measured by FPIA2100 available from Sysmex corporation.

In the pulverized toner 8, the total amount (weight) of external additives is set in a range from 0.5% by weight to 4.0% by weight, preferably in a range from 1.0% by weight to 3.5% by weight relative to the weight of toner mother particles. Therefore, when used as full color toners, the pulverized toner 8 can exhibit its effect of preventing the production of reverse transfer toner particles. If the external additives are added in a total amount of 4.0% by weight or more, external additives may be liberated from the surfaces of toner mother particles and/or the fixing property of the toner may be degraded.

Now, description will be made as regard to the preparation of the toner 8 of the first embodiment employing toner mother particles made by the polymerization method (hereinafter, such a toner will be referred to as a polymerized toner).

The method of preparing the polymerized toner 8 of the first embodiment may be suspension polymerization method or emulsion polymerization method. In the suspension polymerization method, a monomer compound is prepared by melting or dispersing a coloring agent, a release agent, and, if necessary, a dye, a polymerization initiator, a cross-linking agent, a charge control agent, and other additive(s) into polymerizable monomer. By adding the monomer compound into an aqueous phase containing a suspension stabilizer (water soluble polymer, hard water soluble inorganic material) with stirring, the monomer compound is polymerized and granulated, thereby forming color toner particles having a desired particle size.

In the emulsion polymerization, a monomer, a release agent and, if necessary, a polymerization initiator, an emulsifier (surface active agent), and the like are dispersed into a water and are polymerized. During the coagulation, a coloring agent, a charge control agent, and a coagulant (electrolyte) are added, thereby forming color toner particles having a desired particle size.

Among the materials for preparing the polymerized toner 8, the coloring agent, the release agent, the charge control agent, and the fluidity improving agent may be the same materials for the pulverized toner.

As the polymerizable monomer, a known monomer of vinyl series may be used. Examples include: styrene, o-methylstyrene, m-methylstyrene, p-methylstyrene, α-methylstyrene, P-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethyl hexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethyl hexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propylene, acrylonitrile, methacrylonitrile, vinyl methyl ether, vinyl ethyl ether, vinyl ketone, vinyl hexyl ketone, and vinyl naphthalene. Examples of fluorine-containing monomers are 2,2,2-torifluoroethylacrylate, 2,3,3-tetrafluoropropylacrylate, vinyliden fluoride, ethylene trifluororide, ethylene tetrafluoride, and trifluoropropyrene. These are available because the fluorine atoms are effective for negative charge control.

As the emulsifier (surface active agent), a known emulsifier may be used. Examples are dodecyl benzene sulfonic acid sodium, sodium-tetradecyl sulfate, pentadecyl sodium sulfate, sodium octylsulphate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, dodecylpolyoxy ethylene ether, hexadecylpolyoxy ethylene ether, laurylpolyoxy ethylene ether, and sorbitan monooleate polyoxy ethylene ether.

As the polymerization initiators, a known polymerization initiator may be used. Examples include potassium persulfate, sodium persulfate, ammonium persulfate, hydrogen peroxide, 4,4'-azobis-cyano valeric acid, t-butyl hydro peroxide, benzoyl peroxide, and 2,2'-azobis-isobutyronitrile.

As the coagulant (electrolyte), a known coagulant may be used. Examples include sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate, and iron sulfate.

Table 2 shows proportions (parts by weight) of components in the polymerized toner 8 by emulsion polymerization method.

TABLE 2

| | |
|---|---|
| Polymerizable monomer | Par 100 parts by weight |
| Polymerization initiator | 0.03–2 parts, preferably 0.1–1 parts by weight |
| Surface active agent | 0.01–0.1 parts by weight |
| Release agent | 1–40 parts, preferably 2–35 parts by weight |
| Charge control agent | 0.1–7 parts, preferably 0.5–5 parts by weight |
| Coloring agent | 1–20 parts, preferably 3–10 parts by weight |
| Coagulant (electrolyte) | 0.05–5 pars, preferably 0.1–2 parts by weight |

As shown in Table 2, par 100 parts by weight of the polymerizable monomer, the polymerization initiator is in a range from 0.03–2 parts by weight, preferably from 0.1–1 parts by weight, the surface active agent is in a range from 0.01–0.1 parts by weight, the release agent is in a range from 1 to 40 parts by weight, preferably from 2 to 35 parts by weight, the charge control agent is in a range from 0.1 to 7 parts by weight, preferably from 0.5 to 5 parts by weight, the coloring agent is in a range form 1 to 2 parts by weight, preferably from 3 to 10 parts by weight, and the coagulant is in a range from 0.05 to 5 parts by weight, preferably from 0.1 to 2 parts by weight.

The polymerized toner 8 of the first embodiment is also preferably spheroidized to increase the degree of circularity in order to improve the transfer efficiency. To increase the degree of circularity of the polymerized toner 8, the following adjusting methods may be employed:

(i) in case of the emulsion polymerization method, the degree of circularity can be freely changed by controlling the temperature and time of coagulating process of secondary particles. In this case, the degree of circularity is in a range from 0.94 to 1.00, (ii) in case of the suspension polymerization method, since this method enables to make perfect spherical toner particles, the degree of circularity is in a range from 0.98 to 1.00. By heating the toner particles at a temperature higher than the glass-transition temperature of toner to deform them for adjusting the degree of circularity, the degree of circularity can be freely adjusted in a range from 0.94 to 0.98.

There is another method for preparing a polymerized toner 8 of this embodiment, which is a dispersion polymerization method. This method is disclosed in, for example, Japanese Patent Unexamined Publication No. 63-304002. In this case, since the shape of each particle may be close to the perfect sphere, the particles are heated at a temperature higher than the glass-transition temperature of toner so as to form the particles into a desired shape.

Similarly to the aforementioned pulverized toner 8, the desirable degree of circularity (sphericity) of the polymerized toner 8 of the first embodiment is 0.95 or more. In case of the degree of circularity up to 0.97, a cleaning blade is preferably used. In case of the higher degree, a brush cleaning is preferably used with the cleaning blade.

The polymerized toner 8 obtained as mentioned above is set to have a mean particle diameter ($D_{50}$), as 50% particle diameter based on the number, of 9 $\mu$m or less, preferably from 4.5 $\mu$m to 8 $\mu$m. Accordingly, the particles of the polymerized toner 8 have relatively small particle diameter. By using the hydrophobic silica together with the hydrophobic rutile/anatase type titanium oxide as the external additives of the small-particle toner, the amount of hydrophobic silica can be reduced as compared to the amount of hydrophobic silica of a conventional case in which silica particles are used alone, thereby improving the fixing property.

It should be noted that, also in the polymerized toner 8 of the present invention, the mean particle diameter and the degree of circularity of toner particles are values measured by FPIA2100 available from Sysmex corporation.

Also in the polymerized toner 8, the total amount (weight) of external additives is set in a range from 0.5% by weight to 4.0% by weight, preferably in a range from 1.0% by weight to 3.5% by weight relative to the weight of toner mother particles. Therefore, when used as full color toners, the polymerized toner 8 can exhibit its effect of preventing the production of reverse transfer toner particles. If the external additives are added in a total amount of 4.0% by weight or more, external additives may be liberated from the surfaces of the mother particles and/or the fixing property of the toner may be degraded.

Figure 4:
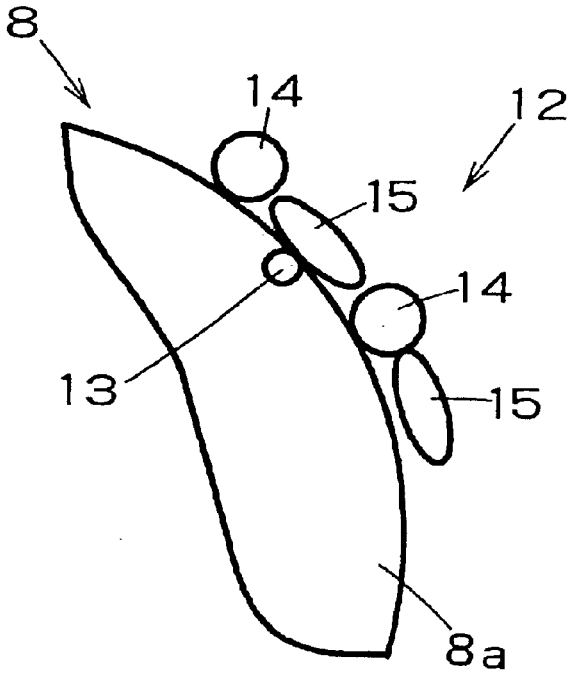
FIG. 4 is an illustration for explaining the behavior of the non-magnetic single-component toner shown in FIG. 1.

In the non-magnetic single-component toner 8 of the first embodiment structured as mentioned above, in either case of polymerized toner or pulverized toner, the small-particle hydrophobic silica 13 is easy to be embedded in toner mother particles 8*a* as shown in FIG. 4. Since the work function of the hydrophobic rutile/anatase type titanium oxide 15 is larger than the work function of hydrophobic silica 13, the hydrophobic rutile/anatase type titanium oxide sticks to the embedded hydrophobic silica 13 because of the difference in work function so that the hydrophobic rutile/anatase type titanium oxide is hardly liberated from the toner mother particles 8*a*. In addition, since the large-particle hydrophobic silica 14 sticks to the surface of each toner mother particle 8*a*, the surface of each toner mother particle 8*a* can be covered evenly with the hydrophobic silicas 13, 14 and the hydrophobic rutile/anatase type titanium oxide 15. Therefore, the negative charging of the non-magnetic single-component toner 8 can be kept stable for longer period of time and stable image quality can be provided even for successive printing.

By adding the hydrophobic silica 13 of which primary particles are small in an amount larger than the adding amount of the hydrophobic rutile/anatase type titanium oxide 15, the negative charging of the non-magnetic single-component toner 8 can be kept stable for further longer period of time. Therefore, the fog on non-image portions can be further effectively prevented, the transfer efficiency can be further improved, and the production of reverse transfer toner particles can be further effectively prevented.

Figure 5:
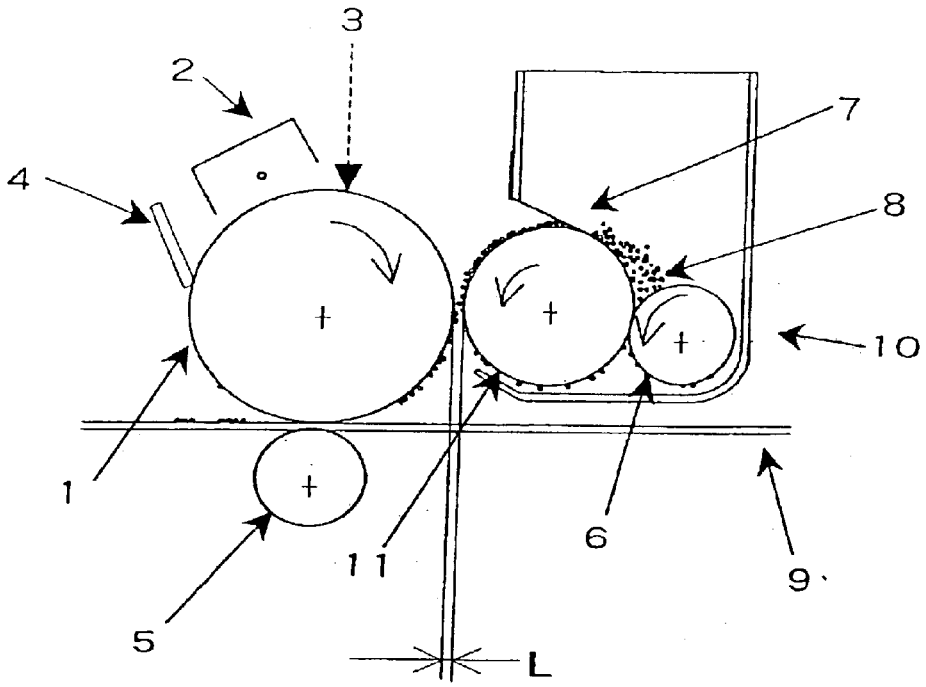
FIG. 5 is an illustration schematically showing an example of the image forming apparatus according to non-contact developing process used for tests of non-magnetic single-component toner of the present invention.
Figure 6:
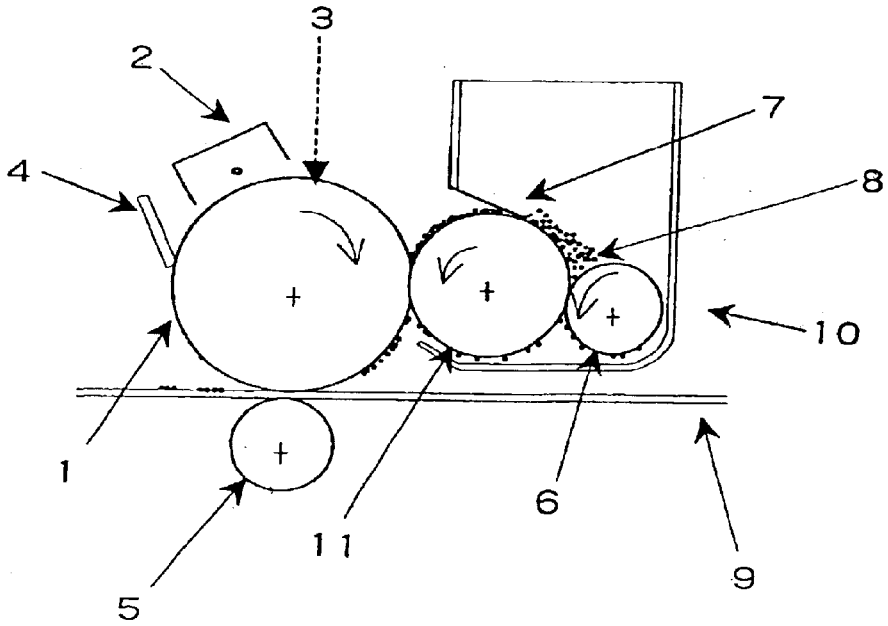
FIG. 6 is an illustration schematically showing an example of the image forming apparatus according to contact developing process used for tests of non-magnetic single-component toner of the present invention.

FIG. 5 is an illustration schematically showing an example of the image forming apparatus according to non-contact developing process, employing the non-magnetic single-component toner 8 of the first embodiment. FIG. 6 is an illustration schematically showing an example of the image forming apparatus according to contact developing process, employing the non-magnetic single-component toner 8 of the first embodiment. In FIG. 5 and FIG. 6, numeral 1 designates an organic photoreceptor, 2 designates a corona charging device, 3 designates an exposing means, 4 designates a cleaning blade, 5 designates a transfer roller, 6 designates a supply roller, 7 designates a regulating blade, 8 designates a non-magnetic single-component toner (negatively chargeable toner), 9 designates a recording medium, 10 designates a developing device, 11 designates a development roller, and a mark L designates a developing gap in the non-contact developing process.

The organic photoreceptor 1 may be of a single layer type in which the organic photosensitive layer consists of a single layer or of a multi-layer type in which the organic photosensitive layer consists of a plurality of layers.

Figure 7:
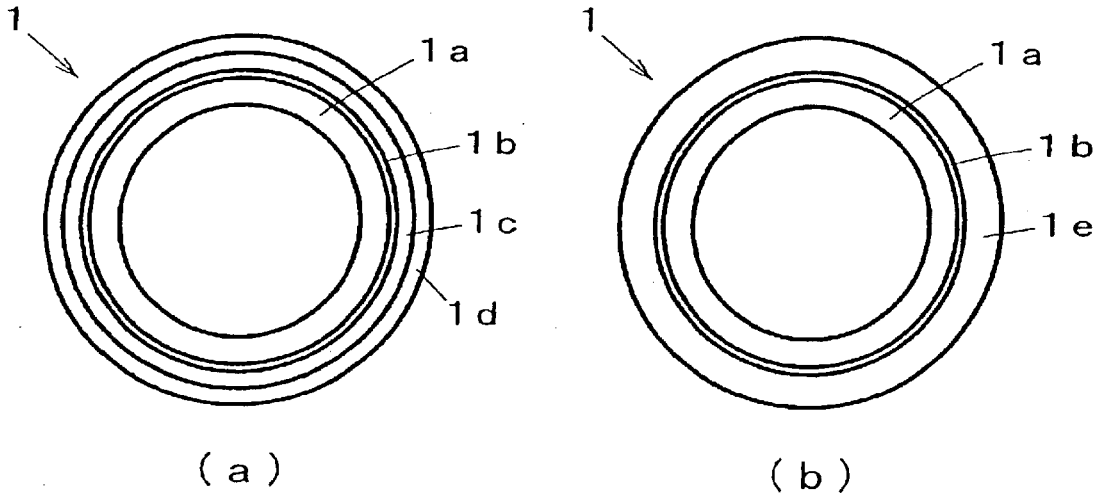
FIG. 7(*a*) is an illustration showing an example of an organic layered photoreceptor for use in the image forming apparatuses shown in FIG. 5 and FIG. 6, and FIG. 7(*b*) is an illustration showing another example of organic layered photoreceptor.

A multi-layer type organic photoreceptor 1 is made by subsequently laminating a photosensitive layer consisting of a charge generation layer 1*c* and a charge transport layer 1*d* on a conductive substrate 1*a* via an undercoat layer 1*b* as shown in FIG. 7(*a*).

As the conductive substrate 1*a*, a known conductive substrate, for example, having conductivity of volume resistance $10^{10}$ Ωcm or less can be used. Specific examples are a tubular substrate formed by machining aluminum alloy, a tubular substrate made of polyethylene terephthalate film which is provided with conductivity by chemical vapor deposition of aluminum or conductive paint, and a tubular substrate formed by conductive polyimide resin. Beside the tubular shape, the conductive substrate may have a belt-like shape, a plate shape, or a sheet shape. In addition, a seamless metallic belt made of a nickel electrocast tube or a stainless steel tube may be suitably employed.

As the undercoat layer 1*b* provided on the conductive substrate 1*a*, a known undercoat layer may be used. For example, the undercoat layer 1*b* is disposed for improving the adhesive property, preventing moire phenomenon, improving the coating property of the charge generation layer 1*c* as an upper layer thereof, and/or reducing residual potential during exposure. The resin as material of the undercoat layer 1*b* preferably has high insoluble property relative to solvent used for a photosensitive layer because the undercoat layer 1*b* is coated by the photosensitive layer having the charge generation layer 1*c*. Examples of available resins are water soluble resins such as polyvinyl alcohol, casein, sodium polyacrylic acid, alcohol soluble resins such as polyvinyl acetate, copolymer nylon, and methoxymethylate nylon, polyurethane, melamine resin, and epoxy resin. The foregoing resins may be used alone or in combination. These resins may contain metallic oxide such as titanium dioxide or zinc oxide.

As the charge generation pigment for use in the charge generation layer 1*c*, a known material may be used. Specific examples are phthalocyanine pigments such as metallic phthalocyanine, metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments. The foregoing charge generation pigments may be used alone or in combination.

Examples of the binder resin for use in the charge generation layer 1*c* include polyvinyl butyral resin, partially acetalized polyvinyl butyral resin, polyarylate resin, and vinyl chloride-vinyl acetate copolymer. As for the structural ratio between the binder resin and the charge generation material, the charge generation material is in a range from 10 to 1000 parts by weight relative to 100 parts by weight of the binder resin.

As the charge transport material for use in the charge transport layer 1*d*, known materials may be used and the charge transport material is divided into an electron transport material and a positive hole transport material. Examples of the electron transport material include electron acceptor materials such as chloroanil, tetracyanoethylene, tetracyanoquinodimethane, 2,4,7-trinitro-9-fluorenone, palladiphenoquinone derivatives, benzoquinone derivatives, and naphthoquinone derivatives. These electron transport materials may be used alone or in combination.

Examples of the positive hole transport material include oxazole compounds, oxadiazole compounds, imidazole compounds, triphenylamine compounds, pyrazoline compounds, hydrazone compounds, stilbene compounds, phenazine compounds, benzofuran compounds, buthaziene compounds, benzizine compounds, styryl compounds, and derivatives thereof. These electron donor materials may be used alone or in combination.

The charge transport layer 1*d* may contain antioxidant, age resistor, ultraviolet ray absorbent or the like for preventing deterioration of the aforementioned materials.

Examples of the binder resins for use in the charge transport layer 1*d* include polyester, polycarbonate, polysulfone, polyarylate, poly-vinyl butyral, poly-methyl methacrylate, poly-vinyl chloride resin, vinyl chloride-vinyl acetate copolymer, and silicone resin. Among these, polycarbonate is preferable in view of the compatibility with the charge transport material, the layer strength, the solubility, and the stability as coating material. As for the structural ratio between the binder resin and the charge transport material, the charge transport material is in a range from 25 to 300 parts by weight relative to 100 parts by weight of the binder resin.

It is preferable to use a coating liquid for forming the charge generation layer 1*c* and the charge transport layer 1*d*. Example of solvents for use in the coating liquid include alcohol solvents such as methanol, ethanol, and isopropyl alcohol, ketone solvents such as acetone, methyl ethyl ketone, and cyclohexanone, amide solvents such as N,N-dimethyl horumu amide, and N,N-dimethyl aceto amide, ether solvents such as tetrahydrofuran, dioxane, and ethylene glycol monomethyl ether, ester solvents such as methyl acetate and ethyl acetate, aliphatic halogenated hydrocarbon solvents such as chloroform, methylene chloride, dichloroethylene, carbon tetrachloride, and trichloroethylene, and aromatic solvents such as benzene, toluene, xylene, and monochlor benzene. Selection from the above solvents depends on the kind of used binder resin.

For dispersing the charge generation pigment, it is preferable to disperse and mix by using a mechanical method such as a sand mill method, a ball mill method, an attritor method, a planetary mill method.

Examples of the coating method for the undercoat layer 1*b*, the charge generation layer 1*c* and the charge transport layer 1*d* include a dip coating method, a ring coating method, a spray coating method, a wire bar coating method, a spin coating method, a blade coating method, a roller coating method, and an air knife coating method. After coating, it is preferable to dry them at room temperature and then, heat-dry them at a temperature from 30 to 200° C. for 30 to 120 minutes. The thickness of the charge generation layer 1*c* after being dried is in a range from 0.05 to 10 μm, preferably from 0.1 to 3 μm. The thickness of the charge transport layer 1*d* after being dried is in a range from 5 to 50 μm, preferably from 10 to 40 μm.

As shown in FIG. 7(*b*), a single layer type organic photoreceptor 1 is manufactured by forming a single layer organic photosensitive layer 1*e* including a charge generation material, a charge transport material, a sensitizer, a binder, a solvent, and the like by coating via a similar undercoat layer 1*b* on a conductive substrate 1*a* as described in the aforementioned multi-layer organic laminated photoreceptor 1. The negatively chargeable single layer type organic photoreceptor may be made according to the method disclosed in Japanese Patent Unexamined Publication 2000-19746.

Examples of charge generation materials for use in the single layer type organic photosensitive layer 1*e* are phthalocyanine pigments, azo pigments, quinone pigments, perylene pigments, quinocyanine pigments, indigoid pigments, bisbenzimidazole pigments, and quinacridone pigments. Among these, phthalocyanine pigments and azo pigments are preferable. Examples of charge transport materials are organic positive hole transport compounds such as hydrazone compounds, stilbene compounds, phenylamine compounds, arylamine compounds, diphenyl buthaziene compounds, and oxazole compounds. Examples of the sensitizers are electron attractive organic compounds such as palladiphenoquinone derivatives, naphthoquinone derivatives, and chloroanil, which are also known as electron transport materials. Examples of the binders are thermoplastic resins such as polycarbonate resin, polyarylate resin, and polyester resin.

Proportions of the respective components are the binder: 40–75% by weight, the charge generation material: 0.5–20% by weight, the charge transport material: 10–50% by weight, and the sensitizer: 0.5–30% by weight, preferably the binder: 45–65% by weight, the charge generation material: 1–20% by weight, the charge transport material: 20–40% by weight, and the sensitizer: 2–25% by weight. The solvent is preferably a solvent being insoluble relative to the undercoat layer. Examples of the solvent are toluene, methyl ethyl ketone, and tetrahydrofuran.

The respective components are pulverized, dispersed, and mixed by using an agitator such as a homo mixer, ball mill, a sand mill, an attritor, a paint conditioner so as to prepare a coating liquid. The coating liquid is applied onto the undercoat layer according to a dip coating method, a ring coating method, a spray coating method and, after that, is dried to have a thickness from 15 to 40 μm, preferably from 20 to 35 μm so as to form the single layer organic photosensitive layer 1*e*.

The organic photoreceptor 1 structured as mentioned above is a photosensitive drum which is 24–86 mm in diameter and rotates at a surface velocity of 60–300 mm/sec. After the surface of the organic photoreceptor 1 is uniformly negatively charged by a corona charging device 2, the organic photoreceptor 1 is exposed by an exposure device 3 according to information to be recorded. In this manner, an electrostatic latent image is formed on the photosensitive drum.

The developing device 10 having the development roller 11 is a single-component developing device 10 which supplies the negatively chargeable toner 8 to the organic photoreceptor 1 to reversely develop the electrostatic latent image on the organic photoreceptor 1, thereby forming a visible image. The negatively chargeable toner 8 is housed in the developing device 10. The toner is supplied to the development roller 11 by a supply roller 6 which rotates in the counter-clockwise direction as shown in FIG. 5 and FIG. 6. The development roller 11 rotate in the counter-clockwise direction as shown in FIG. 5 and FIG. 6 with holding the toner 8, supplied by the supply roller 6, on the surface thereof so as to carry the toner 8 to contact portion with the organic photoreceptor 1, thereby making the electrostatic latent image on the organic photoreceptor 1 visible.

The development roller 11 may be a roller made of a metallic pipe having a diameter 16–24 mm, of which surface is treated by plating or blasting or which is formed on its peripheral surface with a conductive elastic layer made of NBR, SBR, EPDM, polyurethane rubber, or silicone rubber to have a volume resistivity of $10^4$ to $10^8$ Ωcm and hardness of 40 to 70° (Asker A hardness). A developing bias voltage is applied to the development roller 11 via the shaft of the pipe or the center shaft thereof from a power source (not shown). The entire developing device composed of the development roller 11, the supply roller 6, and a toner regulating blade 7 is biased against the organic photoreceptor 1 by a biasing means such as a spring (not shown) with a pressure load of 20 to 100 gf/cm, preferably 25 to 70 gf/cm to have a nip width of 1 to 3 mm.

The regulating blade 7 is formed by pasting rubber tips on a SUS, a phosphor bronze, a rubber plate, a metal sheet. The regulating blade is biased against the development roller 11 by a biasing means such as a spring (not shown) or the bounce itself as an elastic member with a linear load of 20 to 60 gf/cm to make the toner layer on the development roller into a uniform thickness of 5 to 20 μm, preferably 6 to 15 μm and to regulate such that the number of layers made up of toner particles becomes 1 to 2, preferably 1 to 1.8. If the toner layer is desired to have a larger thickness, the regulating blade is biased with a linear load of 25 to 60 gf/cm to make the toner layer into a thickness of 10 to 30 μm, preferably 13 to 25 μm and to regulate such that the number of layers made up of toner particles becomes 1.2 to 3, preferably 1.5 to 2.5.

In the image forming apparatus of non-contact developing method, the development roller 11 and the photoreceptor 1 are arranged to have a developing gap L therebetween. The developing gap L is preferably in a range from 100 to 350 μm. As for the developing bias, the voltage of a direct current (DC) is preferably in a range from −200 to −500 V and an alternating current (AC) to be superimposed on the direct current is preferably in a range from 1.5 to 3.5 kHz with a P—P voltage in a range from 1000 to 1800 V, but not shown. In the non-contact developing method, the peripheral velocity of the development roller 11 which rotates in the counter-clockwise direction is preferably set to have a ratio of peripheral velocity of 1.0 to 2.5, preferably 1.2 to 2.2 relative to that of the organic photoreceptor 1 which rotates in the clockwise direction.

The development roller 11 rotates in the counter-clockwise direction as shown in FIG. 5 and FIG. 6 with holding the non-magnetic single-component toner 8, supplied by the supply roller 6, on the surface thereof so as to carry the non-magnetic single-component toner 8 to a facing portion with the organic photoreceptor 1. By applying a bias voltage, composed of an alternating current superimposed on a direct current, to the facing portion between the organic photoreceptor 1 and the development roller 11, the non-magnetic single-component toner 8 vibrates between the surface of the development roller 11 and the surface of the organic photoreceptor 1 to develop an image. Toner particles adhere to the photoreceptor 1 during the vibration of the toner 8 between the surface of the development roller 11 and the surface of the organic photoreceptor 1, whereby positively charged small-size toner particles become negatively charged toner particles, thus reducing fog toner.

The recording medium 9 such as a paper or an image transfer medium (not shown in FIGS. 5 and 6, shown in FIG. 8 as will be described later) is fed between the organic photoreceptor 1 with visible image thereon and the transfer roller 5. In this case, the pressing load of the recording medium on the organic photoreceptor 1 by the transfer roller 5 is preferably in a range from 20 to 70 gf/cm, preferably from 25 to 50 gf/cm which is nearly equal to that of the contact developing type. This ensures the contact between the toner particles and the organic photoreceptor 1, whereby the toner particles can be negatively charged toner so as to improve the transfer efficiency.

Figure 8:
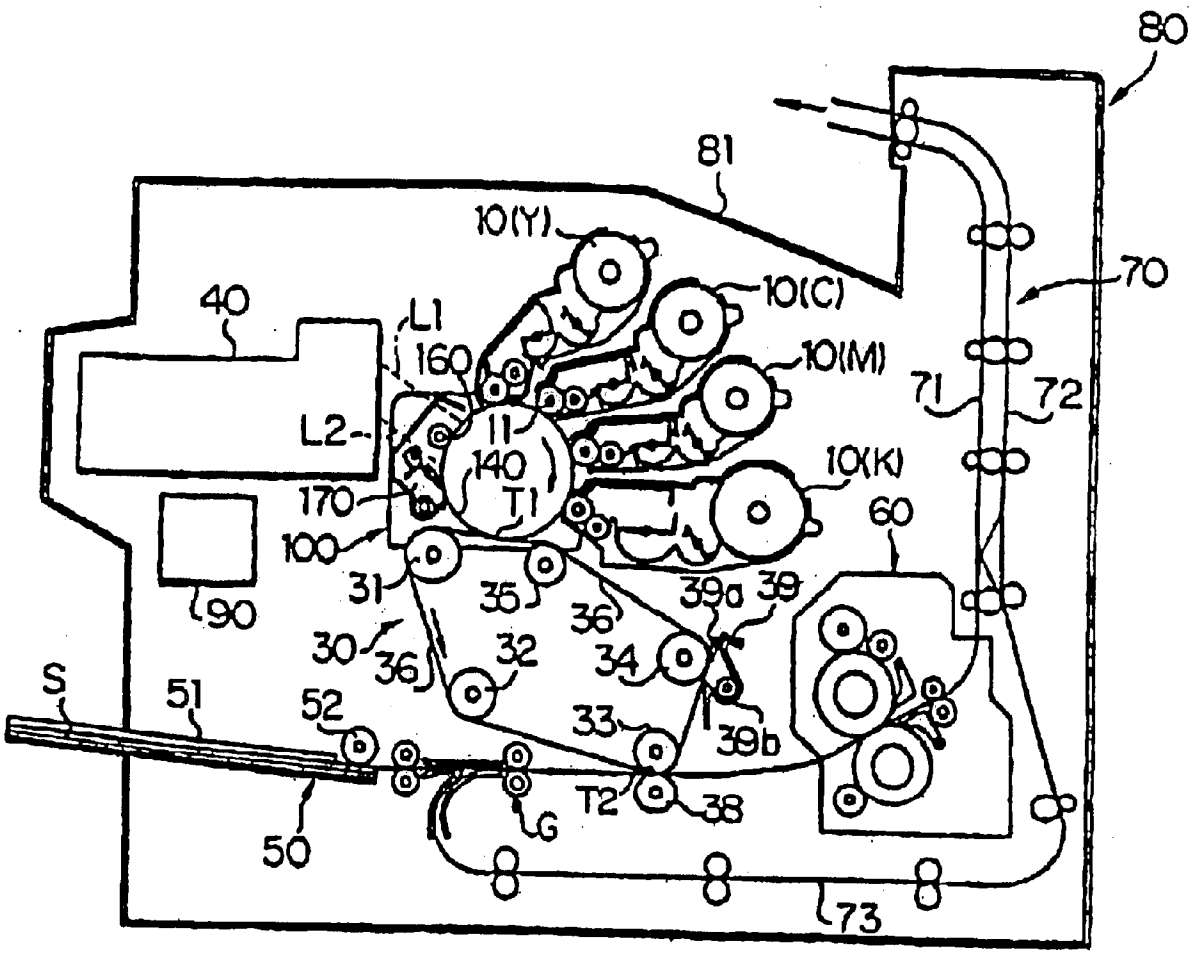
FIG. 8 is an illustration showing an example of a four cycle type full color printer according to the non-contact developing process used for tests of non-magnetic single-component toner of the present invention.

By combining developing devices of conducting non-contact developing process as shown in FIG. 5 or contact developing process as shown in FIG. 6 with developing devices for respective four color toners (developers) of yellow Y, cyan C, magenta M, and black K and the photoreceptor 1, a full color image forming apparatus capable of forming a full color image can be provided. As examples of the full color image forming apparatus, there are three types: a four cycle type (details will be described later) comprising four developing devices for the respective colors and one rotatable latent image carrier as shown in FIG. 8, tandem type comprising four developing devices and four latent image carriers for the respective colors which are aligned, and a rotary type comprising one latent image carrier and four rotatable developing devices for the respective colors.

EXAMPLES

As for non-magnetic single-component toners according to the present invention, examples and comparative examples were made and tests for image forming were carried out. Hereinafter, product examples of the organic photoreceptor and the transfer medium of the image forming apparatus according to the non-contact developing process as shown in FIG. 5 will be explained below.

(Production of Non-Magnetic Single-Component Toner 8)

Examples and comparative examples of non-magnetic single-component toners were made both in the polymerization method and in the pulverization method. The fluidity improving agents (external additives) used for making the respective example toners were combinations of at least two from a group consisting of hydrophobic rutile/anatase type titanium oxide (20 nm) of which major axial length was 20 nm, small-particle hydrophobic silica (12 nm) which was prepared by a vapor phase process (hereinafter, silica prepared by a vapor phase process will be referred to as "vapor-phase silica") and was surface-treated with hexamethyldisilazane (HMDS) and of which mean primary particle diameter was 12 nm, large-particle hydrophobic vapor-phase silica (40 nm) which was treated to have hydrophobic property in the same manner and of which mean primary particle diameter was 40 nm, hydrophobic anatase type titanium oxide (30–40 nm) treated with a silane coupling agent, and hydrophobic rutile type titanium oxide (major axial length: 100 nm; minor axial length: 20 nm) treated with a silane coupling agent. The work functions of the above fluidity improving agents were measured and the results of the measurements are shown in Table 3.

TABLE 3

| External additives | Work function Φ (eV) | Normalized photoelectron yield |
|---|---|---|
| Rutile/anatase type titanium oxide (20 nm) | 5.64 | 8.4 |
| Vapor-phase silica (12 nm) | 5.22 | 5.1 |
| Vapor-phase silica (40 nm) | 5.24 | 5.2 |
| Anatase type titanium oxide | 5.66 | 15.5 |
| Rutile type titanium oxide | 5.61 | 7.6 |

It should be noted that the work functions (Φ) were measured by the aforementioned spectrophotometer AC-2, produced by Riken Keiki Co., Ltd with radiation amount of 500 nW.

As apparent from Table 3, the work function Φ of the rutile/anatase type titanium oxide (20 nm), treated to have hydrophobic property, was 5.64 eV and the normalized photoelectron yield at this point was 8.4. The work function Φ of the vapor-phase silica (12 nm) was 5.22 eV and the normalized photoelectron yield at this point was 5.1. The work function Φ of the vapor-phase silica (40 nm) was 5.24 eV and the normalized photoelectron yield at this point was 5.2. The work function Φ of the hydrophobic anatase type titanium oxide was 5.66 eV and the normalized photoelectron yield at this point was 15.5. The work function Φ of the hydrophobic rutile type titanium oxide was 5.61 eV and the normalized photoelectron yield at this point was 7.6.

(1) Examples of Emulsion Polymerized Toner of the First Embodiment and Comparative Examples of Emulsion Polymerized Toner (a) Production of Emulsion Polymerized Toner of Example 1

A monomer mixture composed of 80 parts by weight of styrene monomer, 20 parts by weight of butyl acrylate, and 5 parts by weight of acryl acid was added into a water soluble mixture composed of:

| | |
|---|---|
| water | 105 parts by weight; |
| nonionic emulsifier | 1 part by weight; |
| anion emulsifier | 1.5 parts by weight; and |
| potassium persulfate | 0.55 parts by weight |

and was agitated in nitrogen gas atmosphere at a temperature of 70° C. for 8 hours. By cooling after polymerization reaction, milky white resin emulsion having a particle size of 0.25 μm was obtained.

Then, a mixture composed of:

| | |
|---|---|
| resin emulsion obtained above | 200 parts by weight; |
| polyethylene wax emulsion (Sanyo Chemical Industries, Ltd.) | 20 parts by weight; and |
| Phthalocyanine Blue | 7 parts by weight |

was dispersed into water containing dodecyl benzene sulfonic acid sodium as a surface active agent in an amount of 0.2 parts by weight, and was adjusted to have pH of 5.5 by adding diethyl amine. After that, electrolyte aluminum sulfate was added in an amount of 0.3 parts by weight with agitation and subsequently agitated at a high speed and thus dispersed by using a TK homo mixer.

Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide, polymerization was conducted for 5 hours to grow up particles. After the polymerization, the pH was adjusted to be 5 or more while the temperature was increased to 95° C. and then maintained for 5 hours in order to improve the association and the film bonding strength of secondary particles. The obtained particles were washed with water and dried under vacuum at a temperature of 45° C. for 10 hours. In this manner, mother particles for cyan toner were obtained.

The obtained mother particles for cyan toner were measured. The results of the measurement showed that the mean particle diameter ($D_{50}$) as 50% particle diameter based on the number was 6.8 μm, the degree of circularity was 0.98, and the work function was 5.57 eV. Subsequently, as the fluidity improving agents, negatively chargeable hydrophobic silica having a mean primary particle diameter of 12 nm was added in an amount of 0.8% by weight to the mother particles for cyan toner, negatively chargeable hydrophobic silica having a mean primary particle diameter of 40 nm was added in an amount of 0.5% by weight to the mother particles for cyan toner, and rutile/anatase type titanium oxide, of which mixed crystal ratio was 10% by weight of rutile type titanium oxide and 90% by weight of anatase type titanium oxide and treated to have hydrophobic property, (degree of hydrophobic: 58%, specific surface: 150 $m^2/g$) was added in an amount of 0.5% by weight to the mother particles for cyan toner. In this manner, a cyan toner of Example 1 was obtained. The work function of this toner was 5.56 eV as a result of measurement.

(b) Production of Emulsion Polymerized Toner of Example 2

A magenta toner of Example 2 was obtained in the same manner as the toner of Example 1 except that Quinacridon was used instead of Phthalocyanine Blue as the pigment and that the temperature for improving the association and the film bonding strength of secondary particles was still kept at 90° C. This magenta toner had a degree of circularity of 0.97 and a work function of 5.65 eV as a result of measurement.

(c) Production of Emulsion Polymerized Toner of Comparative Example 1

A toner of Comparative Example 1 was obtained in the same manner as the toner of Example 1 except that the negatively chargeable hydrophobic silica of a primary particle diameter of 12 nm was added in an amount of 1.1% and that the negatively chargeable hydrophobic silica of a primary particle diameter of 40 nm was added in an amount of 0.7% by weight. As a result of measurement, the work function of the toner of Comparative Example 1 was 5.55 eV.

(d) Production of Emulsion Polymerized Toner of Comparative Example 2

A toner of Comparative Example 2 was obtained in the same manner as the toner of Example 1 except that anatase type titanium oxide treated to have hydrophobic property (degree of hydrophobic: 62%, specific surface: 98 $m^2/g$) was added in an amount of 0.5% instead of the hydrophobic rutile/anatase type titanium oxide. As a result of measurement, the work function of the toner of Comparative Example 2 was 5.56 eV similar to the Example 1.

(e) Production of Emulsion Polymerized Toner of Comparative Example 3

A toner of Comparative Example 3 was obtained in the same manner as the toner of Example 1 except that rutile type titanium oxide treated to have hydrophobic property (degree of hydrophobic: 60%, specific surface: 97 $m^2/g$) was added in an amount of 0.5% instead of the hydrophobic rutile/anatase type titanium oxide. As a result of measurement, the work function of the toner of Comparative Example 3 was 5.64 eV.

(2) Examples of Pulverized Toner of the First Embodiment (a) Production of Pulverized Toner of Example 3

100 parts by weight of a mixture (available from Sanyo Chemical Industries, Ltd.) which was 50:50 (by weight) of polycondensate polyester, composed of aromatic dicarboxylic acid and bisphenol A of alkylene ether, and partially crosslinked compound of the polycondensate polyester by polyvalent metal, 5 parts by weight of Phthalocyanine Blue as a cyan pigment, 3 parts by weight of polypropylene having a melting point of 152° C. and a Mw of 4000 as a release agent, and 4 parts by weight of metal complex compound of salicylic acid E-81 (available from Orient Chemical Industries, Ltd.) as a charge control agent were uniformly mixed by using a Henschel mixer, kneaded by a twin-shaft extruder with an internal temperature of 150° C., and then cooled. The cooled substance was roughly pulverized into pieces of 2 square mm or less and then pulverized into fine particles by a jet mill. The fine particles were classified by a classifier, thereby obtaining toner mother particles having a mean particle diameter of 7.6 μm and a degree of circularity of 0.91.

Subsequently, fluid improving agents were added to the obtained toner particles in the same manner as the aforementioned Example 1. In this manner, a pulverized toner of Example 3 was obtained. The measured work function of this toner was 5.45 eV.

By using the aforementioned Examples 1–3 and Comparative Examples 1–3, images were formed by the image forming apparatus of non-contact single-component process as shown in FIG. 5. First, product examples of the respective component of the image forming apparatus using the negatively chargeable toner 8 of Example 1 will be described.

(Product Example of Organic Photoreceptor 1 [1 in FIG. 5 and FIG. 6, 140 in FIG. 8])

An aluminum pipe of 85.5 mm in diameter was used as a conductive substrate. A coating liquid was prepared by dissolving and dispersing 6 parts by weight of alcohol dissolvable nylon [available from Toray Industries, Inc. (CM8000)] and 4 parts by weight of titanium oxide fine particles treated with aminosilane into 100 parts by weight of methanol. The coating liquid was coated on the peripheral surface of the conductive substrate by the ring coating method and was dried at a temperature 100° C. for 40 minutes, thereby forming an undercoat layer having a thickness of 1.5 to 2 μm.

A pigment dispersed liquid was prepared by dispersing 1 part by weight of oxytitanyl phthalocyanine pigment as a charge generation pigment, 1 part by weight of butyral resin [BX-1, available from Sekisui Chemical Co., Ltd.], and 100 parts by weight of dichloroethane for 8 hours by a sand mill with glass beads of ϕ1 mm. The pigment dispersed liquid was applied on the undercoat layer and was dried at a temperature of 80° C. for 20 minutes, thereby forming a charge generation layer having a thickness of 0.3 μm.

A liquid was prepared by dissolving 40 parts by weight of charge transport material of a styryl compound having the following structural formula (1) and 60 parts by weight of polycarbonate resin (Panlite TS, available from Teijin Chemicals Ltd.) into 400 parts by weight of toluene. The liquid was applied on the charge generation layer by the dip coating to have a thickness of 22 μm when dried, thereby forming a charge transport layer. In this manner, an organic photoreceptor 1 having a double-layered photosensitive layer was obtained.

Structural Formula (1)

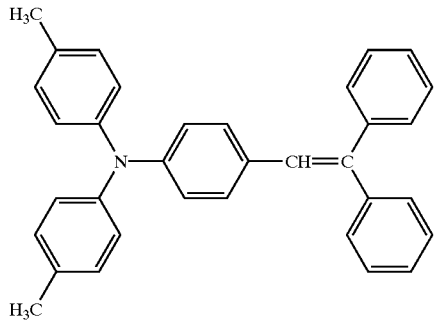

A test piece was made by cutting a part of the obtained organic photoreceptor 1 and was measured by using the commercial surface analyzer (AC-2, produced by Riken Keiki Co., Ltd) with radiation amount of 500 nW. The measured work function was 5.47 eV.

(Product Example of Development Roller)

A tube of conductive silicone rubber (JIS-A hardness: 63 degrees, volume resistivity in sheet: $3.5\times10^{6}$ Ωcm) was bonded to the outer surface of an aluminum pipe of 18 mm in diameter to have a thickness of 2 mm after grinding. The surface roughness (Ra) was 5 μm and the work function was 5.08 eV.

(Product Example of Transfer Medium of Intermediate Transfer Device)

An intermediate conductive layer as a conductive layer of an intermediate transfer belt 36 as the transfer medium of the intermediate transfer device was formed as follows. That is, a uniformly dispersed liquid composed of:

| | |
|---|---|
| vinyl chloride-vinyl acetate copolymer | 30 parts by weight; |
| conductive carbon black | 10 parts by weight; and |
| methyl alcohol | 70 parts by weight |

was applied on a polyethylene terephthalate resin film of 130 μm in thickness with aluminium deposited thereon by the roll coating method to have a thickness of 20 μm and dried to form an intermediate conductive layer.

Then, a coating liquid made by mixing and dispersing the following components:

| | |
|---|---|
| nonionic aqueous polyurethane resin (solid ratio: 62 wt. %) | 55 parts by weight; |
| polytetrafluoroethylene emulsion resin (solid ratio: 60 wt. %) | 11.6 parts by weight |
| conductive tin oxide | 25 parts by weight; |
| polytetrafluoroethylene fine particles (max particle diameter: 0.3 μm or less) | 34 parts by weight; |
| polyethylene emulsion (solid ratio: 35 wt. %) | 5 parts by weight; and |
| deionized water | 20 parts by weight; |

was coated on the intermediate conductive layer by the roll coating method to have a thickness of 10 μm and dried in the same manner so as to form a transfer layer as a resistive layer.

The obtained coated sheet was cut to have a length of 540 mm. The ends of the cut piece are superposed on each other with the coated surface outward and welded by ultrasonic, thereby making an intermediate transfer belt 36. The volume resistivity of this transfer belt was $2.5\times10^{10}$ Ωcm. The work function was 5.37 eV and the normalized photoelectron yield was 6.90.

(Product Example of Toner Regulating Blade 7)

A toner regulating blade 7 was made by bending the end of a SUS plate of 80 μm in thickness by 10° to have projection length of 0.6 mm. The work function was 5.01 eV.

Now, image forming tests by using the image forming apparatus according to the non-contact developing process will be explained below.

As conditions for forming images during the image forming process, the peripheral velocity of the organic photoreceptor 1 was set to 180 mm/sec. and the peripheral velocity ratio between the organic photoreceptor 1 and the development roller 11 was set to 2. The regulating blade 7 was pressed against the development roller 11 with a linear load of 33 gf/cm in such a manner as to make the toner layer on the development roller 11 into a uniform thickness of 15 μm and to regulate such that the number of layers made up of toner particles becomes 2.

The dark potential of the organic photoreceptor 1 was set to −600 V, the light potential thereof was set to −100 V, the DC developing bias was set to −200 V, and the alternating current (AC) to be superimposed on the direct current was set to have a frequency of 2.5 kHz and a P—P voltage of 1500 V. Further, the development roller 11 and the supply roller 6 are set to have the same potential.

The intermediate transfer belt composed of the aforementioned transfer belt was employed as the transfer medium corresponding to the recording medium 9 shown in FIG. 5. A voltage of +300 V was applied to a primary transfer roller on the back side corresponding to the transfer roller 5 in FIG. 5. The pressing load onto the photoreceptor 1 of the intermediate transfer belt by the primary transfer roller was set to 33 gf/cm.

An electrostatic latent image on the organic photoreceptor 1 was developed with non-magnetic single-component toner 8 carried by the development roller 11 according to non-contact developing (jumping developing) method so as to form a toner image. The developed toner image on the photoreceptor 1 was transferred to the intermediate transfer belt. The toner image transferred to the intermediate transfer belt was transferred to a plain paper with a transfer voltage +800 V at a secondary transfer portion (not shown in FIG. 5) and was fixed by a heat roller (not shown).

As for the plain paper with an image thereon, densities at a central portion of the top, a central portion of the bottom, a middle portion, and right and left ends of solid portions of the image were measured by Macbeth reflection densitometer and were averaged to obtain a mean value. Under the same conditions, another image was formed on the organic photoreceptor 1, the degree of fog on non-image portions was measured by the tape transfer method and the degree of fog on the organic photoreceptor 1 was measured in the same manner. These results are shown in Table 4. It should be noted that the tape transfer method is a method comprising attaching a mending tape, available from Sumitomo 3M Ltd., onto toner to transfer fog toner particles onto the mending tape, attaching the tape on a white plain paper, measuring the density from above the tape by the reflection densitometer, and obtaining the difference by subtracting the density of the tape from the measured value. The difference is defined as the fog density. The mean charge amount ($\mu$c/g) of the toner on the development roller 11 was measured by a charge distribution measuring system E-SPART III available from Hosokawa Micron Corporation. The result is also shown in Table 4.

TABLE 4

| Toner | Mean charge amount ($\mu$c/g) | Fog den-sity | Density of solid portion Left | Middle | Right | Top Center | Bottom Center |
|---|---|---|---|---|---|---|---|
| Example 1 | −19.7 | 0.005 | 1.220 | 1.224 | 1.215 | 1.223 | 1.105 |
| Example 2 | −20.3 | 0.007 | 1.310 | 1.311 | 1.309 | 1.310 | 1.311 |
| Example 3 | −15.3 | 0.010 | 1.335 | 1.332 | 1.333 | 1.335 | 1.332 |
| Comparative Example 1 | −27.5 | 0.008 | 0.443 | 1.195 | 0.450 | 1.197 | 1.085 |
| Comparative Example 2 | −19.6 | 0.010 | 0.995 | 1.283 | 1.003 | 1.282 | 1.280 |
| Comparative Example 3 | −23.9 | 0.015 | 0.899 | 1.275 | 0.901 | 1.275 | 1.273 |

As apparent from Table 4, the toners of Examples 1 through 3 had good results that little fog was caused, that the densities at the middle portion and the both side ends of solid image and the center of top and the center of bottom of solid image were substantially uniform, and that the charging property and the fluidity (transfer efficiency) of the toner on the development roller 11 can be judged stable. On the other hand, the toner of Comparative Example 1, containing large-particle hydrophobic silica and small particle hydrophobic silica and not containing hydrophobic rutile/anatase type titanium oxide, had a result that the charge amount was too high and that the densities at the both side ends and the top and bottom centers of solid image were lowered while the density at the middle of the solid image could be maintained. With the toners of Comparative Examples 2 and 3, while no problem about the charge amount was caused, the amount of fog was relatively large and the densities at the both side ends of solid image tended to be lowered.

(Production of Other Examples of Non-Magnetic Single-Component Toner 8 According to the Present Invention, an Image Forming Apparatus Used for Image Forming Tests, Image Forming Tests and the Results of the Tests)

Further, toners of other examples of the non-magnetic single-component toner 8 according to the present invention were made and experienced image forming tests. Hereinafter, the production of these toners, an image forming apparatus used for the tests, the image forming tests and the results of the tests will be described.

(a) Production of Pulverized Toner of Example 4

A magenta toner as a pulverized toner of Example 4 was obtained in the same manner as the production of the aforementioned pulverized toner of Example 3 except that Quinacridon was used as the pigment instead of the Phthalocyanine Blue. As a result of measurement, the work function of this magenta toner of Example 4 was 5.58 eV.

(b) Production of Pulverized Toner of Example 5

A yellow toner as a pulverized toner of Example 5 was obtained in the same manner as the production of the aforementioned pulverized toner of Example 3 except that Pigment Yellow 180 was used as the pigment instead of the Phthalocyanine Blue. As a result of measurement, the work function of this yellow toner of Example 5 was 5.61 eV.

(c) Production of Pulverized Toner of Example 6

A black toner as a pulverized toner of Example 6 was obtained in the same manner as the production of the aforementioned pulverized toner of Example 3 except that Carbon Black was used as the pigment instead of the Phthalocyanine Blue. As a result of measurement, the work function of this black toner of Example 6 was 5.71 eV.

(d) Image Forming Apparatus Used for Image Forming Tests

The image forming apparatus used for image forming tests was a full color printer as shown in FIG. 8 capable of both the non-contact developing process shown in FIG. 5 and the contact developing process shown in FIG. 6. Full color images were made by using this full color printer according to the non-contact developing process. This full color printer was of a four cycle type comprising one electrophotographic photoreceptor (latent image carrier) 140 for negative charging.

In FIG. 8, a numeral 100 designates a latent image carrier cartridge in which a latent image carrier unit is assembled. In this example, the photoreceptor cartridge is provided so that the photoreceptor and a developing unit can be separately installed. The electrophotographic photoreceptor for negative charging (hereinafter, sometimes called just "photoreceptor") 140 having a work function satisfying the relation defined by the present invention is rotated in a direction of arrow by a suitable driving means (not shown). Arranged around the photoreceptor 140 along the rotational direction are a charging roller 160 as the charging means, developing devices 10 (Y, M, C, K) as the developing means, an intermediate transfer device 30, and a cleaning means 170.

The charging roller 160 is in contact with the outer surface of the photoreceptor 140 to uniformly charge the outer surface of the same. The uniformly charged outer surface of the photoreceptor 140 is exposed to selective light L1 corresponding to desired image information by an exposing unit 140, thereby forming an electrostatic latent image on the photoreceptor 140. The electrostatic latent image is developed with developers by the developing devices 10.

As the developing devices, a developing device 10Y for yellow, a developing device 10M for magenta, a developing device 10C for cyan, and a developing device 10K for black are provided. These developing devices 10Y, 10C, 10M, 10K can swing so that the development roller (developer carrier) 11 of only one of the developing devices is selectively in press contact with the photoreceptor 140. These developing devices 10 hold negatively chargeable toners, having work function satisfying the relation to the work function of the photoreceptor, on the respective development rollers. Each developing device 10 supplies either one of toners of yellow Y, magenta M, cyan C, and black K to the surface of the photoreceptor 140, thereby developing the electrostatic latent image on the photoreceptor 140. Each development roller 11 is composed of a hard roller, for example a metallic roller which is processed to have rough surface. The developed toner image is transferred to an intermediate transfer belt 36 of the intermediate transfer device 30. The cleaning means 170 comprises a cleaner blade for scraping off toner particles T adhering to the outer surface of the photoreceptor 140 after the transfer and a toner receiving element for receiving the toner particles scrapped by the cleaner blade.

The intermediate transfer device 30 comprises a driving roller 31, four driven rollers 32, 33, 34, 35, and the endless intermediate transfer belt 36 wound onto and tightly held by these rollers. The driving roller 31 has a gear (not shown) fixed at the end thereof and the gear is meshed with a driving gear of the photoreceptor 140 so that the driving roller 31 is rotated at substantially the same peripheral velocity as the photoreceptor 140. As a result, the intermediate transfer belt 36 is driven to circulate at substantially the same peripheral velocity as the photoreceptor 140 in the direction of arrow.

The driven roller 35 is disposed at such a position that the intermediate transfer belt 36 is in press contact with the photoreceptor 140 by the tension itself between the driving roller 31 and the driven roller 35, thereby providing a primary transfer portion T1 at the press contact portion between the photoreceptor 140 and the intermediate transfer belt 36. The driven roller 35 is arranged at an upstream of the circulating direction of the intermediate transfer belt and near the primary transfer portion T1.

On the driving roller 31, an electrode roller (not shown) is disposed via the intermediate transfer belt 36. A primary transfer voltage is applied to a conductive layer of the intermediate transfer belt 36 via the electrode roller. The driven roller 32 is a tension roller for biasing the intermediate transfer belt 36 in the tensioning direction by a biasing means (not shown). The driven roller 33 is a backup roller for providing a secondary transfer portion T2. A second transfer roller 38 is disposed to face the backup roller 33 via the intermediate transfer belt 36. A secondary transfer voltage is applied to the secondary transfer roller. The secondary transfer roller can move to separate from or to come in contact with the intermediate transfer belt 36 by a sifting mechanism (not shown). The driven roller 34 is a backup roller for a belt cleaner 39. The belt cleaner 39 can move to separate from or to come in contact with the intermediate transfer belt 36 by a shifting mechanism (not shown).

The intermediate transfer belt 36 is a dual-layer belt comprising the conductive layer and a resistive layer formed on the conductive layer, the resistive layer being brought in press contact with the photoreceptor 140. The conductive layer is formed on an insulating substrate made of synthetic resin. The primary transfer voltage is applied to the conductive layer through the electrode roller as mentioned above. The resistive layer is removed in a band shape along the side edge of the belt so that the corresponding portion of the conductive layer is exposed in the band shape. The electrode roller is arranged in contact with the exposed portion of the conductive layer.

In the circulating movement of the intermediate transfer belt 36, the toner image on the photoreceptor 140 is transferred onto the intermediate transfer belt 36 at the primary transfer portion T1, the toner image transferred on the intermediate transfer belt 36 is transferred to a sheet (recording medium) S such as a paper supplied between the secondary transfer roller 38 and the intermediate transfer belt at the secondary transfer portion T2. The sheet S is fed from a sheet feeder 50 and is supplied to the secondary transfer portion T2 at a predetermined timing by a pair of gate rollers G. Numeral 51 designates a sheet cassette and 52 designates a pickup roller.

The toner image transferred at the secondary transfer portion T2 is fixed by a fixing device 60 and is discharged through a discharge path 70 onto a sheet tray 81 formed on a casing 80 of the apparatus. The image forming apparatus of this example has two separate discharge paths 71, 72 as the discharge path 70. The sheet after the fixing device 60 is discharged through either one of the discharge paths 71, 72. The discharge paths 71, 72 have a switchback path through which a sheet passing through the discharge path 71 or 72 is returned and fed again through a return roller 73 to the second transfer portion T2 in case of forming images on both sides of the sheet.

The actions of the image forming apparatus as a whole will be summarized as follows:

(i) As a printing command (image forming signal) is inputted into a controlling unit 90 of the image forming apparatus from a host computer (personal computer) (not shown) or the like, the photoreceptor 140, the respective rollers 11 of the developing devices 10, and the intermediate transfer belt 36 are driven to rotate.

(ii) The outer surface of the photoreceptor 140 is uniformly charged by the charging roller 160.

(iii) The uniformly charged outer surface of the photoreceptor 140 is exposed to selective light L1 corresponding to image information for a first color (e.g. yellow) by the exposure unit 40, thereby forming an electrostatic latent image for yellow.

(iv) Only the development roller of the developing device 10Y for the first color e.g. yellow is set to have a predetermined development gap L relative to the photoreceptor or is brought in contact with the photoreceptor 140 so as to develop the aforementioned electrostatic latent image according to the non-contact development or the contact development, thereby forming a toner image of yellow as the first color on the photoreceptor 140.

(v) The primary transfer voltage of the polarity opposite to the polarity of the toner is applied to the intermediate transfer belt 36, thereby transferring the toner image formed on the photoreceptor 140 onto the intermediate transfer belt 36 at the primary transfer portion T1. At this point, the secondary transfer roller 38 and the belt cleaner 39 are separate from the intermediate transfer belt 36.

(vi) After residual toner particles remaining on the photoreceptor 140 is removed by the cleaning means 170, the charge on the photoreceptor 140 is removed by removing light L2 from a removing means 41.

(vii) The above processes (ii)–(vi) are repeated as necessary. That is, according to the printing command, the processes are repeated for the second color, the third color, and the forth color and the toner images corresponding to the printing command are superposed on each other on the intermediate transfer belt 36.

(viii) A sheet S is fed from the sheet feeder 50 at a predetermined timing, the toner image (a full color image formed by superposing the four toner colors) on the intermediate transfer belt 36 is transferred onto the sheet S with the second transfer roller 38 immediately before or after an end of the sheet S reaches the secondary transfer portion T2 (namely, at a timing as to transfer the toner image on the intermediate transfer belt 36 onto a desired position of the sheet S). The belt cleaner 39 is brought in contact with the intermediate transfer belt 36 to remove toner particles remaining on the intermediate transfer belt 36 after the secondary transfer.

(ix) The sheet S passes through the fixing device 60 whereby the toner image on the sheet S is fixed. After that, the sheet S is carried toward a predetermined position (toward the sheet tray 81 in case of single-side printing, or toward the return roller 73 via the switchback path 71 or 72 in case of dual-side printing).

(e) Image Forming Tests and the Results of the Tests

Full color images were formed by the aforementioned full color printer with four color toners consisting of the aforementioned cyan toner of Example 3, the magenta toner of Example 4, the yellow toner of Example 5, and the black toner of Example 6. Image forming tests are conducted inside an environmental laboratory under a condition of a low temperature of 10° C. and a low humidity of RH 15%, another condition of a normal temperature of 23° C. and a normal humidity of RH 60%, and still another condition of a high temperature of 35° C. and a high humidity of RH 80%. Under the aforementioned conditions, full color images of 20% duty were printed on 5000 sheets of paper, respectively. As results of checking image quality, it found that stable image quality was obtained.

The printing action of the printer was stopped during image forming with each color toner to check whether some prior toner particles were reversely transferred onto the photoreceptor from the intermediate transfer belt. As a result of this, no or little reverse transfer toner was found. Therefore, it was found that the production of reverse transfer toner can be prevented.

(f) Fixing Property Tests and a Fixing Device Used for the Tests

By using a fixing device as described below, a comparison between the toner of Example 1 and the toner of Comparative Example 1 was made about their fixing property.

The fixing device has two press rollers i.e. a heater roller of ϕ40 {with built-in halogen lamp 600 w, a layer, made of PFA having a thickness of 50 μm, formed on a silicone rubber 2.5 mm (60° JISA)} and a press roller of ϕ40 {with built-in halogen lamp 300 w, a layer, made of PFA having a thickness of 50 μm, formed on a silicone rubber 2.5 mm (60° JISA)}. Images were fixed by the two press rollers (with a load about 38 kgf) and at a preset temperature of 190° C. The toners were compared about their fixing property. A cotton cloth was put on the printed sheet and was rubbed 50 times with a weight of 200 g. The densities of solid image before and after the rubbing were measured and the retention rate (%) was calculated. The retention rate was used as an index for evaluating the fixing property of toner.

According to the results of fixing property tests, the retention rate of the toner of Example 1 was 95% while the retention rate of the toner of Comparison Example 1 was 90%. That is, the retention rate of the toner of Comparative Example 1 was lower than that of the toner of Example 1. In case that hydrophobic rutile/anatase type titanium oxide was added to the toner of Comparative Example 1 in the same amount by weight as that of the toner of Example 1, the toner exhibited fixing property nearly equal to that of the toner of Example 1. That is, just by adding a small amount of hydrophobic rutile/anatase type titanium oxide into the toner of Comparative Example 1 of which external additives are only hydrophobic silica, the excellent charging property and image retaining characteristic of toner can be exhibited without lowering the fixing property just like Examples 1 through 5.

(i) Toner Charging Characteristic Tests

Hydrophobic negatively chargeable small-particle vapor-phase silica (12 nm) (of which primary particle diameter was 12 nm) was previously mixed in an amount of 0.8% by weight and hydrophobic negatively chargeable large-particle vapor-phase silica (40 nm) (of which primary particle diameter was 40 nm) was previously mixed in an amount of 0.5% by weight to the mother particles of polymerized toner having a degree of circularity of 0.98 and a mean particle diameter ($D_{50}$), as 50% particle diameter based on the number, of 6.8 μm which was obtained in Example 1. By mixing hydrophobic rutile/anatase type titanium oxide fine particles in an amount of 0.2% by weight, 0.5% by weight, 1.0% by weight, and 2.0% by weight, respectively into this toner, four kinds of polymerized toners were prepared. With these polymerized toners, images were formed by the full color printer as shown in FIG. 8 according to the non-contact developing process to achieve the solid image density about 1.1.

TABLE 5

| Rutile/anatase type titanium oxide (wt. %) | Mean charge amount q/m (μc/g) | Amount of positively charged toner (wt. %) |
|---|---|---|
| 0 | −17.96 | 10.40 |
| 0.2 | −15.95 | 5.83 |
| 0.5 | −21.86 | 3.70 |
| 1.0 | −20.71 | 2.10 |
| 2.0 | −15.40 | 5.61 |

The mean charge amounts q/m (μc/g) of respective toners and the amounts of positively charged toner (% by weight, or briefly wt %) after image forming are shown in Table 5. The charge amount distribution of toner was measured by using an E-SPART analyzer EST-3 available from Hosokawa Micron Corporation.

As apparent from Table 5, the mean charge amount q/m of the toner containing 0 wt % of, i.e. without containing, hydrophobic rutile/anatase type titanium oxide was −17.96 μc/g and the amount of positively charged toner of the same was 10.40 wt %. The mean charge amount q/m of the toner containing 0.2 wt % of hydrophobic rutile/anatase type titanium oxide was −15.95 μc/g and the amount of positively charged toner of the same was 5.83 wt %. Further, the mean charge amount q/m of the toner containing 0.5 wt % of hydrophobic rutile/anatase type titanium oxide was −21.86 μc/g and the amount of positively charged toner of the same was 3.70 wt %. Furthermore, the mean charge amount q/m of the toner containing 1.0 wt % of hydrophobic rutile/anatase type titanium oxide was −20.71 μc/g and the amount of positively charged toner of the same was 2.10 wt %. Moreover, the mean charge amount q/m of the toner containing 2.0 wt % of hydrophobic rutile/anatase type titanium oxide was −15.40 μc/g and the amount of positively charged toner of the same was 5.61 wt %.

According to the results of the tests, the amount of positively charged toner i.e. inversely charged toner can be reduced with little change in the mean charge amount by adding hydrophobic rutile/anatase type titanium oxide.

Figure 9:
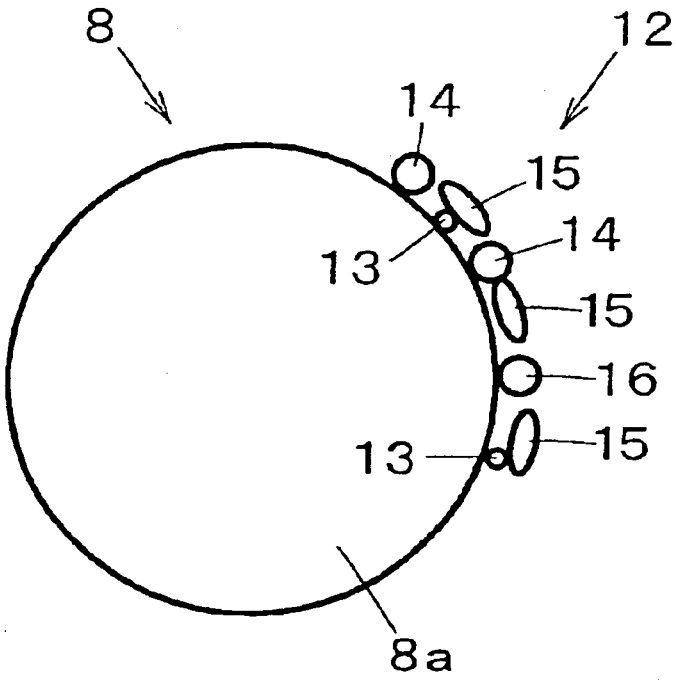
FIG. 9 is an illustration schematically showing another embodiment of non-magnetic single-component toner according to the present invention.

FIG. 9 is an illustration schematically showing a second embodiment of non-magnetic single-component toner according to the present invention.

As shown in FIG. 9, a negatively chargeable toner 8 as a non-magnetic single-component toner of the second embodiment also comprises toner mother particles 8*a* and external additives 12 externally adhering to the toner mother particles 8*a* similarly to the toner shown in FIG. 1. As the external additives 12, a hydrophobic silica ($SiO_2$) 13 having a small mean primary particle diameter, a hydrophobic silica ($SiO_2$) 14 having a large mean primary particle diameter, and hydrophobic rutile/anatase type titanium oxide ($TiO_2$) 15 are used similarly to the aforementioned first embodiment. In addition, hydrophobic positively chargeable silica ($SiO_2$) 16 of which diameter is equal or similar to that of the large-particle negatively chargeable silica 14 is also used in the negatively chargeable toner 8 of the second embodiment.

The mean primary particle diameter of the small-particle hydrophobic negatively chargeable silica 13 is set to 20 nm or less, preferably in a range from 7 to 16 nm and the mean primary particle diameter of large-particle hydrophobic negatively chargeable silica 14 is set to 30 nm or more, preferably in a range from 40 to 50 nm. The rutile/anatase type titanium oxide 15 consists of rutile type titanium oxide and anatase type titanium oxide which are mixed at a predetermined mixed crystal ratio and may be obtained by the aforementioned production method disclosed in Japanese Patent Unexamined Publication No. 2000-128534. The hydrophobic rutile/anatase type titanium oxide particles 15 are each formed in a spindle shape of which major axial diameter is in a range from 0.02 to 0.10 $\mu$m and the ratio of the major axial diameter to the minor axial diameter is set to be 2 to 8. The mean primary particle diameter of hydrophobic positively chargeable silica 16 is set to be equal or similar to the particle diameter of the large-particle hydrophobic negatively chargeable silica 14, i.e. 30 nm or more, preferably in a range form 40 to 50 nm.

In the negatively chargeable toner 8 of the second embodiment, the negative charging property is imparted to the toner mother particles by the hydrophobic negatively chargeable silicas 13, 14 having work function (numerical examples will be described later) smaller than the work function (numerical examples will be described later) of the toner mother particles 8*a*. On the other hand, by mixing and using hydrophobic rutile/anatase type titanium oxide particles 15 having work function (numerical examples will be described later) larger than or equal to the work function of the toner mother particles 8*a* (the difference in work function therebetween is in a range of 0.25 eV or less), the toner mother particles 8*a* is prevented from being excessively charged.

The hydrophobic positively chargeable silica 16 is surface-treated to be positively chargeable by a material such as aminosilane and is set to have a work function as a whole smaller than the work function of the toner mother particles 8*a*. By the hydrophobic positively chargeable silica 16, the positive charging is imparted to the toner mother particles 8*a*.

The toner mother particles used in the negatively chargeable toner 8 of the second embodiment may be prepared by the pulverization method or the polymerization method similarly to the first embodiment. Hereinafter, the preparation method will be described.

First, description will be made as regard to the preparation of the negatively chargeable toner 8 of the second embodiment employing toner mother particles made by the pulverization method, i.e. the preparation of a pulverized toner 8.

For making the pulverized toner 8, similarly to the aforementioned pulverized toner 8 of the first embodiment, a pigment, a release agent, and a charge control agent are uniformly mixed to a resin binder by a Henschel mixer, then melt and kneaded by a twin-shaft extruder. After cooling process, they are classified through the rough pulverizing-fine pulverizing process so as to obtain toner mother particles 8*a*. Further, fluidity improving agents are added as external additives to the toner motor particles. In this manner, the loner is obtained.

As the fluidity improving agent, at least the aforementioned small-particle hydrophobic negatively chargeable silica 13, the aforementioned large-particle hydrophobic negatively chargeable silica 14, the aforementioned hydrophobic rutile/anatase type titanium oxide 15, and further the large-particle positively chargeable silica 16 of which particle diameter is equal or similar to that of the large-particle negatively chargeable silica 14 are used. One or more of known inorganic and organic fluidity improving agents for toner may be additionally used in a state blended with the above fluidity improving agents. Examples as the known inorganic and organic fluidity improving agents are the same as listed in the aforementioned embodiment.

Proportions (by weight) in the pulverized toner 8 of the second embodiment are the same as those of the pulverized toner 8 of the first embodiment and shown in Table 1.

Also in the pulverized toner 8 of the second embodiment, in order to improve the transfer efficiency, the toner is preferably spheroidized. For this, similarly to the method of the aforementioned embodiment, it is preferable to use such a machine allowing the toner to be pulverized into relatively spherical particles. For example, by using a turbo mill (available from Kawasaki Heavy Industries, Ltd.) known as a mechanical pulverizer, the degree of circularity may be 0.93 maximum. Alternatively, by using a commercial hot air spheroidizing apparatus: Surfusing System SFS-3 (available from Nippon Pneumatic Mfg. Co., Ltd.), the degree of circularity may be 1.00 maximum.

The desirable degree of circularity (sphericity) of the pulverized toner 8 of the second embodiment is 0.91 or more, thereby obtaining excellent transfer efficiency. In case of the degree of circularity up to 0.97, a cleaning blade is preferably used. In case of the higher degree, a brush cleaning is preferably used with the cleaning blade.

The pulverized toner 8 of the second embodiment obtained as mentioned above is set to have a mean particle diameter ($D_{50}$), as 50% particle diameter based on the number, of 9 $\mu$m or less, preferably from 4.5 $\mu$m to 8 $\mu$m. Accordingly, the particles of the pulverized toner 8 have relatively small particle diameter. By using the hydrophobic negatively chargeable silica together with the hydrophobic rutile/anatase type titanium oxide as the external additives of the small-particle toner, the amount of hydrophobic silica can be reduced as compared to the amount of hydrophobic silica of a conventional case in which silica particles are used alone, thereby improving the fixing property.

In the pulverized toner 8 of the second embodiment, the total amount (weight) of external additives is set in a range from 0.5% by weight to 4.0% by weight, preferably in a range from 1.0% by weight to 3.5% by weight relative to the weight of toner mother particles. Therefore, when used as full color toners, the pulverized toner 8 can exhibit its effect of preventing the production of reverse transfer toner particles. If the external additives are added in a total amount of 4.0% by weight or more, external additives may be liberated from the surfaces of mother particles and/or the fixing property of the toner may be degraded.

Now, description will be made as regard to the preparation of the non-magnetic single-component toner 8 of the second embodiment employing toner mother particles made by the polymerization method, that is, to the preparation a polymerized toner 8.

The method of preparing the polymerized toner 8 of the second embodiment may be the same as the aforementioned embodiment so as to form colored polymerized toners having desired particle sizes. Among the materials used for preparing the polymerized toner, the coloring agent, the release agent, the charge control agent, and, the fluidity improving agent may be the same materials for the aforementioned pulverized toner.

Proportions (by weight) in the emulsion polymerized toner 8 of the second embodiment are the same as those of the emulsion polymerized toner 8 of the first embodiment and shown in Table 2.

Also in the polymerized toner 8 of the second embodiment, in order to improve the transfer efficiency, the toner is preferably spheroidized to increase the degree of circularity similarly to the aforementioned embodiment.

Similarly to the aforementioned first embodiment, the pulverized toner of the second embodiment may be prepared by the dispersion polymerization method, for example, disclosed in Japanese Patent Unexamined Publication No. 63-304002.

Similarly to the aforementioned pulverized toner 8, the desirable degree of circularity (sphericity) of the polymerized toner 8 of the second embodiment is 0.95 or more. In case of the degree of circularity up to 0.97, a cleaning blade is preferably used. In case of the higher degree, a brush cleaning is preferably used with the cleaning blade.

The polymerized toner 8 of the second embodiment obtained as mentioned above is set to have a mean particle diameter ($D_{50}$), as 50% particle diameter based on the number, of 9 $\mu$m or less, preferably from 4.5 $\mu$m to 8 $\mu$m. Accordingly, the particles of the polymerized toner 8 have relatively small particle diameter. By using the hydrophobic negatively chargeable silica together with the hydrophobic rutile/anatase type titanium oxide as the external additives of the small-particle toner, the amount of hydrophobic silica can be reduced as compared to the amount of hydrophobic silica of a conventional case in which silica particles are used alone, thereby improving the fixing property.

In the polymerized toner 8 of the second embodiment, similarly to the aforementioned pulverized toner, the total amount (weight) of external additives is set in a range from 0.5% by weight to 4.0% by weight, preferably in a range from 1.0% by weight to 3.5% by weight relative to the weight of toner mother particles. Therefore, when used as full color toners, the polymerized toner 8 can exhibit its effect of preventing the production of reverse transfer toner particles. If the external additives are added in a total amount of 4.0% by weight or more, external additives may be liberated from the surfaces of mother particles and/or the fixing property of the toner may be degraded.

Figure 10:
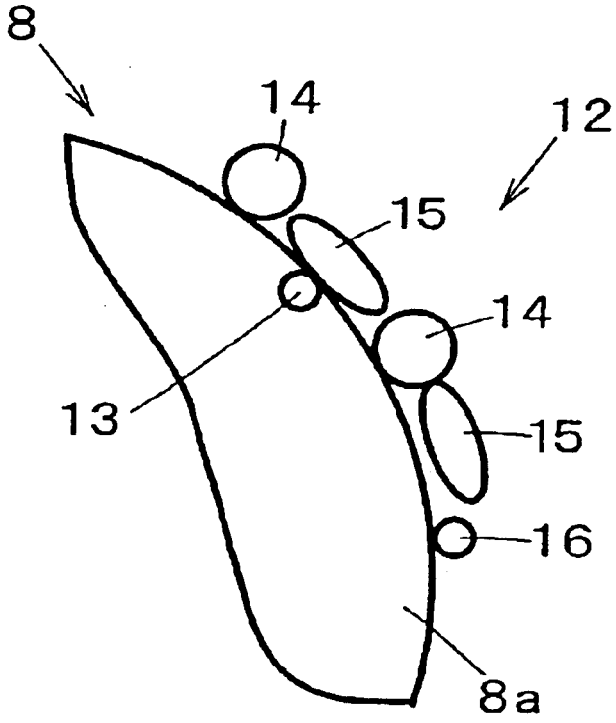
FIG. 10 is an illustration for explaining the behavior of the negatively chargeable toner shown in FIG. 9.

In the negatively chargeable toner 8 of the second embodiment structured as mentioned above, in either case of polymerized toner or pulverized toner, the small-particle hydrophobic negatively chargeable silica 13 is easy to be embedded in toner mother particles 8*a* as shown in FIG. 10. Since the work function of the hydrophobic rutile/anatase type titanium oxide 15 is larger than the work function of hydrophobic negatively chargeable silica 13, the hydrophobic rutile/anatase type titanium oxide sticks to the embedded hydrophobic silica 13 because of the difference in work function so that the hydrophobic rutile/anatase type titanium oxide is hardly liberated from the toner mother particles 8*a*. In addition, since the large-particle hydrophobic negatively chargeable silica 14 sticks to the surface of each toner mother particle 8*a*, the surface of each toner mother particle 8*a* can be covered evenly with the hydrophobic negatively chargeable silicas 13, 14, the hydrophobic rutile/anatase type titanium oxide 15, and the hydrophobic positively chargeable silica 16.

Therefore, characteristics of rutile/anatase type titanium oxide 15, i.e. a feature that they are hardly embedded into mother particles and charge-controlling function, can be fully exhibited. Synergistic function of features owned by the hydrophobic negatively chargeable silicas 13, 14, i.e. the negative charging property and fluidity, and characteristics owned by the hydrophobic rutile/anatase type titanium oxide, i.e. capable of preventing excessive negative charging, can be imparted to the toner mother particles 8*a*. Therefore, the negatively chargeable toner 8 can be prevented from excessively negatively charged without reducing its fluidity, thereby further improving the negative charging property. As a result of this, the production of reverse transfer toner and the generation of fog can be effectively inhibited. Accordingly, the negative charging of the negatively chargeable toner 8 can be kept stable for longer period of time and stable image quality can be provided even for successive printing.

In addition, the large-particle positively chargeable silica 16 functions as micro carrier, thus speeding up the risetime for charging the toner mother particles 8*a*. As a result of this, the production of reverse transfer toner and the generation of fog can be further effectively inhibited.

It is preferable to set the adding amount (weight) of the large-particle positively chargeable silica 16 to be 30% or less of the total adding amount of the hydrophobic negatively chargeable silicas 13, 14 so that the function of the large-particle positively chargeable silica 16 can be effectively exhibited without losing the functions of the hydrophobic negatively chargeable silicas 13, 14.

By adding the hydrophobic negatively chargeable silicas 13, 14 in a total amount (weight) larger than the total adding amount (weight) of the hydrophobic rutile/anatase type titanium oxide 15 and the hydrophobic positively chargeable silica 16, the negative charging of the negative chargeable toner 8 can be kept stable for further longer period of time. Therefore, the generation of fog on non-image portions can be further effectively inhibited, the transfer efficiency can be further improved, and the production of reverse transfer toner particles can be further effectively inhibited.

The reduced fog and reduced reverse transfer toner particles can be obtained by using the large-particle positively chargeable silica 16 without reducing the fluidity as compared with a case of adding small-particle positively chargeable silica even with the same amount of fluidity improving agents.

The negatively chargeable toner 8 of the second embodiment can be used in an image forming apparatus having a developing device 10 of non-contact single-component developing type as shown in FIG. 5 or an image forming apparatus having a developing device 10 of contact single-component developing type as shown in FIG. 6.

In this case, a regulating blade 7 is formed by pasting rubber tips on a SUS, a phosphor bronze, a rubber plate, a metal sheet. The regulating blade is biased against a development roller 11 by a biasing means such as a spring (not shown) or the bounce itself as an elastic member with a linear load of 20 to 60 gf/cm to make the toner layer on the development roller 11 into a uniform thickness of 5 to 20 $\mu$m, preferably 6 to 15 $\mu$m and to regulate such that the number of layers made up of toner particles becomes 1 to 2, preferably 1 to 1.8.

A recording medium 9 such as a paper or an intermediate image transfer medium (not shown in FIGS. 5 and 6, shown in FIG. 8 as will be described later) is fed between the organic photoreceptor 1 with visible image thereon and the transfer roller 5. In this case, the pressing load to the organic photoreceptor 1 by the transfer roller 5 is preferably in a range from 20 to 70 gf/cm, preferably from 25 to 50 gf/cm which is nearly equal to that of the contact developing type.

Other structure of the image forming apparatus using the negatively chargeable toner 8 of the second embodiment is the same as that of the first embodiment. In addition, the developing bias and the ratio of peripheral velocity between the development roller 11 and the organic photoreceptor 1 are the same as those of the first embodiment.

Description will now be made as regard to examples of the negatively chargeable toner 8 of the second embodiment, and product examples of the organic photoreceptor and the transfer medium of the image forming apparatus according to the non-contact or contact developing process as shown in FIG. 8 and having the basic structure shown in FIG. 5. It should be understood that the image forming apparatus as shown in FIG. 8 can carry out the contact single-component developing process as mentioned above. Among the following image forming tests, however, some tests were conducted by the image forming apparatus according to the contact single-component developing process. The following description will be made based on the non-contact single-component developing process.

(Production of Negatively Chargeable Toner)

Negatively chargeable toners 8 of the second embodiment were made both in the polymerization method and in the pulverization method described above. The fluidity improving agents (external additives) used for making the respective example toners were combinations of at least two from a group consisting of hydrophobic rutile/anatase type titanium oxide (20 nm) of which major axial length was 20 nm and which was treated with silane coupling agent, small-particle hydrophobic negatively chargeable vapor-phase silica (7 nm) which was surface-treated with hexamethyldisilazane (HMDS) and of which mean primary particle diameter was 7 nm, small-particle hydrophobic negatively chargeable vapor-phase silica (12 nm) which was treated to have hydrophobic property in the same manner and of which mean primary particle diameter was 12 nm, small-particle hydrophobic negatively chargeable vapor-phase silica (16 nm) which was treated to have hydrophobic property in the same manner and of which mean primary particle diameter was 16 nm, large-particle hydrophobic negatively chargeable vapor-phase silica (40 nm) which was treated to have hydrophobic property in the same manner and of which mean primary particle diameter was 40 nm, and large-particle hydrophobic positively chargeable vapor-phase silica (30 nm) (silica (1) listed in Table 7 described later) treated with aminosilane (AS) to be positively chargeable and of which mean primary particle diameter was 30 nm. In addition, for preparing comparative examples of the present invention, two kinds of small-particle positively chargeable vapor-phase silicas (12 nm) (silicas (2), (3) listed in Table 7 described later) which are treated to have hydrophobic property and of which mean particle diameter was 12 were made. The work functions of the above agents were measured and the results of the measurements are shown in Table 6. The electric resistance of the low resistance hydrophobic rutile/anatase type titanium oxide (20 nm) was measured and the result of the measurement is also shown in Table 6. It should be noted that the work functions (Φ) were measured by the aforementioned spectrophotometer AC-2, produced by Riken Keiki Co., Ltd with radiation amount of 500 nW.

TABLE 6

| External additives | | Work function Φ (eV) | Normalized photoelectron yield |
|---|---|---|---|
| Rutile/anatase type titanium oxide (20 nm) | Electric resistance $1.3 \times 10^{11}$ Ω cm | 5.64 | 8.4 |
| Negatively chargeable vapor-phase silica (7 nm) | | 5.18 | 6.1 |
| Negatively chargeable vapor-phase silica (12 nm) | | 5.22 | 5.1 |
| Negatively chargeable vapor-phase silica (16 nm) | | 5.19 | 6.8 |
| Negatively chargeable vapor-phase silica (40 nm) | | 5.24 | 5.2 |
| Positively chargeable vapor-phase silica (30 nm)(1) | | 5.37 | 11.5 |
| Positively chargeable vapor-phase silica (12 nm)(2) | | 5.13 | 10.7 |
| Positively chargeable vapor-phase silica (12 nm)(3) | | 5.14 | 7.8 |

As apparent from Table 6, the work function Φ of the rutile/anatase type titanium oxide (20 nm), treated to have hydrophobic property, was 5.64 eV, the normalized photoelectron yield at this point was 8.4, and the electric resistance was $1.3\times10^{11}$ Ωcm. The work function Φ of the negatively chargeable vapor-phase silica (7 nm) was 5.18 eV and the normalized photoelectron yield was 6.1. The work function Φ of the negatively chargeable vapor-phase silica (12 nm) was 5.22 eV and the normalized photoelectron yield was 5.1. The work function Φ of the negatively chargeable vapor-phase silica (16 nm) was 5.19 eV and the normalized photoelectron yield was 6.8. The work function Φ of the negatively chargeable vapor-phase silica (40 nm) was 5.24 eV and the normalized photoelectron yield at this point was 5.2. The work function Φ of the positively chargeable vapor-phase silica (30 nm) (1) was 5.37 eV and the normalized photoelectron yield was 11.5. The work function Φ of the positively chargeable vapor-phase silica (12 nm) (2) was 5.13 eV and the normalized photoelectron yield was 10.7. The work function Φ of the positively chargeable vapor-phase silica (12 nm) (3) was 5.14 eV and the normalized photoelectron yield was 7.8.

(1) Examples of Emulsion Polymerized Toner of the Second Embodiment and Comparative Examples of Emulsion Polymerized Toner (a) Production of Emulsion Polymerized Toners of Example 7, Comparative Example 4, Comparative Example 5, and Comparative Example 6

Cyan toner mother particles for these example and comparative examples were obtained in the same manner as the cyan toner mother particles of the aforementioned Example 1.

The obtained mother particles for cyan toner were measured. The results of measurement showed that the mean particle diameter was 6.8 μm, the degree of circularity was 0.98, and the work function was 5.57 eV which was measured by using the aforementioned surface analyzer. Subsequently, as the fluidity improving agents, small-particle negatively chargeable hydrophobic silica 13 having a mean primary particle diameter about 7 nm was added in an amount of 1% by weight to the mother particles for cyan toner, and large-particle negatively chargeable hydrophobic silica 14 having a mean primary particle diameter of 40 nm was added in an amount of 1% by weight to the mother particles for cyan toner wherein these silicas were surface-treated with hexamethyldisilazane (HMDS), so as to produce a mixed toner.

Further, three kinds of positively chargeable hydrophobic silicas listed in Table 7 were prepared by surface-treating hydrophobic silica with aminosilane (AS) and were added, respectively, to the aforementioned mixed toner in an amount of 0.5% by weight so as to make a toner of Example 7 and toners of Comparative Examples 4 and 5, respectively. The mixed toner containing none of the positively chargeable hydrophobic silicas (that is, the mixed toner) was a toner of Comparative Example 6.

TABLE 7

| Positively chargeable silicas used in examples | Positive charging property relative to ferrite carrier (μc/g) | Mean primary particle diameter (nm) |
|---|---|---|
| Silica (1) for Example 7 | +150 | About 30 |
| Silica (2) for Comparative Example 4 | +280 | About 12 |
| Silica (3) for Comparative Example 5 | +380 | About 12 |

As shown in Table 7, the positively chargeable hydrophobic silica (silica (1)) used in the toner of Example 7 had positive charging property relative to ferrite carrier of +150 μc/g and a mean primary particle diameter of about 30 nm. The positively chargeable hydrophobic silica (silica (2)) used in the toner of Comparative Example 4 had positive charging property relative to ferrite carrier of +280 μc/g and a mean primary particle diameter of about 12 nm. The positively chargeable hydrophobic silica (silica (3)) used in the toner of Comparative Example 5 had positive charging property relative to ferrite carrier of +380 μc/g and a mean primary particle diameter of about 12 nm. As apparent from the aforementioned results of measurement, the work functions of these silicas (1), (2), and (3) are smaller than the work function of the mother particles for cyan toner. The measured work functions of the toners of Example 7 and Comparative Examples 4 through 6 were 5.51 eV, 5.50 eV, 5.50 eV, and 5.45 eV, respectively.

(b) Production of Emulsion Polymerized Toners of Example 8, Comparative Example 7, Comparative Example 8, and Comparative Example 9

Mother particles for magenta toner was obtained in the same manner as the production of the cyan emulsion polymerized toner of Example 7 except that Quinacridon was used instead of Phthalocyanine Blue as the pigment and that the temperature for improving the association and the film bonding strength of secondary particles was still kept at 90° C. The obtained mother particles for magenta toner had a degree of circularity of 0.97 and a work function of 5.65 eV. The same treatment for providing external additives of Example 7 and Comparative Examples 4 through 6 were conducted to the mother particles for magenta toner so as to make toners of Example 8 and Comparative Examples 7 through 9, respectively. At this point, the work functions of these silicas (1), (2), and (3) are smaller than the work function of the mother particles for magenta toner. The measured work functions of the toners of Example 8 and Comparative Examples 7 through 9 were 5.59 eV, 5.58 eV, 5.58 eV, and 5.53 eV, respectively.

(c) Production of Emulsion Polymerized Toner of Example 9

To the aforementioned cyan toner of Example 7, rutile/anatase type titanium oxide, of which mixed crystal ratio was 10% by weight of rutile type titanium oxide and 90% by weight of anatase type titanium oxide and which was treated with a silane coupling agent to have hydrophobic property, (degree of hydrophobic: 58%, specific surface: 150 $m^2/g$) was added in an amount of 0.5% and mixed, and the silica (1) listed in Table 7 was further added in an amount of 0.5% and mixed, thereby making a toner of Example 9. At this point, the work function of the rutile/anatase type titanium oxide was larger than either of the work functions of the negatively chargeable silicas 13, 14 and the positively chargeable silica 16 and was nearly equal to or larger than the work function of the mother particles 8*a* for cyan toner. Concretely, as results of measurements, the work function of the rutile/anatase type titanium oxide was 5.64 eV and the work function of the toner of Example 9 was 5.58 eV.

(2) Examples of Pulverized Toner of the Second Embodiment (a) Production of Pulverized Toner of Example 10, Example 11, Comparative Example 10, and Comparative Example 11

As toner mother particles for the examples and comparative examples, toner mother particles having a mean particle diameter of 7.6 μm and a degree of circularity of 0.91 were obtained in the same manner as the aforementioned toner mother particles of Example 3. The measured work function of the toner mother particles was 5.46 eV.

To the toner mother particles, negatively chargeable hydrophobic silica which had been surface-treated with hexamethyldisilazane (HMDS) as a fluidity improving agent and had a mean primary particle diameter about 12 nm was added in an amount of 0.8% by weight, negatively chargeable hydrophobic silica which had been surface-treated in the same manner and had a mean primary particle diameter about 40 nm was added in an amount of 0.5% by weight and mixed. In addition, rutile/anatase type titanium oxide, of which mixed crystal ratio was 10% by weight of rutile type titanium oxide and 90% by weight of anatase type titanium oxide and which was treated with a silane coupling agent to have hydrophobic property, (degree of hydrophobic: 58%, specific surface: 150 $m^2/g$) was added in an amount of 0.4% and mixed to make a mixed toner.

Large-particle positively chargeable hydrophobic silica (silica (1)) (mean primary particle diameter: about 30 nm) listed in Table 7 treated with aminosilane (AS) was added in an amount of 0.2% by weight to the mixed toner, thereby making a toner of Example 10. On the other hand, small-particle positively chargeable hydrophobic silica (silica (2)) (mean primary particle diameter: about 12 nm) listed in Table 7 treated in the same manner was added in an amount of 0.2% by weight to the mixed toner, thereby making a toner of Example 10. The mixed toner without containing the positively chargeable hydrophobic silica was a toner of Comparative Example 11.

Besides, toner mother particles were prepared in the same manner as the above toner mother particles except that Quinacridon was used instead of Phthalocyanine Blue as the pigment. The work function of the obtained mother particles was 5.57 eV as a result of measurement. The same treatment for providing external additives of Example 10 was conducted to the toner mother particles, thereby making a toner of Example 11 of the present invention. As results of measurements, the work functions of the toners of Examples 10 and 11, and Comparative Examples 10 and 11 were 5.45 eV, 5.56 eV, 5.44 eV, 5.46 eV, respectively.

(b) Production of Pulverized Toner of Example 12 and Example 13

Mother particles for yellow toner and mother particles for black toner were obtained in the same manner as the production of the aforementioned pulverized toner of Example 10 except that Pigment Yellow 180 was used as the pigment or that Carbon Black was used as the pigment. As a result of measurement, the work functions of the mother particles for yellow toner was 5.62 eV and the work function of the mother particles for black toner was 5.72 eV. The same treatment for providing external additives of Example 10 was conducted to the mother particles for yellow toner and the mother particles for black toner, respectively so as to make respective toners of Examples 12 and 13 of the present invention. As results of measurement, the work functions of the toners of Examples 12 and 13 were 5.61 eV and 5.71 eV, respectively.

Hereinafter, product examples of components of an image forming apparatus using the negatively chargeable toner 8 of the second embodiment will be described.

(Product Example 2 of Organic Photoreceptor (OPC2) [1 in FIG. 5 and FIG. 6, 140 in FIG. 8])

In Product Example 2, an organic photoreceptor (OPC (2)) was obtained in the same manner as the aforementioned Product Example 1 except that a seamless nickel electroforming pipe having a thickness 40 μm and a diameter of 85.5 mm was used as the conductive substrate 1*a* and that a distyryl compound having the following formula (2) was used as the charge transport material. The work function of the obtained organic photoreceptor was measured in the same manner as mentioned above. The work function was 5.50 eV.

Structural Formula (2)

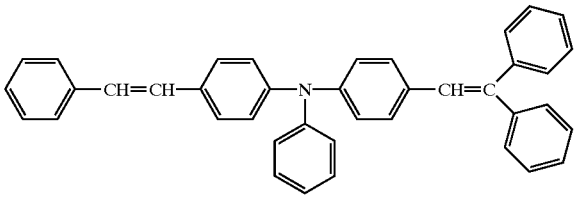

(Product Example of Development Roller 11)

An aluminum pipe of 18 mm in diameter was surfaced with nickel plating (thickness: 23 μm) to have surface roughness (Ra) of 4 μm, thereby obtaining a development roller 11. The surface of the obtained development roller 11 was partially cut for measuring the work function and the work function was measured in the same manner as mentioned above. The work function was 4.58 eV.

(Product Example of Toner Regulating Blade)

Conductive polyurethane rubber tips of 1.5 mm in thickness were attached to a SUS plate of 80 μm in thickness by conductive adhesive, thereby making a toner regulating blade 7. The work function of the polyurethane portions was set to be 5 eV.

(Product Example of Transfer Medium of Intermediate Transfer Device)

In the same manner as the aforementioned example, an intermediate conductive layer as a conductive layer of and a transfer layer as a resistance layer of an intermediate transfer belt 36 as the transfer medium of the intermediate transfer device 30 were formed.

(Product Example of Fixing Device)

A fixing device 60 comprised two press rollers (with load about 38 kgf) i.e. a heater roller and a press roller. The heat roller had a built-in halogen lamp 600 w and was obtained by forming PFA layer having a thickness of 50 μm on a silicone rubber of 2.5 mm (60° JISA) to make its entire diameter ϕ40. The press roller had a built-in halogen lamp 300 w and was obtained by forming PFA layer having a thickness of 50 μm on a silicone rubber of 2.5 mm (60° JISA) to make its entire diameter ϕ40. The fixing temperature was set to 190° C.

The actions of the full color printer of the second embodiment structured as mentioned above are the same as the actions of the aforementioned full color printer using the negatively chargeable toner 8 of the first embodiment.

(Image Forming Tests and the Results of the Tests)

(Image Forming Test 1)

By using full color printers as shown in FIG. 8 each employing the organic photoreceptor 1 (OPC 1) given by the aforementioned structural formula 1 and capable of conducting the non-contact developing process, images were formed to have a solid image density in the order of 1.1 to 1.2 with each of the toners of Example 7 and Comparative Examples 4 and 5 shown in Table 7 set in the cyan developing device 10 (C) of each printer, according to the non-contact developing process with a preset developing gap of 220 μm (under conditions: the light potential of the organic photoreceptor 1 was −600 V, the dark potential of the organic photoreceptor 1 was −80 V, DC developing bias was −300 V, AC developing bias was 1.35 kV, AC frequency was 2.5 kHz). During this, the charge amount of each cyan toner on the development roller 11 was measured by a charge distribution measuring system E-SPART analyzer EST-3 available from Hosokawa Micron Corporation. In addition, the degree of fog toner on the organic photoreceptor was measured by the tape transfer method and the degree of reverse transfer toner from the transfer belt 36 to the organic photoreceptor 1 during a process for the second color was also measured by the tape transfer method. It should be noted that the tape transfer method is a method comprising attaching a mending tape, available from Sumitomo 3M Ltd., onto toner to transfer fog toner particles or reverse transfer toner particles onto the mending tape, attaching the tape on a white plain paper, measuring the density from above the tape by the reflection densitometer, and obtaining the difference by subtracting the density of the tape from the measured value. The difference is defined as the fog density or reverse transfer density. The results of measurements are shown in Table 8.

TABLE 8

| Toner | Charge amount (μc/g) | Density of fog toner | Density of reverse transfer toner |
|---|---|---|---|
| Example 7 (using Silica (1)) | −24.0 | 0.009 | 0.001 |
| Comparative Example 4 (using Silica (2)) | −19.3 | 0.011 | 0.043 |
| Comparative Example 5 (using Silica (3)) | −13.3 | 0.038 | 0.105 |
| Comparative Example 6 | −15.3 | 0.013 | 0.058 |

As apparent from Table 8, by adding hydrophobic positively chargeable silica 16 having large particle size (particle diameter: about 30 nm), the charge amount was increased, the amount of fog toner and the amount of reverse transfer toner were reduced in comparison with the toner of Comparative Example 6 without such large-particle positively chargeable silica 16. Conversely, in Comparative Examples 4 and 5 in which hydrophobic positively chargeable silica having small particle size (particle diameter: about 12 nm) was added, reduction in charge amount, increase in density of fog toner, and increase in density of reverse transfer toner were recognized. Therefore, it was found that the use of the large-particle positively chargeable silica 16 increases the charge amount and exhibits the effect of preventing fog and preventing reverse transfer rather than the use of the small-particle positively chargeable silica.

(Image Forming Test 2)

Figure 13:
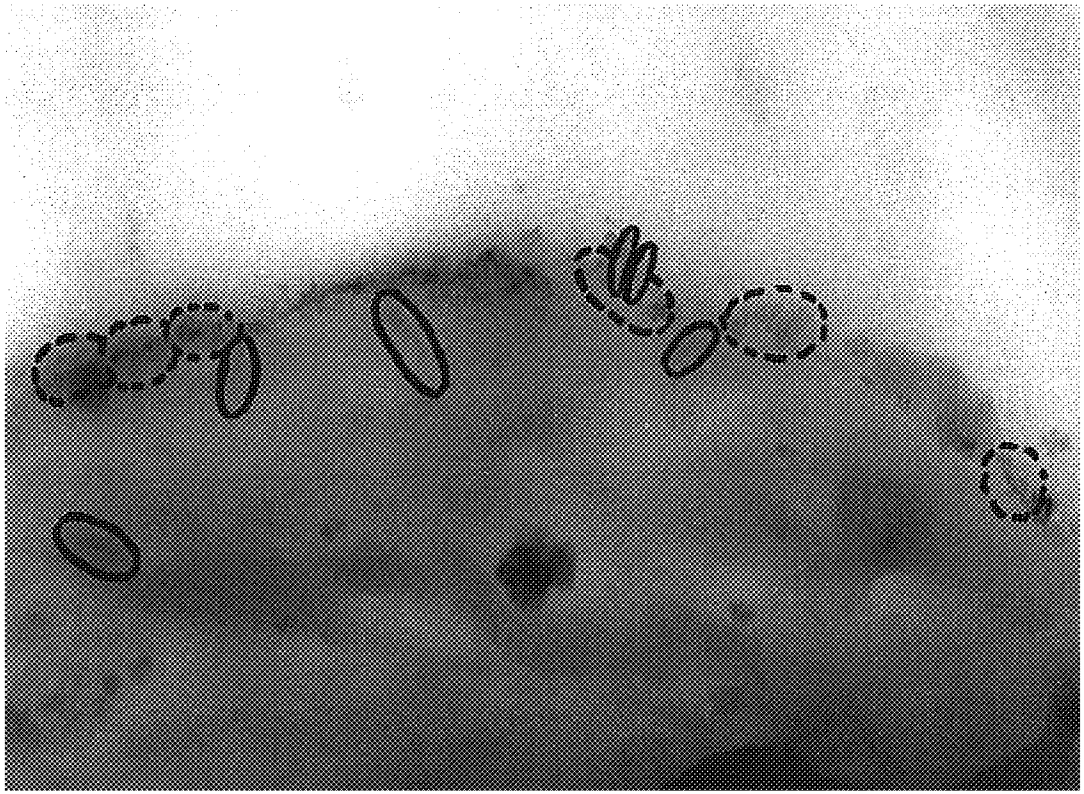
FIG. 13 is a microphotograph of a negatively chargeable toner of Comparative Example 11.

Electron micrographs of the toner of Example 10, the toners of Comparative Examples 10 and 11 were taken and shown in FIG. 11, FIG. 12, and FIG. 13, respectively. As apparent from the electron micrographs shown in FIGS. 11 through 13, the toner of Example 10 containing 0.2 weight % of large-particle hydrophobic positively chargeable silica 16 as an external additive takes the form that the external additives strongly adhere to the surface of a toner mother particle 8*a*. On the other hand, either of the toner of Comparative Example 10 containing small-particle hydrophobic positively chargeable silica as an external additive and the toner of Comparative Example 11 not containing positively chargeable silica at all takes the form that the external additives weakly adhere to the surfaces of the mother particles 8*a*, just like standing on the surfaces of the mother particles 8*a*.

Therefore, the negatively chargeable toner 8 of Example 10 of the present invention can enough and effectively exhibit the aforementioned functions of the external additives strongly adhering to the surfaces of the mother particles 8*a*, while the negatively chargeable toners of Comparative Examples 10 and 11 cannot enough exhibit the aforementioned functions of the external additives because the external additives are easily liberated from the surfaces of the mother particles 8*a*. That is, as the adhering force of the external additives relative to the mother particles 8*a* is weak, the charging property of the toner is reduced so that external additives may be liberated from the surface of the development roller 11 when successively printing a number of sheets. Actually, images were successively printed on 1000 sheets of paper by each of color printers as shown in FIG. 8 in which each toner was set in each developing device 10(C). The state of scattering of toner particles around each development roller 11 was visually observed. As a result, no or little scattering particles of the toner of Example 10 were observed, while scattering particles of the tones of Comparative Examples 10 and 11 were observed. The same printing test printing 1000 sheets of paper was made with the magenta toner of Example 11 of the present invention which was prepared with the same external additive treatment as the toner of Example 10. As a result, no scattering toner particles around the development roller 11 were visually observed.

(Image Forming Test 3)

Variations of the toner of Example 7 were prepared by changing the adding amounts of large-particle positively chargeable silica 16 within a range from 0 to 0.6% by weight. With these variations, the same image forming tests were made. The results of the tests are shown in Table 9.

TABLE 9

| Adding amounts of + silica (wt. %) | Charge amount (μc/g) | Mean OD value at solid image portion | OD value of fog toner | OD value of reverse transfer toner |
|---|---|---|---|---|
| 0 | −15.3 | 0.628 | 0.010 | 0.035 |
| 0.2 | −21.9 | 0.992 | 0.018 | 0.042 |
| 0.4 | −29.6 | 1.198 | 0.016 | 0.038 |
| 0.5 | −24.0 | 1.260 | 0.009 | 0.001 |
| 0.6 | −10.8 | 1.168 | 0.005 | 0.023 |

As apparent from Table 9, when the adding amount of the positively chargeable silica 16 was 0.6% or more, the charge amount was reduced, the density at solid image portions was also reduced, and further the amount of reverse transfer toner was increased. Therefore, the adding amount of the positively chargeable silica 16 is preferably 30% or less of the total amount of negatively chargeable silicas 13, 14 so as to obtain excellent results.

(Image Forming Test 4)

With the toner of Example 9 of the present invention, the same image forming test was made. As the results, the charge amount was −20 μc/g, the mean image density of solid image portion was 1.350, the OD value of fog toner was substantially 0, and the OD value of the reverse transfer toner was substantially 0. Therefore, it was found that the toner of Example 9 can achieve the printing of quite high quality with practically no fog toner and reverse transfer toner, as compared to the toner of Example 7. This is because, besides the positively chargeable silica 16, rutile/anatase type titanium oxide having a work function greater than that of the positively chargeable silica 16 is added, thereby further inhibiting the excessive negative charging and inhibiting the generation of positively charged toner particles.

(Image Forming Test 5)

Four color toners: the toner of Example 10 as a cyan toner; the toner of Example 11 as a magenta toner; the toner of Example 12 as an yellow toner; and the toner of Example 13 as a black toner, and the organic photoreceptor 1 (OPC 2) obtained according to the aforementioned structural formula (2) were combined and a color printer capable of conducting the contact developing process as shown in FIG. 8 was used to form full color images. Image forming tests were conducted inside an environmental laboratory under a condition of a low temperature of 10° C. and a low humidity of RH 15%, another condition of a normal temperature of 23° C. and a normal humidity of RH 60%, and still another condition of a high temperature of 35° C. and a high humidity of RH 65%. Under the aforementioned conditions, full color images of 20% duty were printed on 5000 sheets of paper. As results of checking image quality, it found that stable image quality was obtained without scattering toner around the development portion.

(Image Forming Test 6)

After images were formed with the toner of Example 8 and the toners of Comparative Examples 7 through 9, according to the contact developing process defined for the image forming tests 5, the formed images were fixed by using the following fixing device 60 and the respective toners were compared about their fixing property.

The fixing device 60 has two press rollers i.e. a heater roller of ϕ40 {with built-in halogen lamp 600 w, a layer, made of PFA having a thickness of 50 μm, formed on a silicone rubber 2.5 mm (60° JISA)} and a press roller of ϕ40 {with built-in halogen lamp 300 w, a layer, made of PFA having a thickness of 50 μm, formed on a silicone rubber 2.5 mm (60° JISA)}. Images were fixed by the two press rollers (with a load about 38 kgf) and at a preset temperature of 190° C. The respective toners were compared about their fixing property. A cotton cloth was put on the printed sheet with solid image and was rubbed 50 times with a weight of 200 g. The densities of solid image before and after the rubbing were measured and the retention rate (fixing rate) (%) was calculated. The retention rate was used as an index for evaluating the fixing property of toner. The results are shown in Table 10.

TABLE 10

| Toner | Amount of negatively chargeable silica (wt. %) | Amount of positively chargeable silica (wt. %) | Fixing rate (%) |
|---|---|---|---|
| Example 8 | 2 (about 7 nm and about 40 nm) | 0.5 (about 30 nm) | 95 |
| Comparative Example 7 | 2 (about 7 nm and about 40 nm) | 0.5 (about 12 nm) | 90 |
| Comparative Example 8 | 2 (about 7 nm and about 40 nm) | 0.5 (about 12 nm) | 90 |
| Comparative Example 9 | 2 (about 7 nm and about 40 nm) | 0 | 96 |

As apparent from Table 10, the toner of Example 8 exhibited a retention rate (fixing rate) of 95%. The toner of Comparative Example 9 containing a small amount of negatively chargeable silica exhibited similar retention rate. Unlike the above two toners, the toners of Comparative Examples 7 and 8 containing a relatively large amount of small-particle silica 13 exhibited a retention rate (fixing rate) of 90%. From these results, it is found that the fixing property is not or little reduced in case of using the large-particle positively chargeable silica 16 as compared to the same amount of the other fluidity improving agent. Though the same tests were conducted with negatively chargeable silicas having a mean primary particle diameter of about 12 nm and a mean primary particle diameter of about 16 nm, respectively, instead of the aforementioned small-particle negatively chargeable silica 13, such a tendency did not change. This means that the positively chargeable silica having larger mean primary particle diameter did not affect the fixing property.

(Image Forming Test 7)

Four color toners: the toner of Example 10 as a cyan toner; the toner of Example 11 as a magenta toner; the toner of Example 12 as an yellow toner; and the toner of Example 13 as a black toner, and the organic photoreceptor 1 (OPC 1) given by the aforementioned structural formula (1) were combined and a full color printer which is set to conduct the non-contact developing process of the intermediate transfer type as shown in FIG. 8 and comprises an intermediate transfer belt 36 was used to form full color images.

Image forming tests were conducted with a developing bias composed of a DC of −200 V and an AC having a frequency of 2.5 kHz and a P—P voltage of 1450 V superimposed on the DC, and with a development gap L of 210 $\mu$m (the space was adjusted by a gap roller). Under the condition, a character image corresponding to a color manuscript containing 5% each color was successively printed on 10000 sheets of paper.

The total amount of four color toners collected by cleaning the photoreceptor 1 was measured. The measured amount was 95 g that was about ½ of the expected amount of toners collected by cleaning the photoreceptor. Accordingly, by the combination of the aforementioned four color toners, the aforementioned photoreceptor 1 (OPC 1), and the aforementioned full color printer of non-contact developing type and of intermediate transfer type, the generation of reverse transfer toner and fog toner can be further effectively inhibited.

Now, a third embodiment of non-magnetic single-component toner of the present invention will be described.

A non-magnetic single-component toner 8 of the third embodiment also comprises toner mother particles 8*a* and external additives 12 externally adhering to the toner mother particles 8*a* as shown in FIG. 1. As the external additives 12, a hydrophobic silica ($SiO_2$) 13 having a small mean primary particle diameter, a hydrophobic silica ($SiO_2$) 14 having a large mean primary particle diameter, and hydrophobic rutile/anatase type titanium oxide ($TiO_2$) 15 are used.

Similarly to the aforementioned first and second embodiments, the mean primary particle diameter of the small-particle hydrophobic negatively chargeable silica 13 is set to 20 nm or less, preferably in a range from 7 to 16 nm and the mean primary particle diameter of large-particle hydrophobic negatively chargeable silica 14 is set to 30 nm or more, preferably in a range from 40 to 50 nm. The rutile/anatase type titanium oxide 15 consists of rutile type titanium oxide and anatase type titanium oxide which are mixed at a predetermined mixed crystal ratio and may be obtained by the aforementioned production method disclosed in Japanese Patent Unexamined Publication No. 2000-128534. The hydrophobic rutile/anatase type titanium oxide particles 15 are each formed in a spindle shape of which major axial diameter is in a range from 0.02 to 0.10 $\mu$m and the ratio of the major axial diameter to the minor axial diameter is set to be 2 to 8.

In the non-magnetic single-component toner 8 of the third embodiment, the negative charging property is imparted to the toner mother particles by the hydrophobic silicas 13, 14 having work function (numerical examples will be described later) smaller than the work function (numerical examples will be described later) of the toner mother particles 8*a*. On the other hand, by mixing and using hydrophobic rutile/anatase type titanium oxide particles 15 having work function (numerical examples will be described later) larger than or equal to the work function of the toner mother particles 8*a* (the difference in work function therebetween is in a range of 0.25 eV or less), the toner mother particles 8*a* is prevented from being excessively charged.

Also in the non-magnetic single-component toner 8 of the third embodiment, the toner mother particles may be prepared by the pulverization method or the polymerization method. In either method, the small-particle hydrophobic silica 13 is easily embedded in the toner mother particles 8*a* as shown in FIG. 4. Since the work function of the hydrophobic rutile/anatase type titanium oxide is larger than the work function of hydrophobic silica 13, the hydrophobic rutile/anatase type titanium oxide sticks to the embedded hydrophobic silica 13 because of the difference in work function so that the hydrophobic rutile/anatase type titanium oxide is hardly liberated from the toner mother particles 8*a*. In addition, since the large-particle hydrophobic silica 14 sticks to the surface of each toner mother particle 8*a*, the surface of each toner mother particle 8*a* can be covered evenly with the hydrophobic silicas 13, 14 and the hydrophobic rutile/anatase type titanium oxide 15. Therefore, the negative charging property of the non-magnetic single-component toner 8 can be kept stable for longer period of time and stable image quality can be provided even for successive printing.

By adding the hydrophobic silica 13 of which primary particles are small in an amount larger than the adding amount of the hydrophobic rutile/anatase type titanium oxide 15, the negative charging property of the non-magnetic single-component toner 8 can be kept stable for further longer period of time. Therefore, the fog on non-image portions can be further effectively prevented, the transfer efficiency can be further improved, and the production of reverse transfer toner particles can be further effectively prevented.

The non-magnetic single-component toner 8 of the third embodiment can be used in either of an image forming apparatus of non-contact developing type as shown in FIG. 5 and an image forming apparatus of contact developing type as shown in FIG. 6.

(Production Example of Non-Magnetic Single-Component Toner)

Examples of non-magnetic single-component toners 8 of the third embodiment were made both in the polymerization method and in the pulverization method similarly to the aforementioned first embodiment. The fluidity improving agents (external additives) used for making the respective example toners were combinations of at least two from a group consisting of hydrophobic rutile/anatase type titanium oxide (20 nm) of which major axial length was 20 nm, small-particle hydrophobic vapor-phase silica (12 nm) which was surface-treated with hexamethyldisilazane (HMDS) and of which mean primary particle diameter was 12 nm, large-particle hydrophobic vapor-phase silica (40 nm) which was treated to have hydrophobic property in the same manner and of which mean primary particle diameter was 40 nm, hydrophobic vapor-phase silica (7 nm) which was treated to have hydrophobic property in the same manner, and hydrophobic vapor-phase silica (16 nm) which was treated to have hydrophobic property in the same manner. The work functions Φ of the above fluidity external additives were measured and the results of the measurements are shown in Table 11. It should be noted that the work functions Φ were measured by the aforementioned spectrophotometer AC-2, produced by Riken Keiki Co., Ltd with radiation amount of 500 nW.

TABLE 11

| External additives | Work function Φ (eV) | Normalized photoelectron yield |
|---|---|---|
| Rutile/anatase type titanium oxide (20 nm) | 5.64 | 8.4 |
| Vapor-phase silica (7 nm) | 5.18 | 6.1 |
| Vapor-phase silica (12 nm) | 5.22 | 5.1 |
| Vapor-phase silica (16 nm) | 5.19 | 6.8 |
| Vapor-phase silica (40 nm) | 5.24 | 5.2 |

As apparent from Table 11, the work function Φ of the rutile/anatase type titanium oxide (20 nm), treated to have hydrophobic property, was 5.64 eV and the normalized photoelectron yield at this point was 8.4. The work function Φ of the vapor-phase silica (12 nm) was 5.22 eV and the normalized photoelectron yield at this point was 5.1. The work function Φ of the hydrophobic vapor-phase silica (40 nm) was 5.24 eV and the normalized photoelectron yield at this point was 5.2. Further, the work function Φ of the hydrophobic vapor-phase silica (7 nm) was 5.18 eV and the normalized photoelectron yield at this point was 6.1. Furthermore, the work function Φ of the vapor-phase silica (16 nm) was 5.19 eV and the normalized photoelectron yield at this point was 6.8.

(Examples of Image Forming Apparatus of Conducting Non-Contact or Contact Developing Process)

As examples of image forming apparatus using the non-magnetic single-component toner 8 of the third embodiment, there is a full color printer as shown in FIG. 8 capable of conducing not only the non-contact developing process as shown in FIG. 5, similarly to the first and second embodiments, but also the contact developing process as shown in FIG. 6. The components of the image forming apparatus are manufactured in the same manner as mentioned above.

(Image Forming Tests and the Results of the Tests)

Full-color image forming tests were conducted by using the full color printers both in the non-contact developing process and the contact developing process.

Now, image forming tests by using the image forming apparatuses according to the non-contact developing process and the contact developing process will be explained below.

As conditions for forming images during the image forming process, the peripheral velocity of the organic photoreceptor 1 was set to 180 mm/sec. and the peripheral velocity ratio between the organic photoreceptor 1 and the development roller 11 was set to 2. The regulating blade 7 was pressed against the development roller 11 with a linear load of 33 gf/cm in such a manner as to make a toner layer on the development roller 11 into a uniform thickness of 15 μm and to regulate such that the number of layers made up of toner particles becomes 2.

The dark potential of the organic photoreceptor 1 was set to −600 V, the light potential thereof was set to −100 V. In the non-contact developing process, the developing gap was set to 210 μm by using gap rollers, the DC developing bias supplied by a power source (not shown) was set to −200 V, and the AC developing bias to be superimposed on the DC was set to have a frequency of 2.5 kHz and a P—P voltage of 1500 V. Further, the development roller 11 and the supply roller 6 are set to have the same potential. In case of the contact developing process, the development was conducted with a DC developing bias of −200 V.

At a primary transfer portion T1, a voltage of +300 V was applied to a primary transfer roller (corresponding to a driven roller 35. Voltage was applied via an electrode roller) on the back side corresponding to the transfer roller 5 in FIG. 5. The pressing load onto the photoreceptor 1 of the intermediate transfer belt 36 by the primary transfer roller was set to 33 gf/cm.

An electrostatic latent image on the organic photoreceptor 1 was developed with non-magnetic single-component toner 8 carried by the development roller 11 according to non-contact developing (jumping developing) method so as to form a toner image. The developed toner image on the photoreceptor 1 was transferred to the intermediate transfer belt 36. The toner image transferred to the intermediate transfer belt 36 was transferred to a plain paper S with a transfer voltage +800 V at a secondary transfer portion and was fixed by a heat roller of a fixing device 60.

(Non-magnetic Single-Component Toners Used in Image Forming Tests)

Non-magnetic single-component toners 8 of Example 14 and Example 15 used in image forming tests were emulsion polymerized toners.

Mother particles of cyan toner were obtained in the same manner as the emulsion polymerized toner of Example 1 of the non-magnetic single-component toner 8 of the aforementioned first embodiment. The obtained mother particles had a mean particle diameter ($D_{50}$), as 50% particle diameter based on the number, of 6.8 μm, a degree of circularity of 0.98, and a work function of 5.57 eV.

To the mother particles of cyan toner, small-particle vapor-phase silica as a fluidity improving agent which was negatively chargeable hydrophobic silica having a mean primary particle diameter of about 12 nm was mixed in an amount of 0.8% by weight, large-particle vapor-phase silica which was negatively chargeable hydrophobic silica having a mean primary particle diameter of about 40 nm was mixed in an amount of 0.5% by weight, rutile/anatase type titanium oxide, of which mixed crystal ratio was 10% by weight of rutile type titanium oxide and 90% by weight of anatase type titanium oxide and which was treated with a silane coupling agent to have hydrophobic property, (degree of hydrophobic: 58%, specific surface: 150 $m^2/g$) was added in an amount of 0.2% by weight, 0.5% by weight, 1.0% by weight, or 2.0% by weight. In this manner, each cyan toner 8 as the polymerized toner of the third embodiment was made.

As results of measurement, the work function of a cyan toner 8 of a case of 0.2% by weight of the rutile/anatase type titanium oxide was 5.53 eV, the work function of a cyan toner 8 of a case of 0.5% by weight of the rutile/anatase type titanium oxide was 5.56 eV, the work function of a cyan toner 8 of a case of 1.0% by weight of the rutile/anatase type titanium oxide was 5.57 eV, and the work function of a cyan toner 8 of a case of 2.0% by weight of the rutile/anatase type titanium oxide was 5.58 eV.

In addition, cyan toners of Example 15 were also made by mixing only rutile/anatase type titanium oxide into the mother particles of cyan toner in the same manner without mixing negative chargeable hydrophobic silica as a fluidity improving agent. In this case, the work function of a toner of a case of 0.2% by weight of the rutile/anatase type titanium oxide was 5.40 eV, the work function of a cyan toner 8 of a case of 0.5% by weight of the rutile/anatase type titanium oxide was 5.46 eV, the work function of a toner of a case of 1.0% by weight of the rutile/anatase type titanium oxide was 5.50 eV, and the work function of a toner of a case of 2.0% by weight of the rutile/anatase type titanium oxide was 5.54 eV.

Therefore, the work functions in the image forming tests using the emulsion polymerized toners 8 of the third embodiment are set to satisfy the following relation:

Work function of Development roller 11<Work function of Intermediate transfer belt 36<Work function of Organic photoreceptor 1<Work function of Cyan toner 8≈Work function of Toner mother particles 8*a*<Work function of Rutile/anatase type titanium oxide. In the image forming apparatuses using the negatively chargeable toners 8 of the third embodiment may also be set to satisfy the following relation:

Work function of Development roller 11<Work function of Intermediate transfer belt 36<Work function of Organic photoreceptor 1<Work function of Cyan toner 8≈Work function of Toner mother particles 8*a*≈Work function of Rutile/anatase type titanium oxide. The above relations of work functions are not limited to the image forming tests and may be used for setting of the image forming apparatus of the present invention.

As comparative examples, a toner (1) of Comparative Example 12 was prepared by mixing 1.3% by weight of small-particle negatively chargeable hydrophobic silica having a mean primary particle diameter of about 7 nm and 0.5% by weight of the same rutil/anatase type titanium oxide as mentioned above to the mother particles of cyan toner, and a toner (2) of Comparative Example 13 was prepared by mixing 1.3% by weight of the same large-particle vapor-phase silica and 0.5% by weight of the same rutil/anatase type titanium oxide as mentioned above to the mother particles of cyan toner. The work functions of the toners (1) and (2) of Comparative Examples 12, 13 were 5.52 eV and 5.49 eV, respectively.

With these cyan toners 8, images were formed by the full color printer as shown in FIG. 8 according to the non-contact developing (jumping developing) process (with development gap L=210 μm) and the contact developing process (with contact pressure between the organic photoreceptor 1 and the development roller 11 of 20 gf/cm) to achieve the solid image density about 1.1. The mean charge amounts q/m (μc/g) of respective toners on the development rollers 11 and the amounts of positively charged toner (% by weight= wt %) after image forming were measured and are shown in Tables. These results for the toner of Example 14 containing silicas are the same as the results shown in Table 5. The results for the toners of Example 15 without containing silica, Comparative Example 12 and Comparative Example 13 are shown in Table 12 and Table 13, respectively. The OD values of fog toner, the OD values of reverse transfer toner, and the differences in density of solid image were also measured and are shown in Table 14, Table 15, and Table 16. The charge distribution characteristic of toner was measured by using an E-SPART analyzer EST-3 available from Hosokawa Micron Corporation.

(A) Results of Charging Property Tests of Toners

TABLE 12

| Rutile/anatase type titanium oxide (wt. %) | Mean charge amount q/m (μc/g) | Amount of positively charged toner (wt. %) |
|---|---|---|
| 0 | — | — |
| 0.2 | −7.41 | 39.14 |
| 0.5 | −9.32 | 13.17 |
| 1.0 | −4.26 | 35.22 |
| 2.0 | −1.86 | 31.83 |

TABLE 13

| Comparative Examples | Mean charge amount q/m (μc/g) | Amount of positively charged toner (wt. %) |
|---|---|---|
| Toner (1) | −11.56 | 10.35 |
| Toner (2) | −10.45 | 5.38 |

As apparent from Table 5, the mean charge amount q/m was −17.96 μc/g of the toner containing 0 wt % of, i.e. without containing, hydrophobic rutile/anatase type titanium oxide and the amount of positively charged toner of the same was 10.40 wt %. The mean charge amount q/m of the toner containing 0.2 wt % of hydrophobic rutile/anatase type titanium oxide was −15.95 μc/g and the amount of positively charged toner of the same was 5.83 wt %. Further, the mean charge amount q/m of the toner containing 0.5 wt % of hydrophobic rutile/anatase type titanium oxide was −21.86 μc/g and the amount of positively charged toner of the same was 3.70 wt %.

Furthermore, the mean charge amount q/m of the toner containing 1.0 wt % of hydrophobic rutile/anatase type titanium oxide was −20.71 μc/g and the amount of positively charged toner of the same was 2.10 wt %. Moreover, the mean charge amount q/m of the toner containing 2.0 wt % of hydrophobic rutile/anatase type titanium oxide was −15.40 μc/g and the amount of positively charged toner of the same was 5.61 wt %.

As apparent from Table 12, as for the toners obtained without mixing silica into the mother particles of cyan toner, the mean charge amount q/m of the toner containing 0.2 wt % of hydrophobic rutile/anatase type titanium oxide was −7.41 μc/g and the amount of positively charged toner of the same was 39.14 wt %. Further, the mean charge amount q/m of the toner containing 0.5 wt % of hydrophobic rutile/anatase type titanium oxide was −9.32 μc/g and the amount of positively charged toner of the same was 13.17 wt %.

Furthermore, the mean charge amount q/m of the toner containing 1.0 wt % of hydrophobic rutile/anatase type titanium oxide was −4.26 μc/g and the amount of positively charged toner of the same was 35.22 wt %. Moreover, the mean charge amount q/m of the toner containing 2.0 wt % of hydrophobic rutile/anatase type titanium oxide was −1.86 μc/g and the amount of positively charged toner of the same was 31.83 wt %. As apparent from Table 13, the mean charge amount q/m of the toner (1) of Comparative Example 12 was −11.56 μc/g and the amount of positively charged toner of the same was 10.35 wt %. Further, the mean charge amount q/m of the toner (2) of Comparative Example 12 was −10.45 μc/g and the amount of positively charged toner of the same was 5.83 wt %.

According to the results of the tests shown in Table 5, the amount of positively charged toner i.e. inversely charged toner can be reduced with little change in the mean charge amount by adding hydrophobic rutile/anatase type titanium oxide.

It was found that when only hydrophobic rutile/anatase type titanium oxide was mixed without mixing hydrophobic silica into the mother particles of cyan toner, the negative charge amount is increased according to the increase in adding amount up to 0.5 wt. % and the negative charge amount is decreased with the amount exceeding 0.5 wt. %. It was also found that the minimum positive charge amount as the minimum amount of inversely charged toner i.e. 13.17 wt. % was achieved when the adding amount was 0.5 wt. % and, after that, the amount of positively charged toner was increased.

In the toner (1) of Comparative Example 12 containing 1.3 wt % of hydrophobic silica having a mean primary particle diameter of about 7 nm and 0.5 wt % of hydrophobic rutile/anatase type titanium oxide and the toner (2) of Comparative Example 13 containing 1.3 wt % of hydrophobic silica having a mean primary particle diameter of about 40 nm and 0.5 wt % of hydrophobic rutile/anatase type titanium oxide, the mean negative charge amount was not so great. In addition, it was found that the amount of positively charged toner as the amount of inversely charged toner was increased as compared to the toner of the present invention in which the combination of fluidity improving agents was added in the same amount (the toner in case of 0.5 wt % shown in Table 5).

(B) Test Results for OD Value of Fog Toner, OD Value of Reverse Transfer Toner, and Differences in Density of Solid Image Portion

TABLE 14

| | Non-contact developing process | | | Contact developing process | | |
|---|---|---|---|---|---|---|
| Adding amounts of rutile/anatase type titanium oxide (wt. %) | OD value of fog toner | OD value of reverse transfer toner | Difference in density of solid image portion | OD value of fog toner | OD value of reverse transfer toner | Difference in density of solid image portion |
| 0 | 0.013 | 0.083 | 0.130 | 0.027 | 0.080 | 0.123 |
| 0.2 | 0.004 | 0.023 | 0.097 | 0.009 | 0.025 | 0.096 |
| 0.5 | 0.001 | 0.012 | 0.054 | 0.008 | 0.010 | 0.057 |
| 1.0 | 0.000 | 0.009 | 0.053 | 0.008 | 0.009 | 0.050 |
| 2.0 | 0.002 | 0.001 | 0.050 | 0.010 | 0.003 | 0.051 |

TABLE 15

| | Non-contact developing process | | | Contact developing process | | |
|---|---|---|---|---|---|---|
| Adding amounts of rutile/anatase type titanium oxide (wt. %) | OD value of fog toner | OD value of reverse transfer toner | Difference in density of solid image portion | OD value of fog toner | OD value of reverse transfer toner | Difference in density of solid image portion |
| 0 | — | — | — | 0.327 | 0.037 | — |
| 0.2 | 0.299 | 0.039 | 0.158 | 0.356 | 0.031 | 0.155 |
| 0.5 | 0.276 | 0.058 | 0.170 | 0.477 | 0.049 | 0.158 |
| 1.0 | 0.260 | 0.161 | 0.075 | 0.517 | 0.166 | 0.060 |
| 2.0 | 0.222 | 0.183 | 0.058 | 0.382 | 0.208 | 0.018 |

TABLE 16

| | Non-contact development | | | Contact development | | |
|---|---|---|---|---|---|---|
| Comparative Examples | OD value of fog toner | OD value of reverse transfer toner | Difference in density of solid image portion | OD value of fog toner | OD value of reverse transfer toner | Difference in density of solid image portion |
| Toner (1) | 0.009 | 0.019 | 0.168 | 0.143 | 0.008 | 0.213 |
| Toner (2) | 0.007 | 0.022 | 0.140 | 0.095 | 0.009 | 0.100 |

As apparent from Table 14, in the non-contact developing process with the toner containing 0 wt % of, i.e. without containing, hydrophobic rutile/anatase type titanium oxide, the OD value of fog toner was 0.013, the OD value of reverse transfer toner was 0.083, and the difference in density of solid image portions was 0.130.

With the toner containing 0.2 wt % of hydrophobic rutile/anatase type titanium oxide, the OD value of fog toner was 0.004, the OD value of reverse transfer toner was 0.023, and the difference in density of solid image portions was 0.097. With the toner containing 0.5 wt % of hydrophobic rutile/anatase type titanium oxide, the OD value of fog toner was 0.001, the OD value of reverse transfer toner was 0.012, and the difference in density of solid image portions was 0.054.

Further, with the toner containing 1.0 wt % of hydrophobic rutile/anatase type titanium oxide, the OD value of fog toner was 0.000, the OD value of reverse transfer toner was 0.009, and the difference in density of solid image portions was 0.053. With the toner containing 2.0 wt % of hydrophobic rutile/anatase type titanium oxide, the OD value of fog toner was 0.002, the OD value of reverse transfer toner was 0.001, and the difference in density of solid image portions was 0.050.

As apparent from Table 15, in the non-contact developing process, image forming test was not conducted, i.e. toner image was not formed, with the toner containing 0 wt % of, i.e. without containing, hydrophobic rutile/anatase type titanium oxide because it is impossible to form a uniform toner layer with this toner. However, image forming test was conducted with the other toners. With the toner containing 0.2 wt % of hydrophobic rutile/anatase type titanium oxide, the OD value of fog toner was 0.299, the OD value of reverse transfer toner was 0.039, and the difference in density of solid image portions was 0.158.

Further, with the toner containing 0.5 wt % of hydrophobic rutile/anatase type titanium oxide, the OD value of fog toner was 0.276, the OD value of reverse transfer toner was 0.058, and the difference in density of solid image portions was 0.170. With the toner containing 1.0 wt % of hydrophobic rutile/anatase type titanium oxide, the OD value of fog toner was 0.260, the OD value of reverse transfer toner was 0.161, and the difference in density of solid image portions was 0.075.

Furthermore, with the toner containing 2.0 wt % of hydrophobic rutile/anatase type titanium oxide, the OD value of fog toner was 0.222, the OD value of reverse transfer toner was 0.183, and the difference in density of solid image portions was 0.058. As apparent from Table 16, with the toner (1) of Comparative Example 12, the OD value of fog toner was 0.009, the OD value of reverse transfer toner was 0.019, and the difference in density of solid image portions was 0.168. With the toner (2) of Comparative Example 13, the OD value of fog toner was 0.007, the OD value of reverse transfer toner was 0.022, and the difference in density of solid image portions was 0.140.

On the other hand, in the contact developing process with the toner containing 0 wt % of, i.e. without containing, hydrophobic rutile/anatase type titanium oxide, the OD value of fog toner was 0.027, the OD value of reverse transfer toner was 0.080, and the difference in density of solid image portions was 0.123.

With the toner containing 0.2 wt % of hydrophobic rutile/anatase type titanium oxide, the OD value of fog toner was 0.009, the OD value of reverse transfer toner was 0.025, and the difference in density of solid image portions was 0.096. With the toner containing 0.5 wt % of hydrophobic rutile/anatase type titanium oxide, the OD value of fog toner was 0.008, the OD value of reverse transfer toner was 0.010, and the difference in density of solid image portions was 0.057.

Further, with the toner containing 1.0 wt % of hydrophobic rutile/anatase type titanium oxide, the OD value of fog toner was 0.008, the OD value of reverse transfer toner was 0.009, and the difference in density of solid image portions was 0.050. With the toner containing 2.0 wt % of hydrophobic rutile/anatase type titanium oxide, the OD value of fog toner was 0.010, the OD value of reverse transfer toner was 0.003, and the difference in density of solid image portions was 0.051.

Though a uniform toner layer was not formed with the toner containing 0 wt % of, i.e. without containing, hydrophobic rutile/anatase type titanium oxide, an image was formed in the contact developing process. As a result of this, the OD value of fog toner was 0.327 and the OD value of reverse transfer toner was 0.037. The difference in density of solid image portions was not calculated because of too poor uniformity.

With the toner containing 0.2 wt % of hydrophobic rutile/anatase type titanium oxide, the OD value of fog toner was 0.356, the OD value of reverse transfer toner was 0.031, and the difference in density of solid image portions was 0.155. With the toner containing 0.5 wt % of hydrophobic rutile/anatase type titanium oxide, the OD value of fog toner was 0.477, the OD value of reverse transfer toner was 0.049, and the difference in density of solid image portions was 0.158.

Further, with the toner containing 1.0 wt % of hydrophobic rutile/anatase type titanium oxide, the OD value of fog toner was 0.517, the OD value of reverse transfer toner was 0.166, and the difference in density of solid image portions was 0.060. With the toner containing 2.0 wt % of hydrophobic rutile/anatase type titanium oxide, the OD value of fog toner was 0.382, the OD value of reverse transfer toner was 0.208, and the difference in density of solid image portions was 0.018.

As apparent from Table 16, with the toner (1) of the comparative example, the OD value of fog toner was 0.143, the OD value of reverse transfer toner was 0.008, and the difference in density of solid image portions was 0.213. With the toner (2) of the comparative example, the OD value of fog toner was 0.095, the OD value of reverse transfer toner was 0.009, and the difference in density of solid image portions was 0.100.

From the test results, it was found that, in either of the non-contact developing process and the contact developing process, the fog toner and the reverse transfer toner were reduced and the difference in density was reduced so as to obtain a uniform solid image by adding small-particle hydrophobic silica and large-particle hydrophobic silica and hydrophobic rutile/anatase type titanium oxide fine particles.

As apparent from Table 14, it is found that, especially in the non-contact developing process, the fog toner and the reverse transfer toner were effectively reduced and the difference in density was further reduced so as to effectively obtain a solid image of uniform density by adding small-particle hydrophobic silica and large-particle hydrophobic silica and hydrophobic rutile/anatase type titanium oxide fine particles as external additives. The same tests were conducted with hydrophobic silicas having a mean primary particle diameter of about 7 nm and a mean particle diameter of about 16 nm, respectively, instead of the aforementioned small-particle hydrophobic silica. As results of the tests, the same effects were achieved.

It should be noted that in the non-magnetic single-component toner 8 of the third embodiment, there is no limitation to use two kinds of silicas, i.e. small-particle silica and large-particle silica. Only one kind of silica may be used. However, in order to effectively reduce the fog toner and the reverse transfer toner and effectively obtain a solid image of further uniform density, it is preferable to use two silicas of different sizes and hydrophobic rutile/anatase type titanium oxide.

Figure 14:
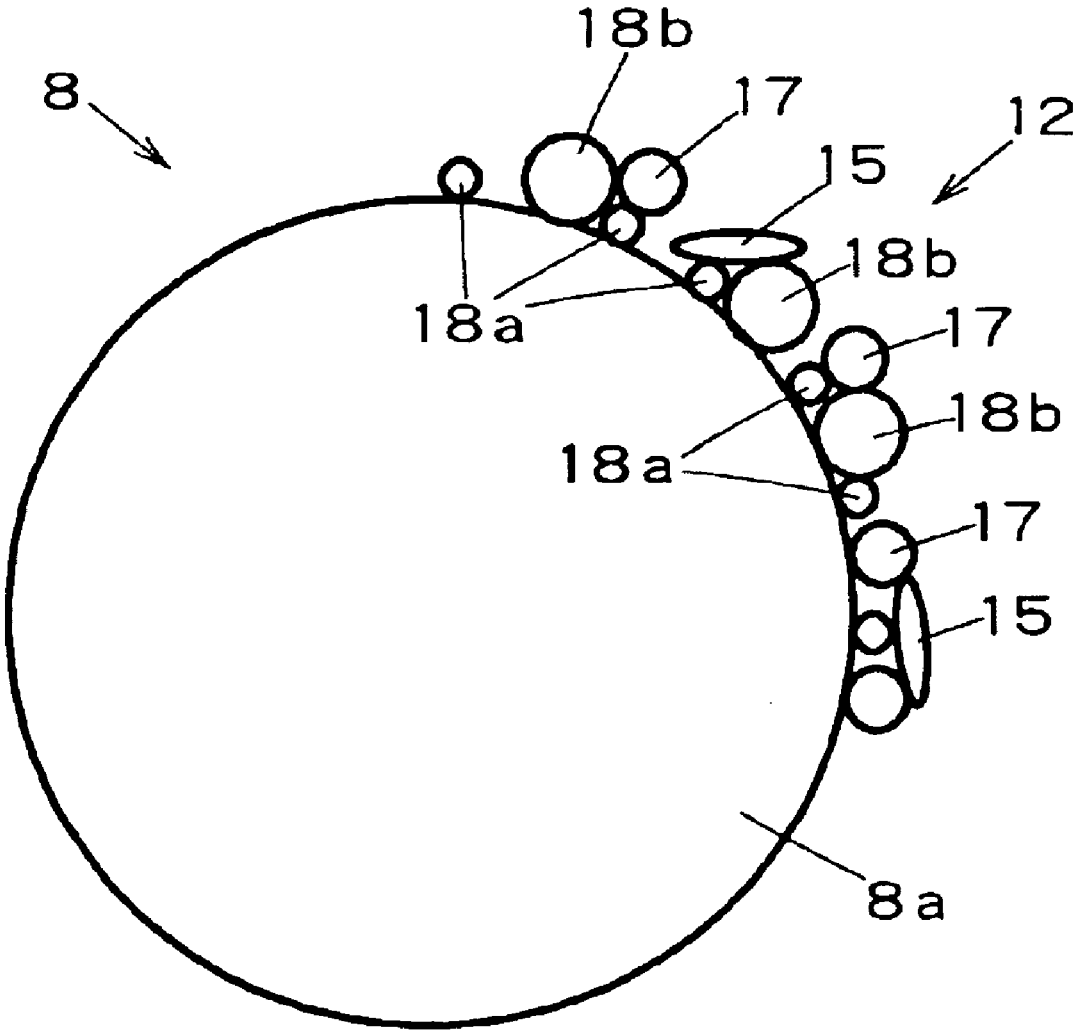
FIG. 14 is an illustration schematically showing still another embodiment of non-magnetic single-component toner according to the present invention.

Hereinafter, a fourth embodiment of non-magnetic single-component toner of the present invention will be described. FIG. 14 is an illustration of schematically showing the fourth embodiment.

As shown in FIG. 14, a negatively chargeable toner 8 as the non-magnetic single-component toner of the fourth embodiment comprises toner mother particles 8*a* and external additives 12 externally adhering to the toner mother particles 8*a* as shown in FIG. 14. As the external additives 12, metallic oxide fine particles 17, a hydrophobic rutile/anatase type titanium oxide ($TiO_2$) 15 having a work function larger than that of the toner mother particles 8*a* and that of the metallic oxide fine particles 17, a hydrophobic negatively chargeable silicon dioxide (negatively chargeable silica ($SiO_2$)) 18 a having a mean primary particle diameter smaller than that of the metallic oxide fine particles 17 and that of the rutile/anatase type titanium oxide 15 and having a work function smaller than that of the toner mother particles 8*a*, that of the metallic oxide fine particles, and that of the rutile/anatase type titanium oxide 15, and a hydrophobic negatively chargeable silicon dioxide (negatively chargeable silica ($SiO_2$) 18*b* having a mean primary particle diameter larger than that of the metallic oxide fine particles 17 and that of the rutile/anatase type titanium oxide 15 are used.

Since the work function of the hydrophobic negatively chargeable silicas 18*a*, 18*b* is smaller than that of the toner mother particle 8*a*, that of the metallic oxide fine particles 17, and that of the rutile/anatase type titanium oxide 15, the negatively chargeable silcas 18*a*, 18*b* adhere to the toner mother particles 8*a* and the metallic oxide fine particles 17 and the rutile/anatase type titanium oxide 15, of which mean primary particle diameters are larger than that of the negatively chargeable silica 18*a*, adhere to the toner mother particles 8*a* in the state being in contact with the negatively chargeable silica 18*a*.

In the negatively chargeable toner 8 of the fourth embodiment, the negative charging property is imparted to the toner mother particles 8*a* by the hydrophobic negatively chargeable silicas 18*a*, 18*b* having work function smaller than the work function of the toner mother particles 8*a*. On the other hand, by mixing and using hydrophobic rutile/anatase type titanium oxide particles 15 having work function larger than or equal to the work function of the toner mother particles 8*a* (the difference in work function therebetween is in a range of 0.25 eV or less), the toner mother particles 8*a* is prevented from being excessively charged and the fluidity of the toner is improved so as to prevent the occurrence of flush due to adhesion of negatively charged toner particles having relatively small negative (−) polarity onto boundaries of a line image. In addition, by using alumina-silica combined oxide fine particles as the metallic oxide fine particles 17, the cohesive property of toner is improved so as to prevent the occurrence of hollow defects due to failing to transfer toner particles to a middle portion of a line image.

The toner mother particles 8*a* used in the negatively chargeable toner 8 of the fourth embodiment may be prepared by the pulverization method or the polymerization method similarly to the first embodiment. In case of full color toner, the toner mother particles are preferably prepared by the polymerization method.

First, a negatively chargeable toner 8 (pulverized toner 8) using toner mother particles 8*a* prepared by the pulverization method will be explained. The toner mother particles 8*a* prepared by the pulverization method were obtained in the same manner as the aforementioned toner mother particles 8*a* prepared by the pulverization method. The obtained pulverized toner mother particles had a mean particle diameter ($D_{50}$), as 50% particle diameter based on the number, of 9 $\mu$m or less, preferably from 4.5 $\mu$m to 8 $\mu$m. Accordingly, the particle diameter of the pulverized toner mother particles 8*a* should be relatively small. Since the hydrophobic negatively chargeable silicas 18*a*, 18*b*, the hydrophobic metallic oxide fine particles 17, and the hydrophobic rutile/anatase type titanium oxide 15 are used together with the small-diameter toner mother particles 8*a*, the amount of the hydrophobic negatively chargeable silica is reduced as compared to the amount of hydrophobic silica of a conventional case in which silica particles are used alone, thereby improving the fixing property.

In the pulverized toner 8 of the fourth embodiment, the total amount (weight) of external additives 12 is set to 0.5% by weight or more and 4.0% by weight or less, preferably in a range from 1.0% by weight to 3.5% by weight relative to the weight of toner mother particles 8*a*. Therefore, when used as full color toners, the pulverized toner 8 can exhibit its effect of preventing the production of reverse transfer toner particles. If the external additives 12 are added in a total amount of 4.0% by weight or more, external additives may be liberated from the surfaces of mother particles and/or the fixing property of the toner may be degraded.

Now, a negatively chargeable toner 8 (polymerized toner 8) using toner mother particles 8*a* prepared by the polymerization method will be explained. The toner mother particles 8*a* prepared by the polymerization method were obtained in the same manner as the aforementioned toner mother particles 8*a* prepared by the polymerization method.

The polymerized toner of the fourth embodiment thus obtained had a mean particle diameter ($D_{50}$), as 50% particle diameter based on the number, of 9 $\mu$m or less, preferably from 4.5 $\mu$m to 8 $\mu$m. Accordingly, the particle diameter of the polymerized toner 8 should be relatively small. Since the hydrophobic negatively chargeable silicas 18*a*, 18*b*, the hydrophobic metallic oxide fine particles 17, and the hydrophobic rutile/anatase type titanium oxide 15 are used as external additives together with the small-diameter toner 8, the amount of the hydrophobic negatively chargeable silicas 18*a*, 18*b* is reduced as compared to the amount of hydrophobic negatively chargeable silica of a conventional case in which silica particles are used alone, thereby improving the fixing property.

In the polymerized toner 8 of the fourth embodiment, the total amount (weight) of external additives 12 is set to 0.5% by weight or more and 4.0% by weight or less, preferably in a range from 1.0% by weight to 3.5% by weight relative to the weight of toner mother particles 8*a* similarly to the aforementioned pulverized toner. Therefore, when used as full color toners, the polymerized toner 8 can exhibit its effect of preventing the production of reverse transfer toner particles. If the external additives are added in a total amount of 4.0% by weight or more, external additives may be scattered from the surfaces of mother particles and/or the fixing property of the toner may be degraded.

The metallic oxide fine particles 17 as one of the external additives 12 are used for stabilizing the charging property and improving the fluidity of dry toner. As the metallic oxide fine particles 17, alumina-silica combined oxide fine particles, silicon dioxide, or aluminum oxide (Al) may be employed.

The metallic oxide fine particles 17 are preferably used after the surfaces thereof are treated to have hydrophobic property.

In this case, the alumina-silica combined oxide fine particles 17 may be prepared by the production method of a silicon-aluminum combined oxide powder disclosed in Japanese Patent No. 2533067. The alumina-silica combined oxide fine particles have two work functions. The difference between the work functions of the metallic oxide fine particles 17 is greater than the different between the work functions of mixed oxide particles obtained by just mixing alumina and silica. Therefore, it is known that the metallic oxide fine particles 17 when used as an external additive of the toner mother particles 8*a* functions to impart triboelectric charging sites both of the positive polarity and of the negative polarity.

The contact of the toner mother particles 8*a* to triboelectric charging sites of the positive polarity of the alumina-silica combined oxide fine particles insures the negative charging of the toner particles as compared to the mixed oxide particles obtained by just mixing alumina and silica, thereby reducing the amount of positively charged toner particles. On the other hand, the contact of the toner mother particles 8*a* to triboelectric charging sites of the negative polarity of the alumina-silica combined oxide fine particles prevents the toner particle from being excessively negatively charged, thereby providing stable negatively charged toner.

The rutile/anatase type titanium oxide 15 consists of rutile type titanium oxide and anatase type titanium oxide which are mixed at a predetermined mixed crystal ratio and may be obtained by a production method disclosed in Japanese Patent Unexamined Publication No. 2000-128534. The hydrophobic rutile/anatase type titanium oxide particles 15 are each formed in a spindle shape of which major axial diameter is in a range from 0.02 μm to 0.10 μm and the ratio of the major axial diameter to the minor axial diameter is set to be 2 to 8.

By using the rutile/anatase type titanium oxide 15 having a work function larger than that of the hydrophobic negatively chargeable silicas 18*a*, 18*b* together with the negatively chargeable silicas 18*a*, 18*b*, the charge can be adjusted by releasing charges from the toner mother particles 8*a*, thereby preventing the excessive charging. That is, if the negatively chargeable silicas 18*a*, 18*b* are added too much, the toner should be excessively negatively charged, thus reducing the image density. The use of the rutile/anatase type titanium oxide 15 together with the negatively chargeable silicas 18*a*, 18*b* prevents the toner mother particles 8*a* from excessively negatively charged, thereby providing excellent negative charging of toner.

The particles of the external additives 12 are preferably processed by a hydrophobic treatment with a silane coupling agent, a titanate coupling agent, a higher fatty, silicone oil. Specifically, the same hydrophobic treatment as the first embodiment may be used.

In the negatively chargeable toner 8 of the fourth embodiment, the adding amount of the metallic oxide fine particles 17 is in a range form 0.1% by weight to 3% by weight, preferably from 0.2% by weight to 2% by weight relative to the toner mother particles 8*a*. The adding amount of the rutile/anatase type titanium oxide 15 is in a range form 0.1% by weight to 2% by weight, preferably from 0.2% by weight to 1.5% by weight relative to the toner mother particles 8*a*. The total adding amount of all of the external additives 12 is in a range from 0.5% by weight to 5% by weight, preferably from 1% by weight to 4% by weight relative to the toner mother particles 8*a*.

In the negatively chargeable toner 8 of the fourth embodiment, the work function of the toner mother particles 8*a* where the metallic oxide fine particles 17 are externally adhere to the toner mother particles 8*a* is in a range from 5.3 eV to 5.70 eV, preferably from 5.35 eV to 5.65 eV.

The toner mother particles 8*a* and the external additives 12 are entered into a known mixing device such as a Henschel mixer mentioned above, a V-shape blender, a counter-flow mixer, a high-speed mixer, a Cyclomix, and an axial mixer, in which the external additives 12 are treated to adhere to the toner mother particles 8*a*, thereby obtaining the negatively chargeable toner 8 of the fourth embodiment.

The work function of the negatively chargeable toner 8 of the fourth embodiment thus obtained is in a range from 5.3 eV to 5.7 eV, preferably from 5.35 eV to 5.65 eV. By setting the work function of the negatively chargeable toner 8 to be larger than the work function of the surface of the photoreceptor, the fog toner is reduced and the transfer efficiency is improved. However, when the work function of the negatively chargeable toner 8 is set to be too large relative to the work function of the surface of the toner image carrier, a phenomenon called "excessive charging" that the charge becomes too high during a toner layer on the development roller is regulated by the toner regulating member may be caused. However, by setting the work function according to the present invention, the phenomenon called "excessive charging" can be prevented.

The negatively chargeable toner 8 of the fourth embodiment, in case of pulverized toner, is set to have a mean particle diameter based on the number from 5 μm to 10 μm, preferably from 6 μm to 9 μm, and in case of polymerized toner, is set to have a mean particle diameter ($D_{50}$) of 8 μm or less, preferably from 4.5 μm to 8 μm in which the mean particle diameter ($D_{50}$) is 50% particle diameter based on the number and has a particle size distribution in which particles having a particle diameter of 3 μm or less occupy 10% or less, preferably 5% or less based on the number.

In either of the pulverization method and the polymerization method, toner having small particle diameter has a problem that the charge of the toner becomes too large in the initial stage because the adding amount of silica particles should be too much in case of such a toner having small particle size. In addition, as printing proceeds, the effective surface areas of the silica particles are reduced due to embedment and/or scattering of silica particles. This reduces the charge of the toner, thus increasing the variation of image density and increasing the amount of fog toner. This means the increase of the toner consumption. Therefore, such a toner having small particle size is hardly used as ordinary used toners. However, by the use of the metallic oxide fine particles 17 having a broad particle size distribution as one of the external additives 12, external additive particles are prevented from being embedded into mother particles, thereby proving a negatively chargeable toner which is stable over the entire life for printing.

In either of the pulverization method and the polymerization method, the desirable degree of circularity (sphericity) of the negatively chargeable toner 8 of the fourth embodiment is 0.94 or more, preferably 0.95 or more. In case of the degree of circularity up to 0.97, a cleaning blade is preferably used. In case of the higher degree, a brush cleaning is preferably used with the cleaning blade. By setting the degree of circularity (sphericity) to 0.94 or more, the transfer efficiency is improved.

In the negatively chargeable toner 8 of the fourth embodiment structured as mentioned above, in either case of the pulverized toner and the polymerized toner, the hydrophobic negatively chargeable silicas 18*a*, 18*b* adhere to the toner mother particles 8*a*. The hydrophobic metallic oxide fine particles 17 and the hydrophobic rutile/anatase type titanium oxide 15, of which work function is larger than the work function of the hydrophobic negatively chargeable silicas 18*a*, 18*b*, are fixed to the negatively chargeable silicas 18*a*, 18*b* because of the respective differences in work function so that these external additives hardly liberated from the toner mother particles 8*a*. Therefore, the surface of each toner mother particle 8*a* can be covered evenly with the hydrophobic metallic oxide fine particles 17, the hydrophobic utile/anatase type titanium oxide 15, and the hydrophobic negatively chargeable silicas 18*a*, 18*b*.

Therefore, the charge controlling function of relatively low electric resistance (for example, in a range from $1\times10^{9}$ Ωcm to $5\times10^{11}$ Ωcm) owned by the rutile/anatase type titanium oxide 15 can be further effectively used and the cohesive function owned by the metallic oxide fine particles 17 can be also further effectively used.

That is, the negative charging function and the fluidity improving function as the characteristics owned by the hydrophobic negatively chargeable silica 18*a*, 18*a*, the function of preventing excessive negative charge and the fluidity improving function as the characteristics owned by the hydrophobic rutile/anatase type titanium oxide 15, the characteristics owned by the metallic oxide fine particles 17 (for example, the cohesive property improving function in case of using alumina-silica combined oxide fine particles as the metallic oxide fine particles 17) are combined and the combined function is imparted to the mother particles 8*a*.

Because of this combined function, the reduction in fluidity of the negatively chargeable toner 8 can be prevented and excessive negative charge can be prevented, thus providing excellent negative charging property. As a result, the occurrence of reverse transfer toner and fog toner can be effectively inhibited. In addition, the fluidity of the toner is improved, thereby preventing the occurrence of flush on boundaries of a line image and thus improving the sharpness of obtained images. When alumina-silica combined oxide fine particles are used as the metallic oxide fine particles 17, the cohesive property of toner is improved so as to prevent the occurrence of hollow defects on a middle portion of a line image.

Therefore, the negatively chargeable toner 8 has stably negative charging for a longer period of time and can provide stable image quality having improved sharpness without producing hollow defects even for successive printing.

The negatively chargeable toner 8 of the fourth embodiment can be used in either of an image forming apparatus of non-contact single-component developing type as shown in FIG. 5, an image forming apparatus of contact single-component developing type as shown in FIG. 6, and a full color printer of a four cycle type capable of conducting the non-contact developing process and the contact developing process as shown in FIG. 8. As the full color image forming apparatus, there are two types i.e. a tandem type and a rotary type as mentioned above.

Image forming tests as described later were basically conducted by using a printer of a four cycle type, as shown in FIG. 8, comprising developing devices for four colors and one latent image carrier according to the non-contact developing process. Image forming tests were also conducted by using a full color printer as shown in FIG. 8 according to the contact developing process.

Now, examples of the negatively chargeable toner of the fourth embodiment will be explained. Among the examples, negatively chargeable toners (1) through (4) of the fourth embodiment were prepared by the polymerization method and negatively chargeable toners (5) through (8) of the fourth embodiment were prepared by the pulverization method.

[Production Example of Negatively Chargeable Toner (1)]

Mother particles of cyan toner were obtained in the same manner as the emulsion polymerized toner 8 of the aforementioned first embodiment.

The obtained mother particles for cyan toner were measured about the mean particle diameter and the degree of circularity thereof by the aforementioned FPIA2100 and measured about the work function thereof by the aforementioned surface analyzer AC-2. As results of measurements, the mean particle diameter was 6.8 μm, the degree of circularity of 0.98, and the work function of 5.57 eV as a result of the measurement by the surface analyzer. To the mother particles for cyan toner, as fluidity improving agents, a hydrophobic silica having a mean primary particle diameter of about 12 nm and a work function of 5.22 eV was added in an amount of 1% by weight and mixed, and a hydrophobic silica having a mean primary particle diameter of about 40 nm and a work function of 5.24 eV was added in an amount of 0.5% by weight and mixed, thereby obtaining a cyan toner (1) of the fourth embodiment. The obtained cyan toner (1) were measured by using the aforementioned apparatuses. As results of measurements, the mean particle diameter was 6.86 μm, the degree of circularity was 0.983, and the work function was 5.54 eV.

[Production Example of Negatively Chargeable Toner (2)]

A magenta toner (2) of the fourth embodiment was obtained in the same manner as the above toner except that Quinacridon was used instead of Phthalocyanine Blue as the pigment and that the temperature for improving the association and the film bonding strength of secondary particles was still kept at 90° C. The mother particles of the magenta toner (2) and the magenta toner (2) were measured about the mean particle diameter, the degree of circularity, and the work function, respectively. The toner mother particles had a mean particle diameter of 6.9 μm, a degree of circularity of 0.97, and a work function of 5.65 eV. The magenta toner (2) had a mean particle diameter of 6.96 μm, a degree of circularity of 0.975, and a work function of 5.61 eV.

[Production Example of Negatively Chargeable Toners (3) and (4)]

A yellow toner (3) of the fourth embodiment and a black toner (4) of the fourth embodiment were obtained in the same manner as the polymerization and the addition of fluid improving agents of the magenta toner (2) except that Pigment Yellow 180 or Carbon Black was used as the pigment instead of the Quinacridon. As for the yellow toner (3), the toner mother particles thereof had a mean particle diameter of 6.93 μm, a degree of circularity of 0.968, and a work function of 5.55 eV, and the yellow toner (3) itself had a mean particle diameter of 7.01 μm, a degree of circularity of 0.971, and a work function of 5.52 eV. As for the black toner (4), the toner mother particles thereof had a mean particle diameter of 6.89 μm, a degree of circularity of 0.965, and a work function of 5.49 eV, and the black toner (4) itself had a mean particle diameter of 7.08 μm, a degree of circularity of 0.975, and a work function of 5.45 eV.

[Production Example of Negatively Chargeable Toner (5)]

Per 100 parts by weight of polycondensate polyester resin (HIMER ES-801, available from Sanyo Chemical Industries, Ltd., consisting of non-crosslinkable component and crosslinkable component at a mixing rate of 45/55), 5 parts by weight of Phthalocyanine Blue as a cyan pigment, 3 parts by weight of polypropylene having a melting point of 152° C. and Mw of 4000 as a release agent, and 4 parts by weight of a metal complex compound of salicylic E-81 (available from Orient Chemical Industries, LTD.) as a charge control agent were uniformly mixed by a Henschel mixer, kneaded by a twin-shaft extruder with an internal temperature of 150° C., and then cooled. The cooled substance was roughly pulverized into pieces of 2 square mm or less and then pulverized into fine particles by a turbo mill. The fine particles were classified by a classifier of a rotary type, thereby obtaining toner mother particles for cyan toner having a mean primary particle diameter of 7.29 μm and a degree of circularity of 0.924. The measured work function of the toner mother particles was 5.39 eV.

To the obtained toner mother particles, external additives were added in the same manner as the toner (1) except that hydrophobic silica having a mean primary particle diameter of about 7 nm and a work function of 5.18 eV was added instead of the small-particle silica as one of the hydrophobic silicas and its adding amount was 0.8% by weight and that hydrophobic silica having a mean primary particle diameter of about 40 nm and a work function of 5.24 eV was added instead of the large-particle silica as the other one of the hydrophobic silicas and its adding amount was 0.5% by weight. In addition, hydrophobic alumina-silica combined oxide fine particles having a primary particle size distribution of 7 nm to 80 nm, a mean primary particle diameter of about 17 nm, a first work function of 5.18 eV, and a second work function of 5.62 eV was added in an amount of 0.5% by weight, and rutile/anatase type titanium oxide having a mean primary particle diameter of about 20 nm and a work function of 5.64 eV was added in an amount of 0.4% by weight and mixed. In this manner, a cyan toner (5) of the fourth embodiment was obtained. The cyan toner (5) had a mean primary particle diameter of about 7.35 m, a degree of circularity of 0.929, and a work function of 5.47 eV.

[Production Example of Negatively Chargeable Toners (6), (7), (8)]

According to the aforementioned production example of the cyan toner (5), a magenta toner (6) (Carmin 6B was used as a magenta pigment), an yellow toner (7) (Pigment Yellow 93 was used as an yellow pigment) of the fourth embodiment, a black toner (8) (Carbon Black was used as a black pigment) of the fourth embodiment were obtained.

As for the magenta toner (6), the mother particles thereof had a mean primary particle diameter of about 7.28 $\mu$m, a degree of circularity of 0.925, and a work function of 5.42 eV. The mean primary particle diameter and a degree of circularity of the magenta toner (6) were substantially the same as those of the cyan toner (5) and the work function of the magenta toner (6) was 5.49 eV. As for the yellow toner (7), the mother particles thereof had a mean primary particle diameter of about 7.29 $\mu$m, a degree of circularity of 0.924, and a work function of 5.55 eV. The mean primary particle diameter and a degree of circularity of the yellow toner (7) were substantially the same as those of the cyan toner (5) and the work function of the yellow toner (7) was 5.56 eV. As for the black toner (8), the mother particles thereof had a mean primary particle diameter of about 7.27 $\mu$m, a degree of circularity of 0.925, and a work function of 5.60 eV. The mean primary particle diameter and a degree of circularity of the black toner (8) were substantially the same as those of the cyan toner (5) and the work function of the black toner (8) was 5.61 eV.

(Examples of Image Forming Apparatuses According to Non-contact or Contact Developing Process)

The following image forming tests with the negatively chargeable toners 8 of the fourth embodiment were conducted by using an image forming apparatus of non-contact single-component developing type as shown in FIG. 5, an image forming apparatus of contact single-component developing type as shown in FIG. 6, and a full color printer of a four cycle type capable of conducting the non-contact developing process and the contact developing process as shown in FIG. 8.

Product examples of the respective components of the image forming apparatus used for the tests of the fourth embodiment were the same as the aforementioned examples.

Hereinafter, examples of the negatively chargeable toner 8 of the fourth embodiment will be described.

Example 16

The work functions of external additives 12 used in Example 16 are shown in Table 17. In this case, alumina-silica combined oxide fine particles were used as the metallic oxide fine particles 17 in Example 16.

TABLE 17

| External additives | Work function (eV) | Normalized photoelectron yield |
|---|---|---|
| (1) Vapor-phase silica (12 nm), treated with hexamethyldisilazane (HMDS) | 5.22 | 5.1 |
| (2) Vapor-phase silica (12 nm), treated with hexamethyldisilazane (HMDS) | 5.24 | 5.2 |
| (3) Rutile/anatase type titanium oxide (20 nm),treated with silane coupling agent | 5.64 | 8.4 |
| (4) Alumina-silica combined oxide fine particles | 5.18 | 4.6 |
| (17 mn), treated with dimethylsilane (DMS), mixed crystal ratio of 65:35 | 5.62 | 14.6 |

The alumina-silica combined oxide fine particles have a point of inflection so as to have two work functions. Therefore, the two work functions of the alumina-silica combined oxide fine particles as the external additive (4) are shown in Table 17. Because of the two work functions, the aforementioned triboelectric charging sites both of the positive polarity and of the negative polarity may be provided.

In Example 16, to the aforementioned cyan toner (1), hydrophobic alumina-silica combined oxide fine particles surface-treated with dimethylsilane (DMS) {having a bulk density of 75 g/L, a mean particle diameter 17 nm, a specific surface area of 110 $m^2$/g, and a weight mixing ratio (mixed crystal ratio) of silica 35/alumina 65} and hydrophobic rutile/anatase type titanium oxide treated with silane coupling agent (having a major axial length of 0.02 $\mu$m to 0.10 $\mu$m and a ratio of the major axial diameter to the minor axial diameter in a range from 2 to 8, a mean particle diameter of 20 nm, a specific surface area of 135 $m^2$/g, and a rutile content of 10.0%) were added at a proportion shown in Table 18 by totally 1% in weight percentage and mixed. In this manner, toners 1-(1) through 1-(6) were prepared.

For testing the charging property of each of these toners, images were formed with each toner to have a solid image density in the order of 1.1 according to the non-contact developing process schematically shown in FIG. 5 by using the full color printer as shown in FIG. 8 employing the aforementioned organic photoreceptor (OPC 1), the aforementioned development roller 11, the intermediate transfer belt 36 of the intermediate transfer device 30, and the toner regulating member 7 with a developing gap set to 220 $\mu$m (under conditions: the dark potential of the organic photoreceptor 1 was −600 V, the light potential of the organic photoreceptor 1 was −80 V, DC developing bias was −300 V, AC developing bias (P—P voltage) was 1320 V, AC frequency was 2.5 kHz). During this, the mean charge amount q/m ($\mu$c/g) of each toner on the development roller 11 and the amount of positively charged toner were measured by a charge distribution measuring system (E-SPART analyzer EST-III) available from Hosokawa Micron Corporation. The results of the measurements for the charging property are shown in Table 18.

TABLE 18

| Toners | Mixed crystal ratio of rutile/anatase type titanium oxide to alumina-silica combined oxide fine particles | Mean charge amount q/m (μc/g) | Amount of positively charged toner (c/g) |
|---|---|---|---|
| 1-(1) | 0/0 (without addition) | −18.33 | 9.87 |
| 1-(2) | 0/1.0 | −20.23 | 2.23 |
| 1-(3) | 0.25/0.75 | −18.33 | 1.50 |
| 1-(4) | 0.5/0.5 | −17.22 | 2.88 |
| 1-(5) | 0.75/0.25 | −16.10 | 3.76 |
| 1-(6) | 1.0/0 | −15.74 | 5.32 |

As apparent from the results shown in Table 18, by adding the external additive in which the rutile/anatase type titanium oxide and the alumina-silica combined oxide fine particles were mixed, the amount of positively charged toner was reduced while the mean charge amount was increased or not so increased as compared to the case not containing such a mixed external additive. It was found that the minimum amount of positively charged toner can be achieved when the mixing ratio of the rutile/anatase type titanium oxide to the alumina-silica combined oxide fine particles was 0.25 to 0.75. This result was far superior to the both cases that the rutile/anatase type titanium oxide the alumina-silica combined oxide fine particles were each used alone by 1.0 wt %.

Example 17

Image forming tests were conducted with each of the toners 1-(1) through 1-(6) used in the aforementioned Example 16 according to the non-contact developing process schematically shown in FIG. 5 and according to the contact developing process schematically shown in FIG. 6 by using the full color printer as shown in FIG. 8 employing the aforementioned organic photoreceptor (OPC 1) 1, the aforementioned development roller 11, the intermediate transfer belt 36 of the intermediate transfer device 30, and the toner regulating member 7. The tests according to the non-contact developing process were conducted under conditions that the dark potential of the organic photoreceptor 1 was −600 V, the light potential of the organic photoreceptor 1 was −80 V, the DC developing bias was −300 V, the AC developing bias (P—P voltage): 1320 V, and the AC frequency was 2.5 kHz. On the other hand, the tests according to the contact developing process were conducted under conditions that the dark potential of the organic photoreceptor 2 was −600 V, the light potential of the organic photoreceptor 2 was −80 V, the DC developing bias was −200 V, and the supply roller and the development roller were in the same potential.

The results of the image forming tests are shown in Table 19 and Table 20.

TABLE 19

| | Contact development | | | Non-contact development | | |
|---|---|---|---|---|---|---|
| Toners | OD value of solid image | OD value of fog toner | OD value of reverse transfer toner | OD value of solid image | OD value of fog toner | OD value of reverse transfer toner |
| 1-(1) | 1.050 | 0.031 | 0.020 | 0.682 | 0.013 | 0.023 |
| 1-(2) | 1.258 | 0.028 | 0.010 | 0.758 | 0.004 | 0.009 |
| 1-(3) | 1.324 | 0.005 | 0.005 | 1.043 | 0.004 | 0.003 |
| 1-(4) | 1.370 | 0.010 | 0.008 | 1.352 | 0.005 | 0.010 |

TABLE 19-continued

| | Contact development | | | Non-contact development | | |
|---|---|---|---|---|---|---|
| Toners | OD value of solid image | OD value of fog toner | OD value of reverse transfer toner | OD value of solid image | OD value of fog toner | OD value of reverse transfer toner |
| 1-(5) | 1.410 | 0.010 | 0.013 | 1.380 | 0.005 | 0.015 |
| 1-(6) | 1.413 | 0.011 | 0.020 | 1.293 | 0.006 | 0.019 |

TABLE 20

| | Contact developing process | | Non-contact developing process | |
|---|---|---|---|---|
| Toners | Hollow defect | Flush | Hollow defect | Flush |
| 1-(1) | Δ | Δ | Δ | Δ |
| 1-(2) | ○ | ○ | Δ | ○ |
| 1-(3) | ○ | ○ | ○ | ○ |
| 1-(4) | ○ | ○ | ○ | ○ |
| 1-(5) | ○ | ○ | ○ | ○ |
| 1-(6) | ○ | ○ | Δ | ○ |

In Table 20, the mark
Δ indicates a state that the obtained solid image had a problem because there wew some hollow defects or flushes and the mark
○ indicates a state that the obtained solid image was good because there was no or little hollow defects or flushes.

As apparent from the test results shown in Table 19 and Table 20, the toner 1-(2) containing the alumina-silica combined oxide fine particles and the toner 1-(6) containing the rutile/anatase type titanium oxide had good results not only improved density of solid image but also reduced fog toner, reduced reverse transfer toner, reduced hollow defects, and reduced flushes, as compared to the toner 1-(1) containing silica only. Further, the toners 1-(3), 1-(4), and 1-(5) containing the mixture of the alumina-silica combined oxide fine particles and the rutile/anatase type titanium oxide had excellent results with further reduced fog toner, reduced reverse transfer toner, reduced hollow defects, and reduced flushes.

While the transfer efficiency of the toner 1-(1) was in a range from 90% to 94%, the transfer efficincy of the toners 1-(2) through 1-(6) was in order of 98%. This means that the addition of alumina-silica combined oxide fine particles and rutile/anatase type titanium oxide improves the transfer.

The OD values of fog toner and reverse transfer toner were measured by the tape transfer method. It should be noted that the tape transfer method is a method comprising attaching a mending tape, available from Sumitomo 3M Ltd., onto toner existing on the photoreceptor to transfer fog toner particles or reverse transfer toner particles onto the mending tape, attaching the tape on a white plain paper and also attaching another tape not attached to the photoreceptor on a white plain paper, measuring their reflection densities by a Macbeth reflection densitometer, and obtaining the difference by subtracting the density of the other tape from the measured value of the tape after attachment. The difference is defined as the reflection density of fog toner or reverse transfer density. On the other hand, the transfer efficiency was obtained by attaching such tapes onto toner existing on the photoreceptor before and after the transfer, measuring the weights of the tapes, and calculating a difference therebetween. The amount of reverse transfer toner was obtained as follows. After a solid image is formed with a cyan toner as a first color, a white solid image is formed with a second color. At this point, the cyan toner as the first color reversely transferred to the photoreceptor now only having non-image portion corresponding to the white solid image is measured as the amount of reverse transfer toner by the tape transfer method.

Hereinafter, the fifth embodiment of the non-magnetic single-component toner according to the present invention will be described.

The negatively chargeable dry toner 8 of the fifth embodiment is a non magnetic single component toner of a negatively chargeable dry type which comprises toner mother particles and "aluminum oxide-silicon dioxide combined oxide particles which are obtained by flame hydrolysis" (hereinafter, referred to as "combined oxide particles") and silicon dioxide (silica: $SiO_2$) particles as external additives. It should be noted that numerical range will be indicated by omitting the former unit when the former unit and the latter unit are the same, for example, using "from 20 to 60 $\mu$m" instead of "from 20 $\mu$m to 60 $\mu$m". The same is true for other units.

The toner mother particles may be prepared by the pulverization method or the polymerization method. In case of full color toner, the mother particles are preferably prepared by the polymerization method. For making the pulverized toner, at least a pigment is added and, as necessary, a release agent, and a charge control agent are added to a resin binder, uniformly mixed by a Henschel mixer, and melt and kneaded by a twin-shaft extruder. After cooling process, they are classified through the rough pulverizing-fine pulverizing process. Further, external additives are added to adhere to the mother particles. In this manner, the toner is obtained.

The binder resin, the release agent and the charge control agent used in the negatively chargeable dry toner 8 of the fifth embodiment may be the same as those used in the aforementioned first embodiment.

The proportions (parts by weight) of components in the pulverized toner 8 of the fifth embodiment are the same as shown in Table 1 for the aforementioned first embodiment, that is, par 100 parts by weight of the binder resin, the coloring agent is in a range form 0.5 to 15 parts by weight, preferably from 1 to 10 parts by weight, the release agent is in a range from 1 to 10 parts by weight, preferably from 2.5 to 8 parts by weight, and the charge control agent is in a range from 0.1 to 7 parts by weight, preferably from 0.5 to 5 parts by weight.

Also in the pulverized toner of the fifth embodiment, in order to improve the transfer efficiency, the toner is preferably spheroidized similarly to the method of the aforementioned first embodiment. For this, it is preferable to use such a machine allowing the toner to be pulverized into relatively spherical particles. For example, by using a turbo mill (available from Kawasaki Heavy Industries, Ltd.) known as a mechanical pulverizer, the degree of circularity may be 0.93 maximum. Alternatively, by using a commercial hot air spheroidizing apparatus: Surfusing System SFS-3 (available from Nippon Pneumatic Mfg. Co., Ltd.), the degree of circularity may be 1.00 maximum.

The method of preparing the polymerized toner 8 of the fifth embodiment may be suspension polymerization method, emulsion polymerization method, or dispersion polymerization method. In the suspension polymerization, a monomer compound is prepared by melting or dispersing a coloring agent, a release agent, and, if necessary, a dye, a polymerization initiator, a cross-linking agent, a charge control agent, and other additive(s) into polymerizable monomer. By adding the monomer compound into an aqueous phase containing a suspension stabilizer (water soluble polymer, hard water soluble inorganic material) with stirring, the monomer compound is polymerized and granulated, thereby forming toner particles having a desired particle size.

In the emulsion polymerization, a monomer, a release agent and, if necessary, a polymerization initiator, an emulsifier (surface active agent), and the like are dispersed into a water and are polymerized. During the coagulation, a coloring agent, a charge control agent, and a coagulant (electrolyte) are added, thereby forming color toner particles having a desired particle size.

Among the materials for the polymerization method, the coloring agent, the release agent, the charge control agent, and the fluidity improving agent may be the same materials for the pulverized toner mentioned above.

Also in the polymerized toner 8 of the fifth embodiment, the polymerizable monomer, the emulsifier (surface active agent), the polymerization initiator, and the coagulant (electrolyte) may the same as those used in the aforementioned first embodiment.

As the method of adjusting the degree of circularity of the polymerized toner of the fifth embodiment, in case of the emulsion polymerization method, the degree of circularity can be freely changed by controlling the temperature and time of coagulating process of secondary particles. In this case, the degree of circularity is in a range from 0.94 to 1.00. In case of the suspension polymerization method, since this method enables to make perfect spherical toner particles, the degree of circularity is in a range from 0.98 to 1.00. By heating the toner particles at a temperature higher than the glass-transition temperature of toner to deform them for adjusting the circularity, the degree of circularity can be freely adjusted in a range from 0.94 to 0.98.

Besides the aforementioned methods, the polymerized toner of the fifth embodiment can be prepared by the dispersion polymerization method, for example, the method disclosed in Japanese Patent Unexamined Publication No. 63-304002. In this case, since the shape of each particle may be close to the perfect sphere, the particles are heated at a temperature higher than the glass-transition temperature of toner so as to form the particles into a desired shape.

External additives are used for stabilizing the charging property and improving the fluidity of a dry toner. In the dry toner of the present invention, the combined oxide particles are used as one of the external additives. The combined oxide particles may be prepared by the method of preparing silicone-aluminum combined oxide powder disclosed in Japanese Patent No. 2533067. The method comprises the following steps.

(1) Silicon halides and aluminum halides are evaporated. The evaporated halides are combined with a carrier gas and they are homogeneously mixed in a mixing unit with air, oxygen and hydrogen.

(2) Then, this evaporated mixture is supplied to a burner and brought to reaction in a combustion chamber in a flame. The hot gases and solid produced in the reaction are subsequently cooled in a heat-exchanger unit.

(3) The gases are separated from the solid and any residual halides adhering to the product are removed by a heat treatment with moistened air. In this manner, the combined oxide particles are obtained.

The ratio of $Al_2O_3$ and $SiO_2$ in the combined oxide particles is suitably adjusted according to reaction conditions such as the feed rate of silicon halides and aluminum halides, the flow rate of hydrogen, the flow rate of air.

The weight ratio of $Al_2O_3$ to $SiO_2$ in the combined oxide particles may be set such that the content of $Al_2O_3$ is in a range from 55 wt % to 85 wt % and the content of $SiO_2$ is in a range from 45 wt % to 15 wt %. Because the combined oxide particles are formed into particles in the flame, the combined oxide particles have amorphous structure, enough fine particle property, and a specific surface area of 20 to 200 $m^2/g$, according to the BET method. The primary particle diameter of the combined oxide particles are in a range from 7 to 80 nm, preferably from 10 to 40 nm. In the combined oxide particles, particles having a particle diameter of 20 nm or more occupy 30% or more based on the number.

The combined oxide particles are preferably added by an amount of 0.1 to 3% by weight, more preferably 0.2 to 2% by weight relative to the toner mother particles. Since the combined oxide particles has a broad particle size distribution, external additive particles can be prevented from being embedded into mother particles in successive printing when the combined oxide particles are added even in a small amount. In addition, the transfer efficiency can be improved because of the larger particles thereof. Since the larger particles are not too large, the abnormal partial wear of the photoreceptor can be prevented.

In the negatively chargeable dry toner 8 of the fifth embodiment, the combined oxide particles have two work functions: i.e. a first work function in a range from 5.0 to 5.4 eV and a second work function in a range from 5.4 to 5.7 eV. The work function of the toner mother particles is in a range from 5.3 to 5.65 eV, that is, larger than the first work function of the combined oxide particles and smaller than the second work function of the combined oxide particles.

Figure 15:
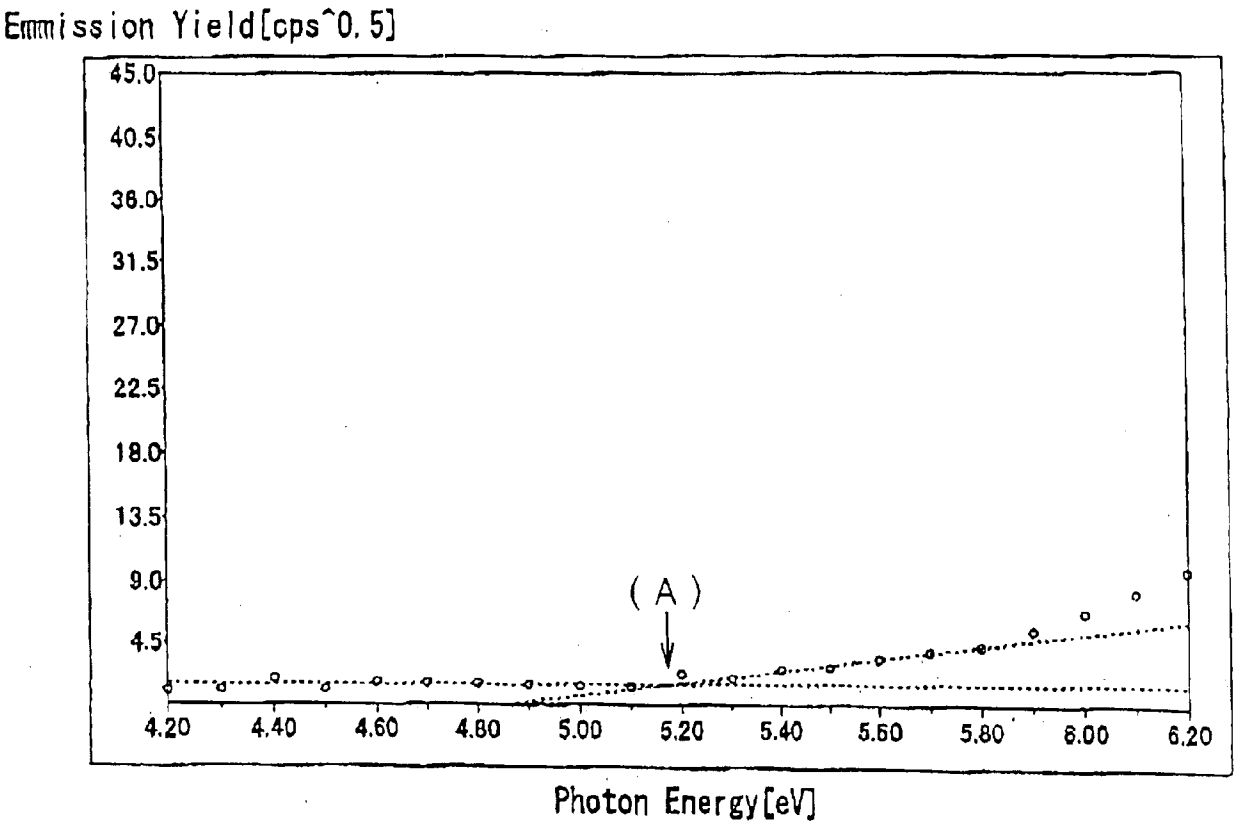
FIG. 15 is a diagram showing data of combined oxide particles of the present invention measured by using a surface analyzer and for explaining that two kinds of work functions are obtained.
Figure 16:
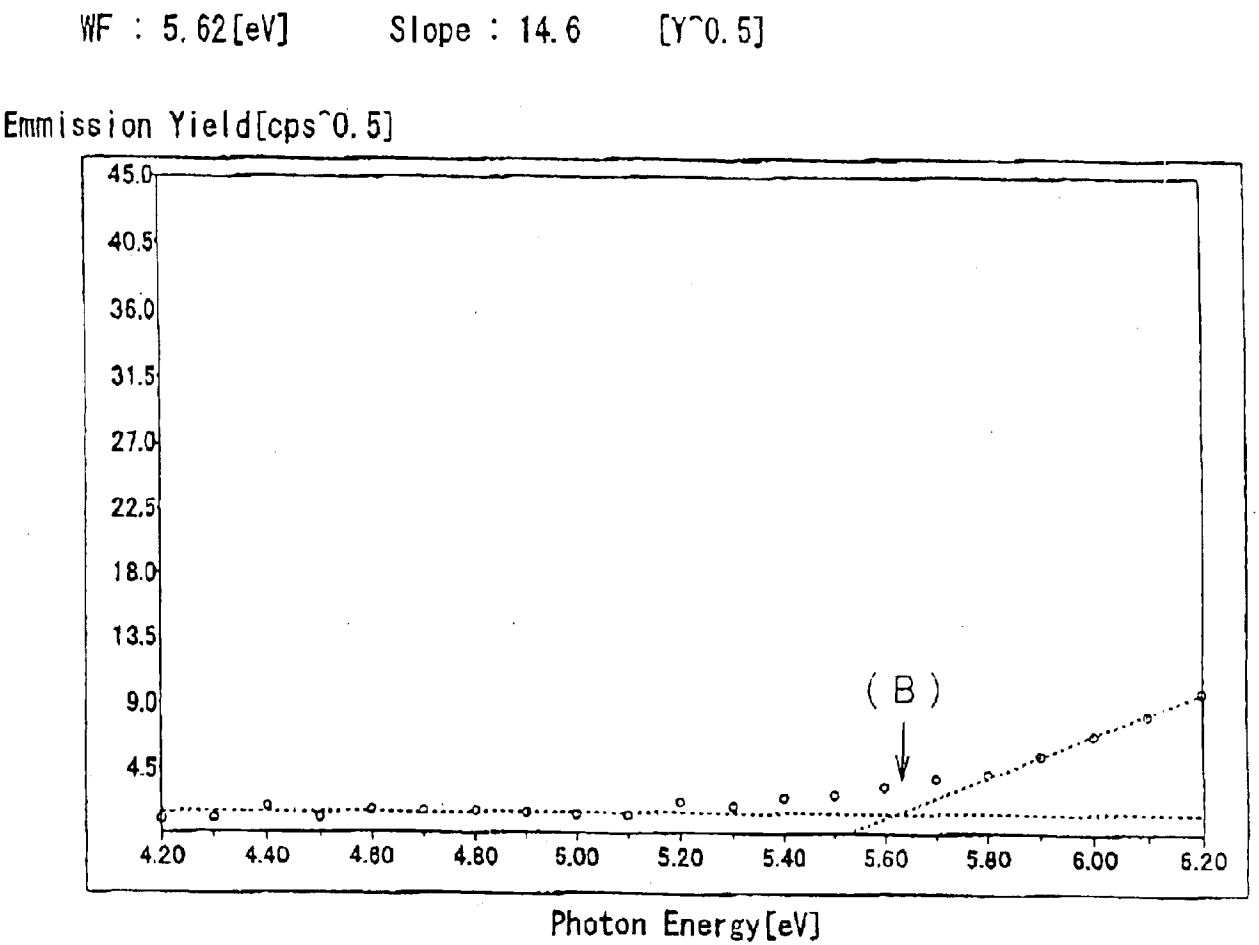
FIG. 16 is a diagram showing the same kind of data as that shown in FIG. 15 and for explaining that two kinds of work functions are obtained.
Figure 17:
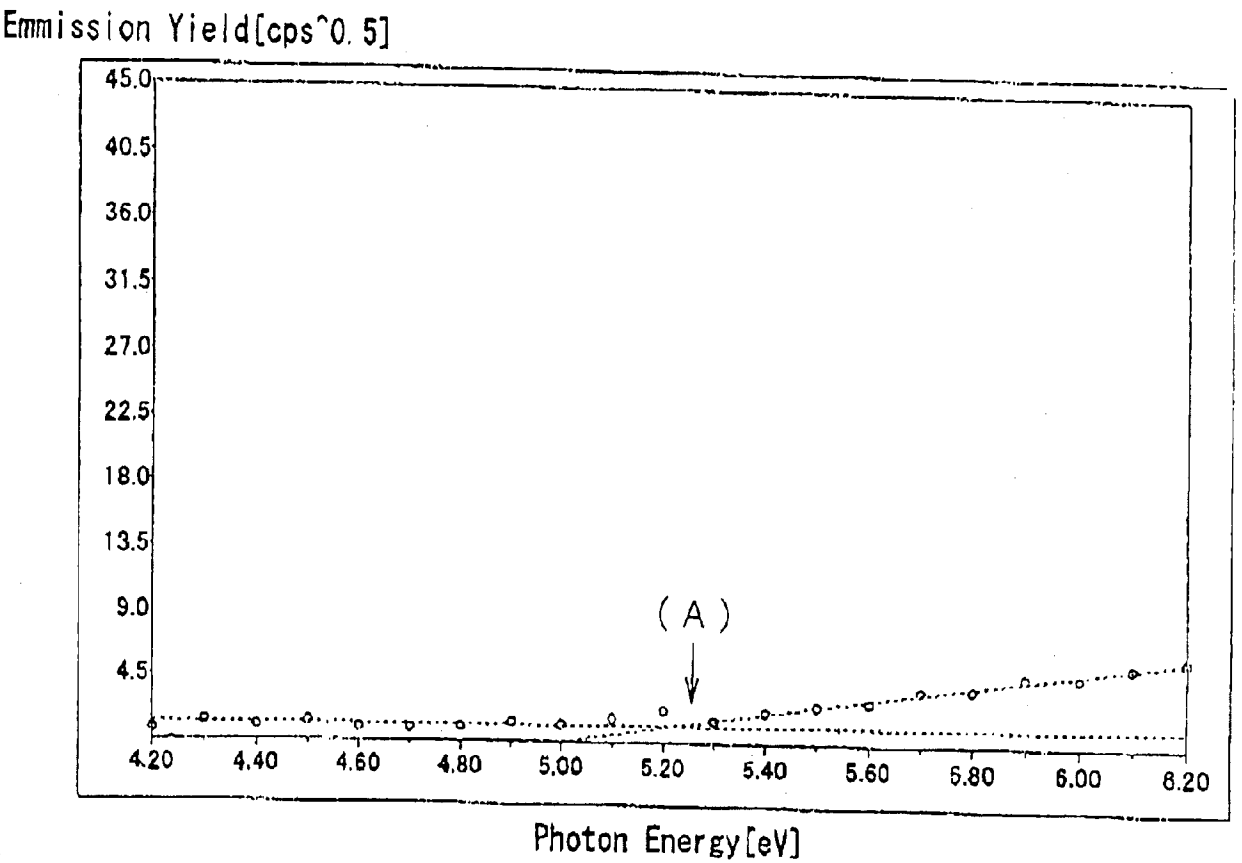
FIG. 17 is a diagram showing data of $SiO_2$ particles (mean particle diameter: 12 nm) as external additive particles measured by the surface analyzer.
Figure 18:
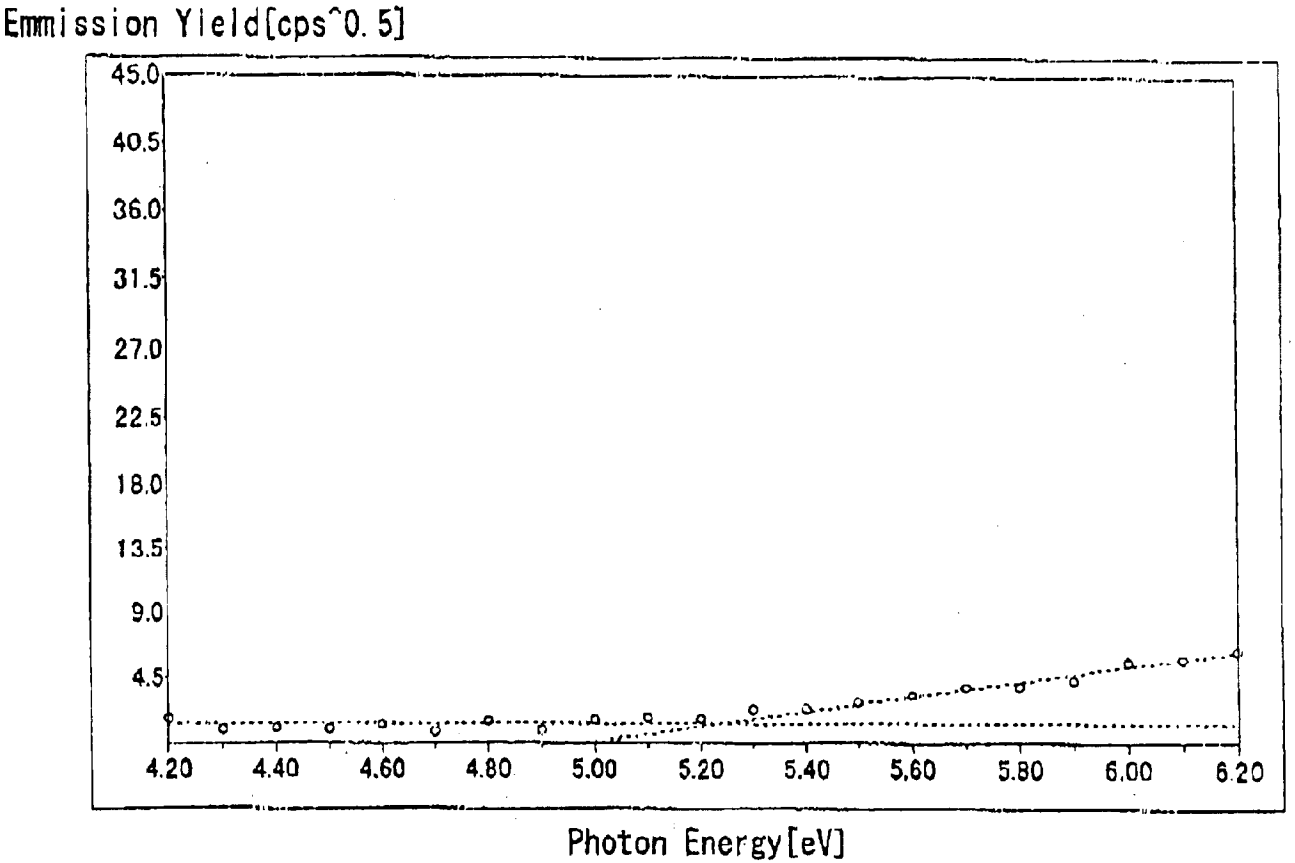
FIG. 18 is a diagram showing data of $SiO_2$ particles (mean particle diameter: 40 nm) as external additive particles measured by the surface analyzer.
Figure 19:
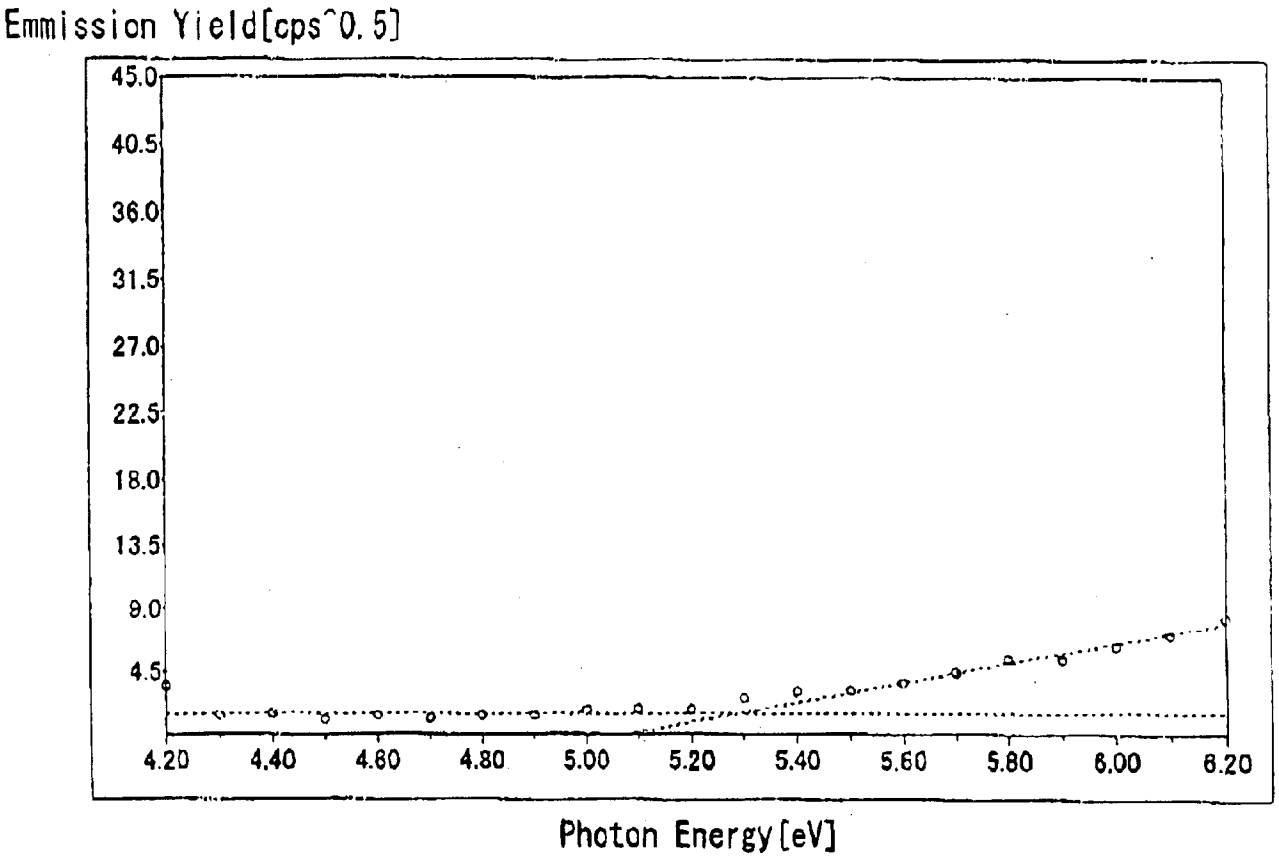
FIG. 19 is a diagram showing data of $Al_2O_3$ particles as external additive particles measured by the surface analyzer.

Data of the combined oxide particles of the fifth embodiment are shown in FIG. 15 and FIG. 16. Respective data of $SiO_2$ particles (having a mean particle diameter of 12 nm), $SiO_2$ particles (having a mean particle diameter of 40 nm), and $Al_2O_3$ particles are shown in FIG. 17 through FIG. 19, respectively. Data of mixed oxide particles obtained by just mixing $SiO_2$ particles and $Al_2O_3$ particles are shown in FIG. 20 through FIG. 23. As for a pair of FIG. 15 and FIG. 16, a pair of FIG. 20 and FIG. 21, and a pair of FIG. 22 and FIG. 23, the diagrams of each pair were the same. The reason of using the same diagrams is for facilitating the following explanation.

In the surface analyzer, the energy value (work function) at which photoelectron emission is started while scanning excitation energy of monochromatic beam from the lower side to the higher side is measured. Data is obtained from the relation between the excitation energy (Photon Energy) (abscissa) and the normalized photoelectron yield (Emission Yield). For example, as described with FIG. 17, the work function (WF) of $SiO_2$ particles is an excitation energy of 5.22 eV at a critical point (A). A large value in gradient (slope; normalized photoelectron yield/eV) indicates a state of easily allowing electrons to be emitted.

Figure 20:
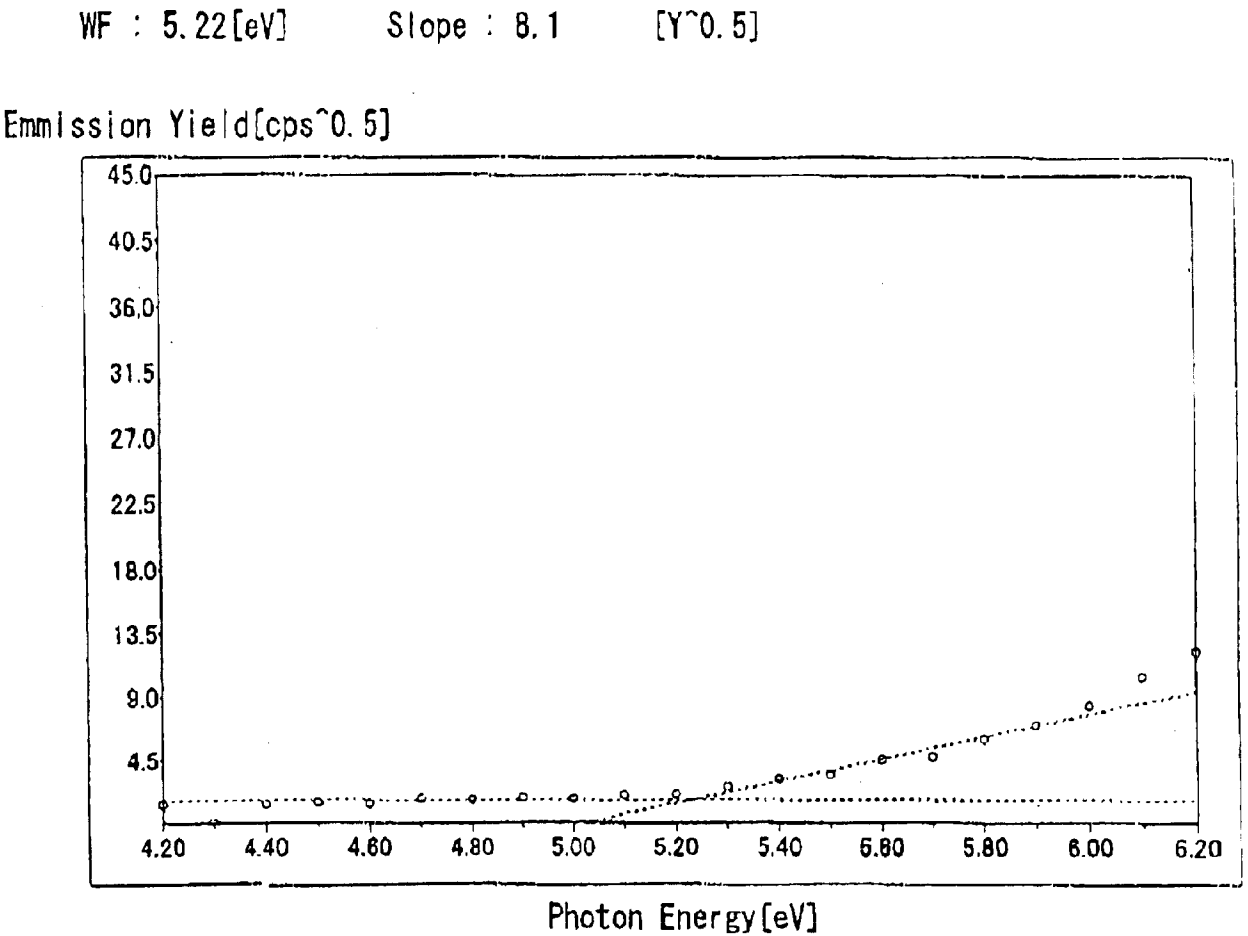
FIG. 20 is a diagram showing data of mixed oxide particles-1 which is a mixture of $SiO_2$ particles and $Al_2O_3$ particles as external additive particles measured by using the surface analyzer.
Figure 21:
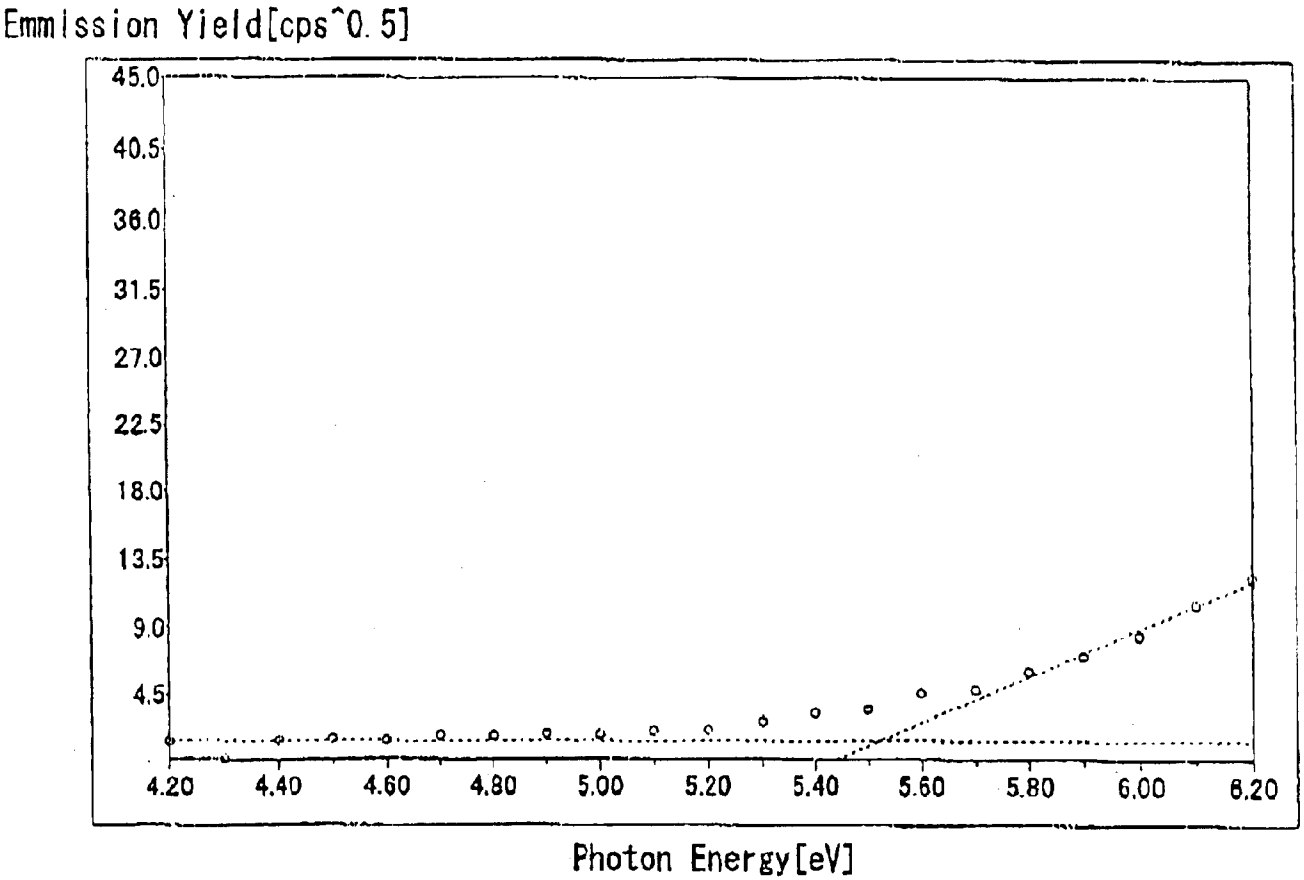
FIG. 21 is a diagram showing the same kind of data as that shown in FIG. 20 and for explaining that two kinds of work functions are obtained.

As a result of measuring the combined oxide particles, it is found from the relation between the photoelectron energy and the photoelectron yield, the combined oxide particles have two excitation energies, i.e. 5.18 eV at a critical point (A) as shown in FIG. 15 and 5.62 eV at a critical point (B) as shown in FIG. 16. As a result of measuring the mixed oxide particles, it is found that the mixed oxide particles also have two excitation energies, i.e. 5.22 eV and 5.52 eV as shown in FIG. 20 and FIG. 21. As apparent from Table 21, the combined oxide particles have a difference between the work functions larger than that of the mixed oxide particles and easily impart triboelectric charging sites both of the positive polarity and of the negative polarity as compared to the mixed oxide particles when externally adhering to toner mother particles. Though the detail reason is not clarified, it is considered that the combined oxide particles are not a mixture obtaining by just mixing $SiO_2$ particles and $Al_2O_3$ particles.

The contact of the toner particles to triboelectric charging sites of the positive polarity of the combined oxide particles insures the negative charging of the toner particles, thereby reducing the amount of positively charged toner particles. On the other hand, the contact of the toner particles to triboelectric charging sites of the negative polarity of the combined oxide particles prevents the toner particle from being excessively negatively charged, thereby providing stable negatively charged toner.

The combined oxide particles of the fifth embodiment is obtained by evaporating silicon halides and aluminum halides, verifying the respective evaporation amounts corresponding to the purpose, homogeneously mixing the evaporated halides with a carrier gas in a mixing unit with air, oxygen and hydrogen, and hydrolyzing the mixture in a flame. By controlling the production conditions, it can be controlled to have a first work function in a range from 5.0 to 5.4 eV and a second work function in a range from 5.4 to 5.7 eV.

It is preferable to add $SiO_2$ particles as another external additive together with the combined oxide particles. The use of $SiO_2$ particles makes the toner 8 of the present invention to a negatively chargeable dry toner 8 and prevents the toner from being positively charged when using the combined oxide particles as the external additive particles. If the combined oxide particles are used alone as external additive particles to prepare a negatively chargeable toner, the aluminum oxide component contained in the combined oxide particles functions as a positively charged site so as to generate reverse transfer toner particles, thus increasing fog toner, leading to the reduction in transfer efficiency. By adding negatively chargeable $SiO_2$ particles together with the combined oxide particles, however, the production of positively charged toner can be prevented. When the combined oxide particles and the $SiO_2$ particles are used together, the amount of $SiO_2$ particles can be reduced as compared to the amount of $SiO_2$ particles when used alone, thereby holding well fixing property.

Another external additive may be additionally used in as the external additive particles in the fifth embodiment. Examples are fine particles of titanium dioxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, calcium stearate, metallic salt titanate such as barium titanate, strontium titanate, and silicon metallic salt. The mean particle diameter of primary particles of the external additive to be added together with the combined oxide particles is in a range from 1 to 500 nm, preferably from 5 to 200 nm.

The external additive particles in the fifth embodiment are preferably processed by a hydrophobic treatment with a silane coupling agent, a titanate coupling agent, a higher fatty, silicone oil. Specifically, the same hydrophobic treatment agent as the negatively chargeable toner 8 of the first embodiment may be used.

In the negatively chargeable dry toner 8 of the fifth embodiment, the adding amount of the combined oxide particles is in a range form 0.1% by weight to 3% by weight, preferably from 0.2% by weight to 2% by weight relative to the toner mother particles. The adding amount of the $SiO_2$ particles is in a range form 0.3% by weight to 3% by weight, preferably from 0.5% by weight to 2% by weight relative to the toner mother particles. The total adding amount of all of the external additives is in a range from 0.5% by weight to 5% by weight, preferably from 1% by weight to 4% by weight relative to the toner mother particles.

In the negatively chargeable dry toner 8 of the fifth embodiment, the work function of the toner mother particles when the combined oxide particles externally adhere to the toner mother particles is in a range from 5.3 eV to 5.65 eV, preferably from 5.35 eV to 5.6 eV. In addition, the work function of the toner mother particles is set to be larger than the first work function of the combined oxide particles and smaller than the work function of the combined oxide particles. It is found that such arrangement about the work functions reduces the fog toner and improves the transfer efficiency. If the work function of the toner mother particles is not in a range between the two work functions of the combined oxide particles, the amount of cleaning toner particles should be increased as compared to the case that the work function of the toner mother particles is set in a range between the two work functions, as will be described with regard to Example 23.

The toner mother particles and the external additives are entered into a known mixing device such as a Henschel mixer, a V-shape blender, a counter-flow mixer, a high-speed mixer, a Cyclomix, and an axial mixer, in which the external additives are treated to adhere to the toner mother particles, thereby obtaining the negatively chargeable dry toner of the fifth embodiment.

The work function of the negative chargeable dry toner of the fifth embodiment thus obtained is in a range from 5.3 eV to 5.9 eV, preferably from 5.4 eV to 5.85 eV. By setting the work function of the negatively chargeable dry toner to be larger than the work function of the surface of the photoreceptor, the fog toner is reduced and the transfer efficiency is improved as stated in the following examples. When the work function of the negatively chargeable dry toner is set to be smaller than the work function of the photoreceptor, a phenomenon called "excessive charging" that the charge becomes too high during a toner layer on the development roller is regulated by the toner regulating member may be caused. However, by setting the work function according to the present invention, the phenomenon called "excessive charging" can be prevented.

The negatively chargeable toner of the fifth embodiment, in case of pulverized toner, is set to have a mean particle diameter based on the number from 5 $\mu$m to 10 $\mu$m, preferably from 6 $\mu$m to 9 $\mu$m, and in case of polymerized toner, is set to have a mean particle diameter as 50% particle diameter based on the number of 8 $\mu$m or less, preferably from 4.5 $\mu$m to 8 $\mu$m and has a particle size distribution in which particles having a particle diameter of 3 $\mu$m or less occupy 10% or less, preferably 5% or less based on the number.

In either of the pulverization method and the polymerization method, toner having small particle diameter has a problem that the charge of the toner becomes too large in the initial stage because the adding amount of $SiO_2$ particles should be too much. In addition, as printing proceeds, the effective surface areas of the $SiO_2$ particles are reduced due to embedment and/or scattering. This reduces the charge of the toner, thus increasing the variation of image density and increasing the amount of fog toner. This means the increase of the toner consumption. Therefore, such a toner having small particle size is hardly used as ordinary used toners. However, by the use of the combined oxide particles having a broad particle size distribution as one of the external additives, external additive particles are prevented from being embedded into mother particles. In addition, the combined oxide particles have a large difference between the first and second work functions, thereby proving a negatively chargeable toner which is stable over the entire life for printing.

Also in the negatively chargeable dry toner of the fifth embodiment in either of the pulverization method and the polymerization method, the desirable degree of circularity (sphericity) preferably is 0.94 or more, specifically 0.95 or more. In case of the degree of circularity up to 0.97, a cleaning blade is preferably used. In case of the higher degree, a brush cleaning is preferably used with the cleaning blade. By setting the degree of circularity (sphericity) to 0.94 or more, the transfer efficiency is improved.

It should be noted that, in the fifth embodiment, the mean particle diameter and the degree of circularity (sphericity) of the toner mother particles and the toner particles are values measured by FPIA2100 available from Sysmex corporation, similarly to the aforementioned embodiments. The mean particle diameter of the external additive particles such as the combined oxide particles are values measured by an electron microscope.

The negatively chargeable dry toner of the fifth embodiment can be used in a full color printer of a four cycle type as shown in FIG. 8, similarly to the aforementioned embodiments. The full color image forming apparatus may be of a tandem type or a rotary type.

In the image forming apparatus of the present invention, the development roller 11 and the intermediate transfer medium 36 may be in contact with the photoreceptor 140, or the development may be conducted by the non-contact jumping process.

Since the toner particles of the fifth embodiment are stable negatively chargeable dry toner, high-quality uniform toner images can be formed without fog toner, thereby increasing the transfer efficiency to a recording medium or a transfer medium and thus significantly reducing the amount of toner left after transfer. In addition, the load to a cleaning unit can be reduced, a smaller-size cleaning container can be used, and the consumption of toner can be minimized, thereby reducing the running cost.

Now, the negatively chargeable dry toner of the fifth embodiment will be described in detail with concrete examples.

Examples

Description will be made as regard to the manufacturing method and work functions of the external additives such as the combined oxide particles used in Example 18 described later.

(Production of Combined Oxide Particles)

Figure 24:
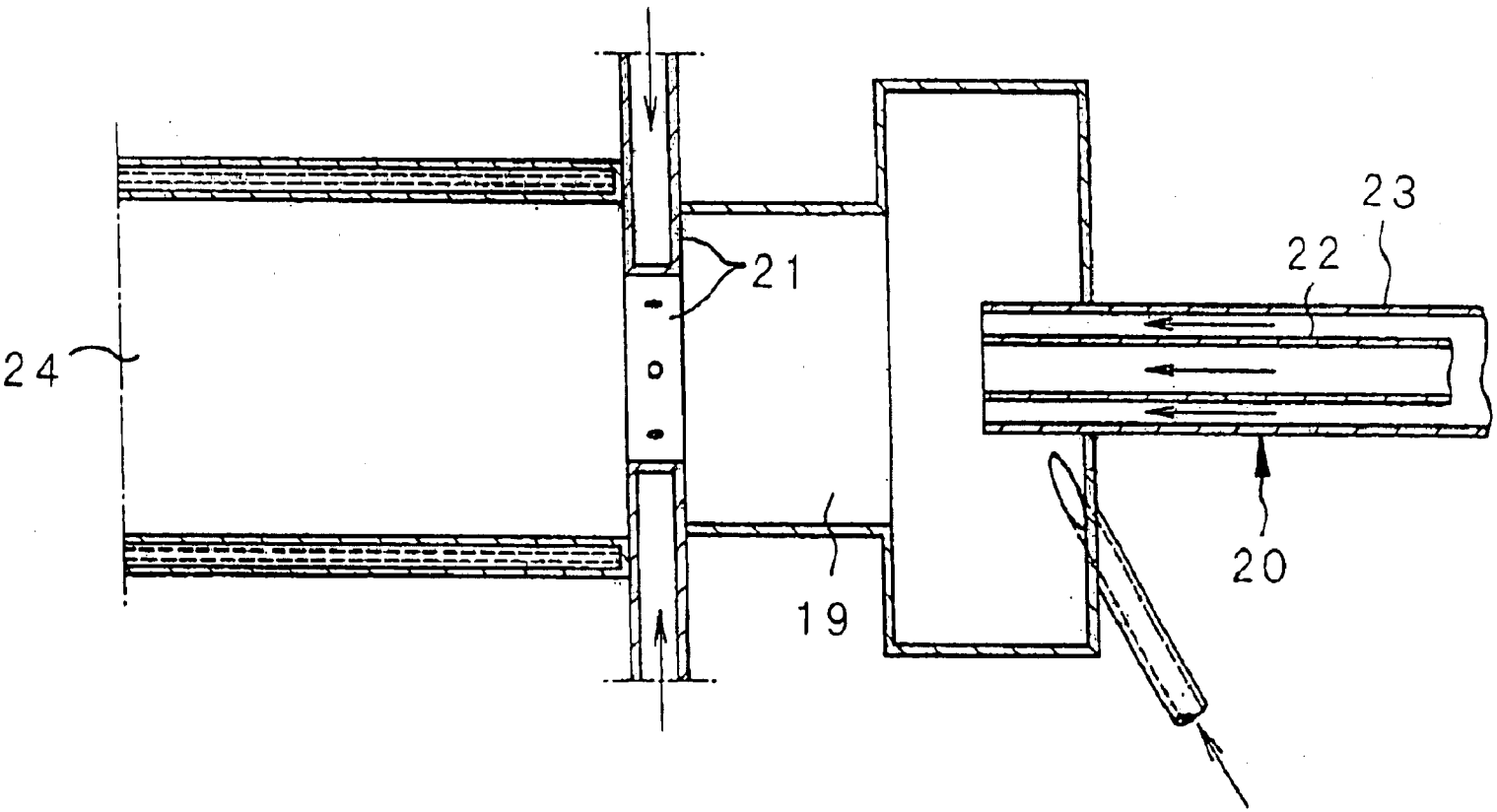
FIG. 24 is an illustration showing a burner device for producing combined oxide particles according to the present invention.

FIG. 24 shows a burner system for manufacturing combined oxide particles. In FIG. 24, numeral 19 designates a combustion chamber, 20 designates a double-jacketed tube, 21 designates an annular diaphragm, 22 designates an inner tube, 23 designates an outer tube, and 24 designates a water-cooled flame tube. The double-jacket tube 20 projects to the combustion chamber 19. Evaporated heat mixture of 200° C., which is obtained by mixing 1.4 $Nm^3/h$ of hydrogen, 5.5 $Nm^3/h$ of air, and 1.30 kg/h of previously evaporated gaseous $SiCl_4$, is introduced from the inner tube 22 of the double-jacketed tube 20. Gaseous $AlCl_3$ is previously made by evaporating $AlCl_3$ at temperature of 300° C. This gaseous $AlCl_3$ is successively introduced into the flame tube at a rate of 2.34 kg/h and air is additionally added in an amount of 12 $Nm^3/h$ so as to burn. During this, air is introduced into the combustion chamber 19 and air is additionally introduced from the annular diaphragm 21. In the flame, produced water and chloride rapidly react with each other so as to produce the combined oxide particles. After having passed through the flame tube, the produced powder is separated and hydrochloric acid adhering to the powder is removed by using a filter or cyclones. The obtained combined oxide particles consists of 65 weight % of $Al_2O_3$ and 35 weight % of $SiO_2$ and has a mean primary particle diameter of 14 nm, a specific surface area according to the BET method of 74 $m^2/g$, and a volume resistance of $10^{12}$ Ωcm. The obtained combined oxide particles were treated to have hydrophobic property with dimethylsilane (DMS).

The work function of the obtained combined oxide particles was measured by a surface analyzer (AC-2, produced by Riken Keiki Co., Ltd) with radiation amount of 500 nW. Data as the results of this measurement are shown in FIG. 15 and FIG. 16. FIG. 15 and FIG. 16 are diagrams for explaining that the combined oxide particles have two work functions and show the same data.

($SiO_2$ Particles-1)

Vapor-phase silica particles (having a mean particle diameter of 12 nm) were treated to have hydrophobic property with hexamethyldisilazane (HMDS). Data as results of measuring the obtained particles by the surface analyzer in the same manner are shown in FIG. 17.

($SiO_2$ Particles-2)

Vapor-phase silica particles (having a mean particle diameter of 40 nm) were treated to have hydrophobic property with hexamethyldisilazane (HMDS). Data as results of measuring the obtained particles by the surface analyzer in the same manner are shown in FIG. 18.

($Al_2O_3$ Particles)

Vapor-phase alumina particles (having a mean particle diameter of 13 nm). Data as results of measuring this example by the surface analyzer in the same manner are shown in FIG. 19.

(Mixed Oxide Particles-1, as a Mixture of $SiO_2$ Particles and $Al_2O_3$ Particles)

Vapor-phase alumina particles (having a mean particle diameter of 13 nm) and vapor-phase silica particles (having a mean particle diameter of 12 nm) treated with hexamethyldisilazane (HMDS) were mixed in the dry method at a mixing ratio of 65:35 (by weight) and, after that, were left for 24 hours at a room temperature of 25° C. and humidity of 55% so as to produce mixed oxide particles of this example. Data of as results of measuring the obtained particles by the surface analyzer in the same manner are shown in FIG. 20 and FIG. 21. FIG. 20 and FIG. 21 are diagrams for explaining that the obtained particles have two work functions and show the same data.

TABLE 21

| External additive particles | Work function (eV) | Normalized photoelectron yield | Difference between work functions (eV) |
|---|---|---|---|
| $SiO_2$ particles-1 | 5.22 | 5.1 | — |
| $SiO_2$ particles-2 | 5.24 | 5.2 | — |

TABLE 21-continued

| External additive particles | Work function (eV) | Normalized photoelectron yield | Difference between work functions (eV) |
|---|---|---|---|
| $Al_2O_3$ particles | 5.29 | 7.1 | — |
| Mixed oxide particles-1 | 5.22 | 8.1 | 0.30 |
| | 5.52 | 15.8 | |
| Mixed oxide particles-2 | 5.24 | 7.1 | 0.34 |
| | 5.58 | 17.3 | |
| Combined oxide particles | 5.18 | 4.6 | 0.44 |
| | 5.62 | 14.6 | |

(Mixed oxide particles-2, as a mixture of $SiO_2$ particles and $Al_2O_3$ particles)

Figure 22:
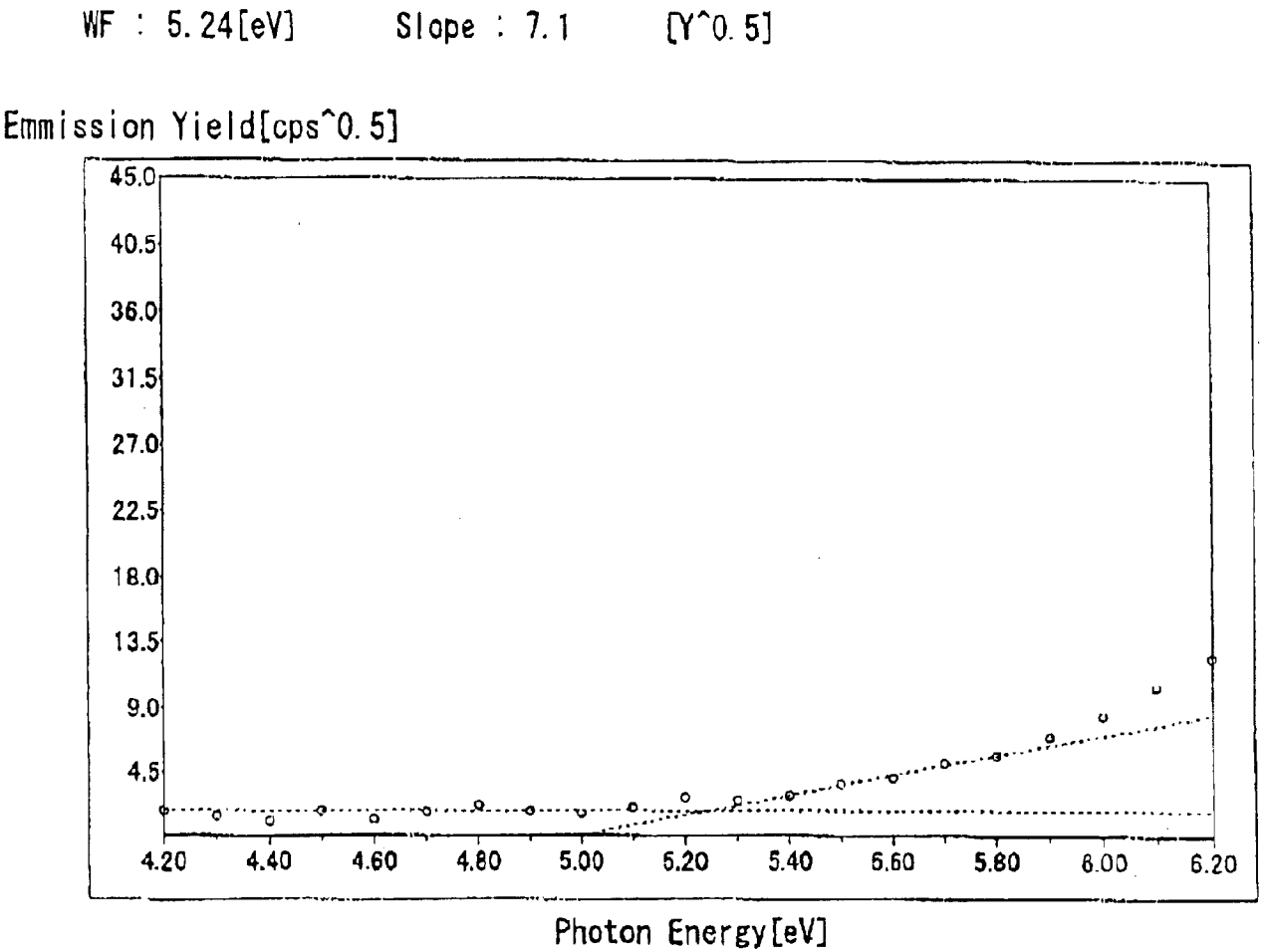
FIG. 22 is a diagram showing data of mixed oxide particles-2 which is a mixture of $SiO_2$ particles and $Al_2O_3$ particles as external additive particles measured by using the surface analyzer.
Figure 23:
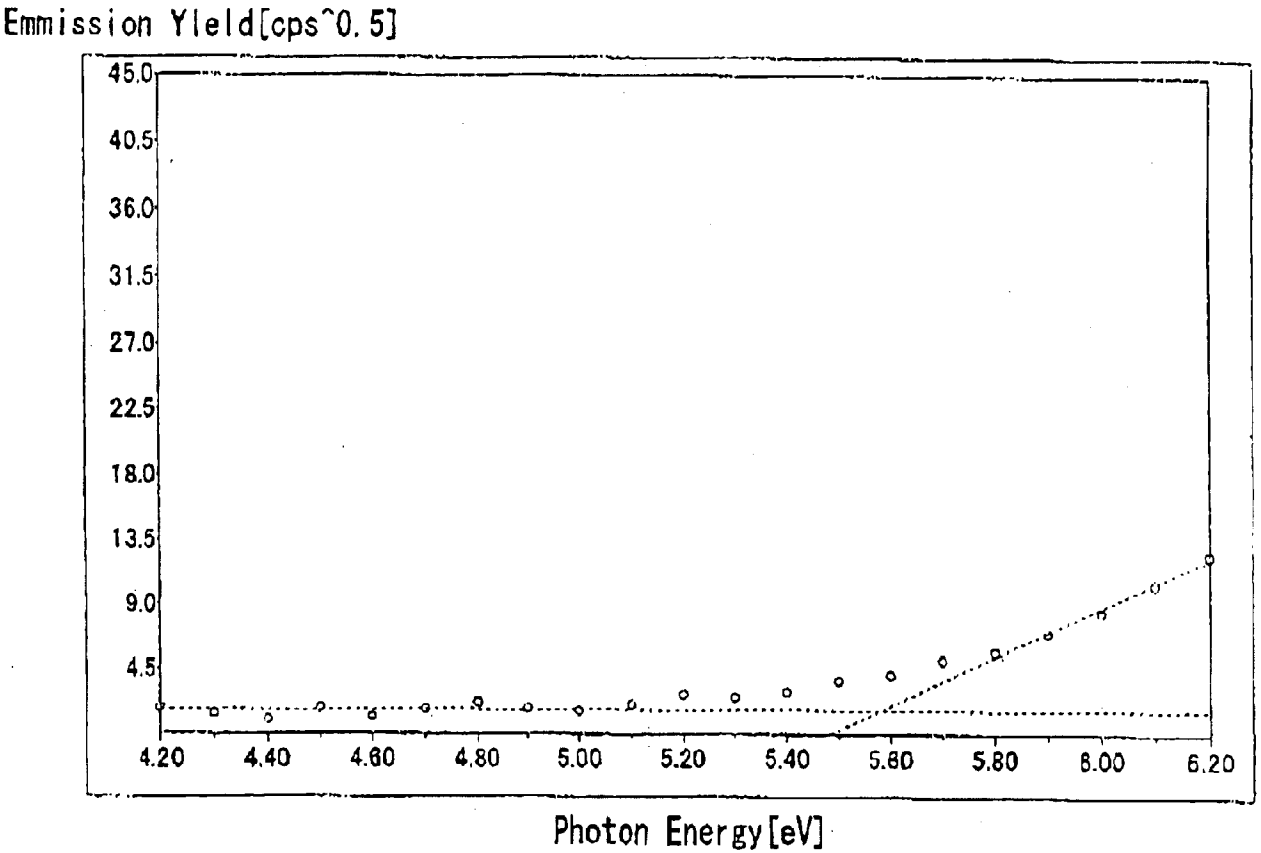
FIG. 23 is a diagram showing the same kind of data as that shown in FIG. 22 and for explaining that two kinds of work functions are obtained.

Vapor-phase alumina particles (having a mean particle diameter of 13 nm) and vapor-phase silica particles (having a mean particle diameter of 40 nm) treated with hexamethyldisilazane (HMDS) were mixed in the dry method at a mixing ratio of 65:35 (by weight) and, after that, were left for 24 hours at a room temperature of 25° C. and humidity of 55% so as to produce mixed oxide particles of this example. Data of as results of measuring the obtained particles by the surface analyzer in the same manner are shown in FIG. 22 and FIG. 23. FIG. 22 and FIG. 23 are diagrams for explaining that the obtained particles have two work functions and show the same data.

The work functions of the respective external additives obtained from FIGS. 15 through 23 are summarized in Table 21.

Though the $SiO_2$ particles-1, the $SiO_2$ particles-2, and the $Al_2O_3$ particles each have one work function, the mixed oxide particles-1, the mixed oxide particles-2, and the combined oxide particles each have two work functions. In addition, it is found that the difference between the two work functions of the combined oxide particles is larger than that of the mixed oxide particles.

Hereinafter, manufacturing methods and production methods of toners 1, an organic photoreceptor, a development roller, and a transfer medium used in the examples will be described.

(Production Example of Toner 1)

A monomer mixture composed of 80 parts by weight of styrene monomer, 20 parts by weight of butyl acrylate, and 5 parts by weight of acryl acid was added into a water soluble mixture composed of: 105 parts by weight of water, 1 part by weight of nonionic emulsifier, 1.5 parts by weight of anion emulsifier, and 0.55 parts by weight of potassium persulfate and was agitated and polymerized in nitrogen gas atmosphere at a temperature of 70° C. for 8 hours. By cooling after polymerization reaction, milky white resin emulsion having a particle size of 0.25 μm was obtained.

Then, a mixture composed of 200 parts by weight of resin emulsion obtained above, 20 parts by weight of polyethylene wax emulsion (available from Sanyo Chemical Industries, Ltd.), and 7 parts by weight of Phthalocyanine Blue was dispersed into water containing dodecyl benzene sulfonic acid sodium as a surface active agent in an amount of 0.2 parts by weight, and was adjusted to have pH of 5.5 by adding diethyl amine. After that, electrolyte aluminum sulfate was added in an amount of 0.3 parts by weight with agitation and subsequently agitated at a high speed and thus dispersed by using a TK homo mixer.

Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide, polymerization was conducted for 5 hours to grow up particles. After the polymerization, the pH was adjusted to be 5 or more while the temperature was increased to 95° C. and then maintained for 6 hours in order to improve the bonding strength of associated particles. The obtained particles were washed with water and dried under vacuum at a temperature of 45° C. for 10 hours. In this manner, mother particles for cyan toner were obtained. The obtained mother particles for cyan toner had a mean particle diameter of 6.8 μm and a degree of circularity of 0.98. The work function of the mother particles for cyan toner was measured by using the surface analyzer (AC-2, produced by Riken Keiki Co., Ltd) with radiation amount of 500 nW and the measured value was 5.57 eV.

To the toner mother particles, hydrophobic silica (having a mean particle diameter of 12 nm, a specific surface area of $140/m^2/g$) surface-treated with hexamethyldisilazane (HMDS) was added in an amount of 0.5 weight % and hydrophobic silica (having a mean particle diameter of 40 nm, a specific surface area of $45/m^2/g$) treated by the same treatment was added in an amount of 0.5 weight %, thereby producing a toner 1. The work function of the obtained toner 1 was 5.58 eV.

(Product Example of Organic Photoreceptor (OPC 1))

A seamless nickel electroforming pipe having a thickness 40 μm and a diameter of 85.5 mm was used as a conductive substrate. A coating liquid was prepared by dissolving and dispersing 6 parts by weight of alcohol dissolvable nylon [available from Toray Industries, Inc. (CM8000)] and 4 parts by weight of titanium oxide fine particles treated with aminosilane into 100 parts by weight of methanol. The coating liquid was coated on the peripheral surface of the conductive substrate by the ring coating method and was dried at a temperature 100° C. for 40 minutes, thereby forming an undercoat layer having a thickness of 1.5 to 2 μm. A pigment dispersed liquid was prepared by dispersing 1 part by weight of oxytitanyl phthalocyanine pigment as a charge generation pigment, 1 part by weight of butyral resin [BX-1, available from Sekisui Chemical Co., Ltd.], and 100 parts by weight of dichloroethane for 8 hours by a sand mill with glass beads of ϕ1 mm. The pigment dispersed liquid was applied on the undercoat layer and was dried at a temperature of 80° C. for 20 minutes, thereby forming a charge generation layer having a thickness of 0.3 μm. A liquid was prepared by dissolving 40 parts by weight of charge transport material of a styryl compound having the aforementioned structural formula (1) and 60 parts by weight of polycarbonate resin (Panlite TS, available from Teijin Chemicals Ltd.) into 400 parts by weight of toluene. The charge transport material liquid was applied on the charge generation layer by the dip coating method to have a thickness of 22 μm when dried, thereby forming a charge transport layer. In this manner, an organic photoreceptor (OPC 1) having a double-layered photosensitive layer was obtained. A test piece was made by cutting a part of the obtained organic photoreceptor and the work function the test piece was measured by using the surface analyzer (AC-2, produced by Riken Keiki Co., Ltd) with radiation amount of 500 nW. The measured value was 5.48 eV.

(Production of Development Roller)

An aluminum pipe of 18 mm in diameter was surfaced with nickel plating (thickness: 23 μm) to have surface roughness (Ra) of 4 μm, thereby obtaining a development roller 11. The work function of the surface of the obtained development roller 11 was measured and the measured value was 4.58 eV.

(Product Example of Transfer Medium)

A uniformly dispersed liquid composed of 30 parts by weight of vinyl chloride-vinyl acetate copolymer, 10 parts by weight of conductive carbon black, and 70 parts by weight of methyl alcohol was applied on a polyethylene terephthalate resin film of 130 μm in thickness with aluminium deposited thereon by the roll coating method to have a thickness of 20 μm and dried to form an intermediate conductive layer. Then, a coating liquid made by mixing and dispersing the following components: 55 parts by weight of nonionic aqueous polyurethane resin (solid ratio: 62 wt. %), 11.6 parts by weight of polytetrafluoroethylene emulsion resin(solid ratio: 60 wt. %), 25 parts by weight of conductive tin oxide, 34 parts by weight of polytetrafluoroethylene fine particles (max particle diameter: 0.3 μm or less), 5 parts by weight of polyethylene emulsion (solid ratio: 35 wt. %), and 20 parts by weight of deionized water, was coated on the intermediate conductive layer by the roll coating method to have a thickness of 10 μm and dried in the same manner so as to form a transfer layer. The obtained coated sheet was cut to have a length of 540 mm. The ends of the cut piece are superposed on each other with the coated surface outward and welded by ultrasonic, thereby making an intermediate transfer belt. The volume resistivity of this transfer belt was $2.5\times10^{10}$ Ωcm. The work function was 5.37 eV and the normalized photoelectron yield was 6.90.

Example 18

The $SiO_2$ particles-1, the $SiO_2$ particles-2, $Al_2O_3$ particles, the mixed oxide particles-1, the mixed oxide particles-2, and the combined oxide particles were added to toners 1, respectively, in an amount of 0.5 weight % each and mixed by using a commercial blender, thereby making toners 1—1 through 1-6.

Images were formed to have a solid image density in the order of 1.3 according to the contact developing process by using full color printers as shown in FIG. 8 each employing the development roller, the organic photoreceptor, and the transfer medium which are obtained in the above, with each of the toners set in each cyan developing device. The conditions for forming images are that the dark potential was −600 V, the light potential was −100 V, the developing bias was −200 V, the supply roller and the development roller were in the same potential, and the primary transfer voltage was +300 V.

The transfer efficiency to the photoreceptor and the amount of fog toner on the photoreceptor were measured by the tape transfer method and the results are shown in Table 22. After a solid image was formed with a first color, a white solid image was formed with a second color. At this point, the first color reversely transferred to the photoreceptor now only having non-image portion corresponding to the white solid image was measured as the amount of reverse transfer toner by the tape transfer method. The results of this were also shown in Table 22.

The tape transfer method is a method comprising attaching a mending tape, available from Sumitomo 3M Ltd., onto toner existing on the photoreceptor to transfer fog toner particles or reverse transfer toner particles onto the mending tape, attaching the tape on a white plain paper and also attaching another tape, not attached on the photoreceptor, on a white plain paper, measuring their reflection densities, and obtaining the difference by subtracting the density of the other tape from the measured value of the tape after attachment. The difference is defined as the reflection density of fog toner or reverse transfer density. On the other hand, the transfer efficiency was obtained by attaching such tapes onto toner existing on the photoreceptor before and after the transfer, measuring the weights of the tapes, and calculating a difference therebetween.

TABLE 22

| Toner particles | OD value of fog toner | OD value of reverse transfer toner | Transfer efficiency (%) |
|---|---|---|---|
| Toner 1-1 | 0.158 | 0.009 | 96.8 |
| Toner 1–2 | 0.185 | 0.015 | 96.4 |
| Toner 1–3 | 0.093 | 0.070 | 96.6 |
| Toner 1–4 | 0.055 | 0.011 | 96.5 |
| Toner 1–5 | 0.048 | 0.023 | 96.4 |
| Toner 1–6 | 0.040 | 0.008 | 98.3 |

It was found that the toner 1-4 and the toner 1-5, as toners obtained by externally adding external particles, previously obtained by mixing alumina particles and silica particles according to the dry method, to toner particles composed of mother particles and silica particles externally adhering to the mother particles, are superior in the amount of fog toner (i.e. smaller amount of fog toner) to the toner 1—1 through the toner 1-3, as toners only containing silica particles as the external additive particles and a toner obtained by externally adding alumina particles to toner particles composed of mother particles and silica particles externally adhering to the mother particles, but are inferior in the amount of reverse transfer toner (i.e. larger amount of reverse transfer toner) to the toners only containing silica particles as external additives. On the other hand, the toner 1-6 of the present invention is superior both in the amount of fog toner and the amount of reverse transfer toner and also has improved transfer efficiency.

As for the toner 1, the work function of the mother particles thereof ware 5.57 eV which was between the first work function of 5.18 eV and the second work function of 5.62 of the combined oxide particles. It can be understood that this is the reason for reducing the amount of fog toner and the amount of reverse transfer toner and improving the transfer efficiency.

Example 19

The combined oxide particles (consisting of 65 weight % of $Al_2O_3$ and 35 weight % of $SiO_2$, having a mean primary particle diameter of 17 nm, a specific surface area according to the BET method of 110 $m^2/g$) treated to have hydrophobic property with dimethylsilane (DMS) was added to externally adhere to toners 1 at ratios shown in Table 23, respectively, thereby obtaing toners. The respective work functions of the obtained toners were measured. Images of 5% duty were printed on 10 sheets of paper by using the full color printer as shown in FIG. 8 with each of the toners set to a cyan developing device. After that, the development roller was removed from the cyan developing device and the charge distribution characteristic of toner on the development roller was measured by using an "E-SPART III" available from Hosokawa Micron Corporation. The results are shown in Table 23.

TABLE 23

| Adding amount (wt %) | Work function (eV) | Normalized photoelectron yield | Mean charge amount q/m (μc/g) | Amount of positively charged toner (wt %) |
|---|---|---|---|---|
| 0 | 5.58 | 13.19 | −17.96 | 10.40 |
| 0.2 | 5.62 | 16.56 | −15.95 | 5.83 |
| 0.5 | 5.62 | 17.46 | −21.86 | 3.70 |
| 1.0 | 5.67 | 21.36 | −20.71 | 2.10 |
| 2.0 | 5.63 | 19.30 | −15.40 | 5.61 |

It is found that according to the increase in the adding amount of the external additive of the fifth embodiment, the amount of positively charged toner is reduced while the mean charge amount is increased or little changed. This means that the reduction in amount of fog toner is facilitated and the reduction in amount of reverse transfer toner is also facilitated.

Example 20

(Production Example of Toner 2)

A magenta toner 2 was obtained in the same manner as the above toner 1 except that Quinacridon was used as the pigment and that the temperature for improving the association and the film bonding strength of secondary particles was still kept at 90° C. The magenta toner had a mean particle diameter of 6.9 μm, a degree of circularity of 0.97. To this magenta toner, the external additives of the same kinds and the same amount as used in the toner 1 were added and hydrophobic alumina-silica combined oxide fine particles of the present invention was additionally added in an amount of 0.5% and mixed. The work function of the magenta toner was measured and the measured value was 5.67 eV.

(Product Example of Organic Photoreceptor (OPC 2))

An organic photoreceptor (OPC 2) was obtained in the same manner as the organic photoreceptor (OPC 1) except that an aluminum pipe of 85.5 mm in diameter was used as a conductive substrate, that titanyl phthalocyanine pigment was used as a charge generation pigment, and that a distyryl compound (2) having the aforementioned formula (2) was used as the charge transport material. The work function of the obtained organic photoreceptor was measured and the measured value was 5.50 eV.

Images were formed to have a solid image density in the order of 1.3 according to the contact developing process and according to the non-contact developing process by using full color printers as shown in FIG. 8, each employing the development roller and the transfer medium which are obtained in Example 18 and employing the OPC 1 in case of the contact developing process and the OPC 2 in case of the non-contact developing process, with each of the toners 2 set in each magenta developing device. The conditions for forming images in case of contact developing process are that the dark potential was −600 V, the light potential was −100 V, the developing bias was −200 V, the supply roller and the development roller were in the same potential, and the primary transfer voltage was +300 V. The conditions for forming images in case of non-contact developing process are that the gap rollers were arranged on both sides of the development roller to have a developing gap of 210 μm, the AC to be superimposed on the DC developing bias of −350 V was applied with a frequency of 2.5 kHz and a P—P voltage of 1400 V, and the others were the same as those in case of contact developing process.

As for the case of the contact developing process, the OD value of fog toner, the OD value of reverse transfer toner, and the transfer efficiency (%) were measured in the same manner as Example 18 and the results are shown in Table 24. Similarly, the results of the case of the non-contact developing process are shown in Table 25.

TABLE 24

| Adding amount (wt %) | OD value of fog toner | OD value of reverse transfer toner | Transfer efficiency (%) |
|---|---|---|---|
| 0 | 0.034 | 0.020 | 88.2 |
| 0.2 | 0.014 | 0.015 | 90.2 |
| 0.5 | 0.021 | 0.010 | 98.7 |
| 1.0 | 0.028 | 0.009 | 98.8 |
| 2.0 | 0.035 | 0.003 | 98.3 |

TABLE 25

| Adding amount (wt %) | OD value of fog toner | OD value of reverse transfer toner | Transfer efficiency (%) |
|---|---|---|---|
| 0 | 0.013 | 0.023 | 93.0 |
| 0.2 | 0.004 | 0.020 | 95.0 |
| 0.5 | 0.001 | 0.010 | 96.2 |
| 1.0 | 0.000 | 0.009 | 97.2 |
| 2.0 | 0.002 | 0.001 | 98.3 |

As apparent from Table 24 and Table 25, according to the increase in the adding amount of the external additive of the present invention, the amount of pfog toner and the amount of reverse transfer toner are both reduced and the transfer efficiency was improved.

Example 21

(Production Example of Toner 3)

Per 100 parts by weight of a mixture (available from Sanyo Chemical Industries, Ltd.) which was 50:50 (by weight) of polycondensate polyester, composed of aromatic dicarboxylic acid and bisphenol A of alkylene ether, and a compound partially crosslinked by polyvalent metal of the polycondensate polyester, 5 parts by weight of phthalocyanine Blue as a cyan pigment, 3 parts by weight of polypropylene having a melting point of 152° C. and a Mw of 4000 as a release agent, and 4 parts by weight of metal complex compound of salicylic acid E-81 (available from Orient Chemical Industries, Ltd.) as a charge control agent were uniformly mixed by using a Henschel mixer, kneaded by a twin-shaft extruder with an internal temperature of 150° C., and then cooled. The cooled substance was roughly pulverized into pieces of 2 square mm or less and then pulverized into fine particles by a turbo mill. The fine particles were classified by a classifier of a rotary type, thereby obtaining toner mother particles for cyan toner having a mean particle diameter of 7.5 μm and a degree of circularity of 0.925. To the obtained toner mother particles, two kinds of hydrophobic silicas used in the toner 1 were added in an amount of 0.5% each, and the combined oxide fine particles, treated to have hydrophobic property, were added in an amount of 0.5%, thereby obtaining a toner 3. The work function of the obtained toner 3 was measured and the measured value was 5.47 eV.

(Production Example of Toners 4, 5, 6)

According to the aforementioned production example of the toner 3, a toner 4 (Quinacridon was used as a magenta pigment), a toner 5 (Pigment Yellow 180 was used as an yellow pigment), and a toner 6 (Carbon Black was used as a black pigment) were obtained. The mean particle diameters and the degrees of circularity of the obtained toners were substantially the same as those of the toner 3. The work functions of the respective toners were 5.66 eV (magenta), 5.63 eV (yellow), and 5.72 eV (black).

By using the toners 3 through 6 for full colors, an image corresponding to a color manuscript (with 5% duty for each color) was successively printed on 10,000 sheets of paper according to the contact developing process defined in Example 20. The image on the $10{,}000^{th}$ sheet was compared with the image on the first sheet. As a result of this, there was no degradation in image quality. In addition, there was no toner scattering in the apparatus. Therefore, the toners had stable charging properties. After the full color toners were used, the total weight of the content in the container housing cleaning toner was measured and the measured value was 96 g. It was confirmed that the amount of toner cleaned and collected was relatively small. The weight of collected toners was about 34% of the expected amount of toners collected by cleaning the photoreceptor. This means that the amount of collected toners can be reduced.

Example 22

(Production Example of Toner 7)

Toner mother particles were obtained in the same manner as the above toner 1 except that Carmin 6B was used as the pigment and that the temperature for improving the association and the film bonding strength of secondary particles was still kept at 90° C. The toner mother particles for magenta toner had a mean particle diameter 6.9 μm, and a degree of circularity of 0.97, and a work function of 5.56 eV. To the mother particles, the external additives of the same kinds and the same amount as used in the toner 1 were added and combined oxide fine particles was additionally added in an amount of 0.5%, thereby obtaining a toner 7. The work function of the toner 7 was measured and the measured value was 5.60 eV.

Images were formed to have a solid image density in the order of 1.3 according to the contact developing process and according to the non-contact developing process by using full color printers as shown in FIG. 8, each employing the development roller and the transfer medium which are obtained in Example 18 and employing the OPC 1 in case of the contact developing process and the OPC 2 in case of the non-contact developing process, with the toner 7 set in each magenta developing device. The conditions for forming images in case of contact developing process are that the dark potential was −600 V, the light potential was −100 V, the developing bias was −200 V, the supply roller and the development roller were in the same potential, and the primary transfer voltage was +300 V. The conditions for forming images in case of non-contact developing process are that the gap rollers were arranged on both sides of the development roller to have a developing gap of 210 μm, the AC to be superimposed on the DC developing bias of −350 V was applied with a frequency of 2.5 kHz and a P—P voltage of 1400 V, and the others were the same as those in case of contact developing process.

As for the case of the contact developing process, the OD value of fog toner, the OD value of reverse transfer toner, and the transfer efficiency (%) were measured in the same manner as Example 18 and the results are the same as the results shown in Table 24. Similarly, the results of the case of the non-contact developing process are the same as the results shown in Table 25.

As apparent from Table 24 and Table 25, according to the increase in the adding amount of the external additive of the fifth embodiment, the amount of fog toner and the amount of reverse transfer toner are both reduced and the transfer efficiency was improved.

As for the toner 7, the work function of the mother particles thereof ware 5.56 eV which was between the first work function of 5.18 eV and the second work function of 5.62 of the combined oxide particles. It can be understood that this is the reason for reducing the amount of fog toner and the amount of reverse transfer toner and improving the transfer efficiency.

Example 23

(Production Example of Toner 8)

Per 100 parts by weight of polycondensate polyester resin (HIMER ES-801, available from Sanyo Chemical Industries, Ltd., consisting of non-crosslinkable component and crosslinkable component at a mixing rate of 45/55), 5 parts by weight of Phthalocyanine Blue as a cyan pigment, 3 parts by weight of polypropylene having a melting point of 152° C. and Mw of 4000 as a release agent, and 4 parts by weight of a metal complex compound of salicylic E-81 (available from Orient Chemical Industries, LTD.) as a charge control agent were uniformly mixed by a Henschel mixer, kneaded by a twin-shaft extruder with an internal temperature of 150° C., and then cooled. The cooled substance was roughly pulverized into pieces of 2 square mm or less and then pulverized into fine particles by a turbo mill. The fine particles were classified by a classifier of a rotary type, thereby obtaining toner mother particles for cyan toner having a mean particle diameter of 7.4 $\mu$m, a degree of circularity of 0.925, and a work function of the toner mother particles was 5.38 eV. To the obtained toner mother particles, two kinds of hydrophobic silicas used in the toner 1 were added in an amount of 0.5% each, and the combined oxide fine particles, treated to have hydrophobic property, were added in an amount of 0.5%, thereby obtaining a toner 8. The work function of the obtained toner 8 was measured and the measured value was 5.43 eV.

(Production Example of Toners 9, 10, 11)

According to the aforementioned production example of the toner 8, a toner 9 (Carmin 6B was used as a magenta toner pigment), a toner 10 (Pigment Yellow 93 was used as an yellow toner pigment), and a toner 11 (Carbon Black was used as a black toner pigment) were obtained. The mean particle diameters and the degrees of circularity of the obtained toner mother particles were substantially the same as those of the toner 8. The work functions of the respective toners were 5.42 eV (magenta), 5.55 eV (yellow), and 5.60 eV (black).

(Production Example of Toners 12, 13, 14)

A toner 12 was obtained in the same manner as the above toner 8 except that a mixture (available from Sanyo Chemical Industries, Ltd.) which was 50:50 (by weight) of polycondensate polyester, composed of aromatic dicarboxylic acid and bisphenol A of alkylene ether, and a compound partially crosslinked by polyvalent metal of the polycondensate polyester was used instead of the polyester resin and that Quinacridon was used as the pigment. Further, a toner 13 was obtained in the same manner as the toner 12 except that Pigment Yellow 180 was used as the pigment. Furthermore, a toner 14 was obtained in the same manner as the toner 12 except that Carbon Black was used as the pigment. The work functions of the respective toners were 5.66 eV (magenta), 5.63 eV (yellow), and 5.72 eV (black).

By using a combination of the toners 8 (cyan), 9 (magenta), 10 (yellow), and 11 (black) and a combination as a comparative example of toners 8 (cyan), 12 (magenta), 13 (yellow), and 14 (black), an image corresponding to a color manuscript (with 5% duty for each color) was successively printed on 10,000 sheets of paper by using a color printer of Example 22 according to the contact developing process. The image on the 10,000$^{th}$ sheet was compared with the image on the first sheet.

In the case of the combination of the toners 8-11, there was no degradation in image quality and there was no toner scattering in the apparatus. Therefore, it was found that the toners had stable charging properties. In addition, the total weight of the content in the container housing cleaning toners was measured and the measured value as the total weight of cleaning toners was 80 g. It was confirmed that the amount of each toner cleaned and collected was relatively small. The weight of collected toners was about 28% of the expected amount of toners collected by cleaning the photoreceptor.

On the other hand, in the case of the combination of toner 8 and the toners 12-14 of which mother particles had work functions larger than the second work function of the combined oxide particles, the total weight of collected toners was 96 g which was relatively large. The total weight of cleaning toner was about 34% of the expected amount of toners collected by cleaning the photoreceptor.

What we claim is:

1. A non-magnetic single-component toner having toner mother particles and external additives externally adhering to said toner mother particles, wherein said external additives comprise, at least, a small-particle hydrophobic silica for imparting the negative charging property to said toner mother particles and of which mean primary particle diameter is 20 nm or less, a large-particle hydrophobic silica for imparting the negative charging property to said toner mother particles and of which mean primary particle diameter is 30 nm or more and a hydrophobic rutile/anatase type titanium oxide having a work function nearly equal to the work function of said toner mother particles and having a spindle shape of which major axial diameter is in a range from 0.02 $\mu$m to 0.10 $\mu$m and the ratio of the major axial diameter to the minor axial diameter is set to be 2 to 8, and wherein the work function of said toner mother particle is set to be larger than the work function of said each hydrophobic silica and is set to be nearly equal to the work function of said hydrophobic rutile/anatase type titanium oxide.

2. A non-magnetic single-component toner as claimed in claim 1, wherein said small-particle hydrophobic silica is added in an amount larger than the adding amount of said hydrophobic rutile/anatase type titanium oxide.

3. A non-magnetic single-component toner as claimed in claim 1 or 2, wherein the total amount of said external additives is 0.5% by weight or more and 4.0% by weight or less relative to the weight of the toner mother particles.

4. A method of producing a non-magnetic single-component toner as claimed in claims 1 or claim 2, wherein:

said toner mother particles and said two hydrophobic silicas of which mean primary particle diameters are different from each other are first mixed to make a mixture, and said hydrophobic rutile/anatase type titanium oxide is then added into said mixture and mixed.

5. An image forming apparatus which has a predetermined gap between a latent image carrier and a development roller and is structured such that the development roller carries a non-magnetic single component toner comprising toner mother particles coated with external additives to develop an electrostatic latent image on said latent image carrier according to the non-contact development, wherein said external additives include at least a hydrophobic rutile/anatase type titanium oxide having a work function larger than or nearly equal to the work function of said toner mother particles and of which each particle is in a spindle shape.

6. An image forming apparatus which is structured such that an electrostatic latent image on a latent image carrier is developed with a non-magnetic single component toner comprising toner mother particles coated with external additives to form a toner image and the toner image is transferred to an intermediate transfer medium, wherein said external additives include at least a hydrophobic rutile/anatase type titanium oxide having a work function larger than or nearly equal to the work function of said toner mother particles and of which each particle is in a spindle shape.

7. An image forming apparatus as claimed in claim 5 or 6, wherein said external additives include a hydrophobic silica having a work function smaller than the work function of said toner mother particles for imparting a negative charging property to said toner mother particles.

8. An image forming apparatus as claimed in claim 7, wherein said hydrophobic silica comprises a small-particle hydrophobic silica having a work function smaller than the work function of said toner mother particles for imparting the negative charging property to said toner mother particles and of which mean primary particle diameter is 20 nm or less, and a large-particle hydrophobic silica having a work function smaller than the work function of said toner mother particles for imparting the negative charging property to said toner mother particles and of which mean primary particle diameter is 30 nm or more.

9. A non-magnetic single-component toner as claimed in claim 1 or 2, wherein the non-magnetic single-component toner is a pulverized toner of which toner mother particles are prepared by the pulverization method or a polymerized toner of which toner mother particles are prepared by the polymerization method.

10. A non-magnetic single-component toner as claimed in claim 1 or 2, wherein the degree of circularity of the non-magnetic single-component toner is set to be 0.91 (value measured by FPIA2100) or more.

11. A non-magnetic single-component toner as claimed claim 1 or 2, wherein the particle diameter ($D_{50}$), as 50% particle diameter based on the number, of the non-magnetic single-component toner is set to be 9 $\mu$m or less.

12. A method of producing a non-magnetic single-component toner as claimed in claims 3, wherein:

said toner mother particles and said two hydrophobic silicas of which mean primary particle diameters are different from each other are first mixed to make a mixture, and said hydrophobic rutile/anatase type titanium oxide is the added into said mixture and mixed.

* * * * *

UNITED STATES PATENT AND TRADEMARK OFFICE

CERTIFICATE OF CORRECTION

PATENT NO. : 6,875,550 B2
DATED : April 19, 2005
INVENTOR(S) : Nobuhiro Miyakawa et al.

It is certified that error appears in the above-identified patent and that said Letters Patent is hereby corrected as shown below:

Title page,
Item [30], Foreign Application Priority Data, please delete "2001-30939" and insert -- 2001-370939 --.

Signed and Sealed this

Fifteenth Day of November, 2005

JON W. DUDAS
*Director of the United States Patent and Trademark Office*